US012280976B2

(12) United States Patent
Yamano et al.

(10) Patent No.: US 12,280,976 B2
(45) Date of Patent: Apr. 22, 2025

(54) SHEET CONVEYANCE APPARATUS AND IMAGE FORMING SYSTEM

(71) Applicant: CANON KABUSHIKI KAISHA, Tokyo (JP)

(72) Inventors: Hiroyuki Yamano, Kanagawa (JP); Hiroharu Tsuji, Shizuoka (JP); Koji Miwa, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 87 days.

(21) Appl. No.: 18/134,714

(22) Filed: Apr. 14, 2023

(65) Prior Publication Data

US 2023/0348220 A1 Nov. 2, 2023

(30) Foreign Application Priority Data

| | | |
|---|---|---|
| Apr. 28, 2022 | (JP) | 2022-075403 |
| Jun. 8, 2022 | (JP) | 2022-092796 |
| Jun. 8, 2022 | (JP) | 2022-092797 |
| Mar. 30, 2023 | (JP) | 2023-054938 |

(51) Int. Cl.
*B65H 29/60* (2006.01)

(52) U.S. Cl.
CPC ..... *B65H 29/60* (2013.01); *B65H 2301/5144* (2013.01); *B65H 2404/14* (2013.01); *B65H 2406/40* (2013.01)

(58) Field of Classification Search
CPC ..... B65H 2406/122; B65H 29/60; B65H 2301/5144; B65H 2404/14; B65H 2406/40; B65H 2801/27; G03G 2221/1645; G03G 21/206
See application file for complete search history.

(56) References Cited

U.S. PATENT DOCUMENTS

| | | | | |
|---|---|---|---|---|
| 11,221,586 | B2 | 1/2022 | Aono et al. | |
| 2010/0181717 | A1* | 7/2010 | Sumikura | G03G 15/6573 271/226 |
| 2013/0287413 | A1* | 10/2013 | Akamatsu | G03G 21/206 399/21 |

(Continued)

FOREIGN PATENT DOCUMENTS

| | | | |
|---|---|---|---|
| JP | 2006-232418 | A | 9/2006 |
| JP | 2010266799 | A * | 11/2010 |

(Continued)

*Primary Examiner* — Jennifer Bahls
(74) *Attorney, Agent, or Firm* — VENABLE LLP

(57) ABSTRACT

A sheet conveyance apparatus is arranged on an upper face portion of an image forming apparatus and conveys a sheet to a sheet processing apparatus. The sheet conveyance apparatus includes a conveyance path including a first path through which the sheet is conveyed toward the sheet processing apparatus and a second path branched from the first path, a switching guide to switch a conveyance route of the sheet between the first and second paths, an air blowing unit to send air toward the conveyance path, and an air intake port provided on an end portion on a front side of the sheet conveyance apparatus. A duct connects the air intake port and the air blowing unit, and an air blowing port blows the air from the air blowing unit to the conveyance path in a sheet conveyance direction.

14 Claims, 27 Drawing Sheets

(56) References Cited

U.S. PATENT DOCUMENTS

| | | | | |
|---|---|---|---|---|
| 2016/0154359 | A1* | 6/2016 | Watanabe | G03G 15/6529 271/225 |
| 2017/0017198 | A1* | 1/2017 | Harada | G03G 21/206 |
| 2020/0387102 | A1* | 12/2020 | Midorikawa | G03G 21/206 |
| 2021/0039411 | A1* | 2/2021 | Aono | B41J 11/007 |

FOREIGN PATENT DOCUMENTS

| | | | |
|---|---|---|---|
| JP | 2014-081403 | A | 5/2014 |
| JP | 2021-051272 | A | 4/2021 |

* cited by examiner

SHEET CONVEYANCE APPARATUS AND IMAGE FORMING SYSTEM

BACKGROUND OF THE INVENTION

Field of the Invention

The present invention relates to a sheet conveyance apparatus for conveying sheets, and an image forming system for forming images on sheets.

Description of the Related Art

In image forming systems, air blowing units for sending air into a sheet conveyance path may be provided with the aim to cool or dry sheets after image formation, to cool the conveyance path, and to prevent dew condensation. Japanese Patent Application Laid-Open Publication No. 2014-81403 discloses a configuration example of a fan and a duct for sending air toward a sheet conveyance path extending from a fixing unit to a sheet discharge portion.

Further, an image forming system is known in which a sheet conveyance apparatus and a sheet processing apparatus are connected to an image forming apparatus, and sheets to which an image has been formed in the image forming apparatus are conveyed through the sheet conveyance apparatus to the sheet processing apparatus. Japanese Patent Application Laid-Open Publication No. 2006-232418 discloses an image forming system equipped with a conveyance apparatus that is disposed on an upper portion of an image forming apparatus.

In some cases, according to the functions of the sheet conveyance apparatus, the conveyance path may be branched in the interior of the sheet conveyance apparatus. In such a case, if a plurality of fans are arranged to correspond to each of the plurality of conveyance paths being branched, the apparatus may be increased in cost and size.

SUMMARY OF THE INVENTION

According to a first aspect of the present invention, a sheet conveyance apparatus configured to be connected to an image forming apparatus configured to form an image on a sheet, and a sheet processing apparatus configured to subject the sheet to a processing, the sheet conveyance apparatus configured to receive the sheet from the image forming apparatus and convey the sheet to the sheet processing apparatus, the sheet conveyance apparatus includes a conveyance path including a first path through which the sheet is conveyed toward the sheet processing apparatus, and a second path branched from the first path, a switching guide configured to switch a conveyance route of the sheet between the first path and the second path, an air blowing unit configured to send air toward the conveyance path, and an air blowing port configured to blow the air from the air blowing unit to the conveyance path. The air blowing port is arranged upstream of the switching guide in a sheet conveyance direction of the first path, and configured to blow the air toward a downstream side in the sheet conveyance direction.

According to a second aspect of the present invention, a sheet conveyance apparatus configured to be connected to an image forming apparatus including a first sheet discharge port configured to discharge a sheet, and a second sheet discharge port arranged at a position different from the first sheet discharge port and configured to discharge a sheet, the sheet conveyance apparatus including a conveyance path through which the sheet discharged through the first sheet discharge port is transferred to a sheet processing apparatus, the sheet conveyance apparatus includes a first air intake port communicated with a first space through which the sheet discharged through the first sheet discharge port passes, the first space being surrounded by a casing of the image forming apparatus and a casing of the sheet conveyance apparatus, a second air intake port communicated with a second space through which the sheet discharged through the second sheet discharge port passes, the second space being formed between a first surface provided on the casing of the image forming apparatus and a second surface provided on the casing of the sheet conveyance apparatus, the second sheet discharge port being formed on the first surface, the second surface facing the first surface, a fan configured to rotate and generate an air current, and an air discharge port. The fan takes in air through the first air intake port and the second air intake port and discharges air to an exterior of the sheet conveyance apparatus through the air discharge port.

According to a third aspect of the present invention, an image forming system includes an image forming apparatus including a first sheet discharge port configured to discharge a sheet, and a second sheet discharge port arranged at a position different from the first sheet discharge port and configured to discharge a sheet, a sheet processing apparatus configured to process a sheet, and a sheet conveyance apparatus configured to be connected to the image forming apparatus and includes a conveyance path configured to convey a sheet discharged through the first sheet discharge port to the sheet processing apparatus. The sheet conveyance apparatus includes a first air intake port communicated with a first space through which the sheet discharged through the first sheet discharge port passes, the first space being surrounded by a casing of the image forming apparatus and a casing of the sheet conveyance apparatus, a second air intake port communicated with a second space through which the sheet discharged through the second sheet discharge port passes, the second space being formed between a first surface provided on the casing of the image forming apparatus and a second surface provided on the casing of the sheet conveyance apparatus, the second sheet discharge port being formed on the first surface, the second surface facing the first surface, a fan configured to rotate and generate an air current, and an air discharge port. The fan takes in air through the first air intake port and the second air intake port and discharges air to an exterior of the sheet conveyance apparatus through the air discharge port.

Further features of the present invention will become apparent from the following description of exemplary embodiments with reference to the attached drawings.

DESCRIPTION OF THE EMBODIMENTS

Embodiments according to the present disclosure will be described hereafter with reference to the drawings.

First Embodiment

Entire Configuration

Figure 1:
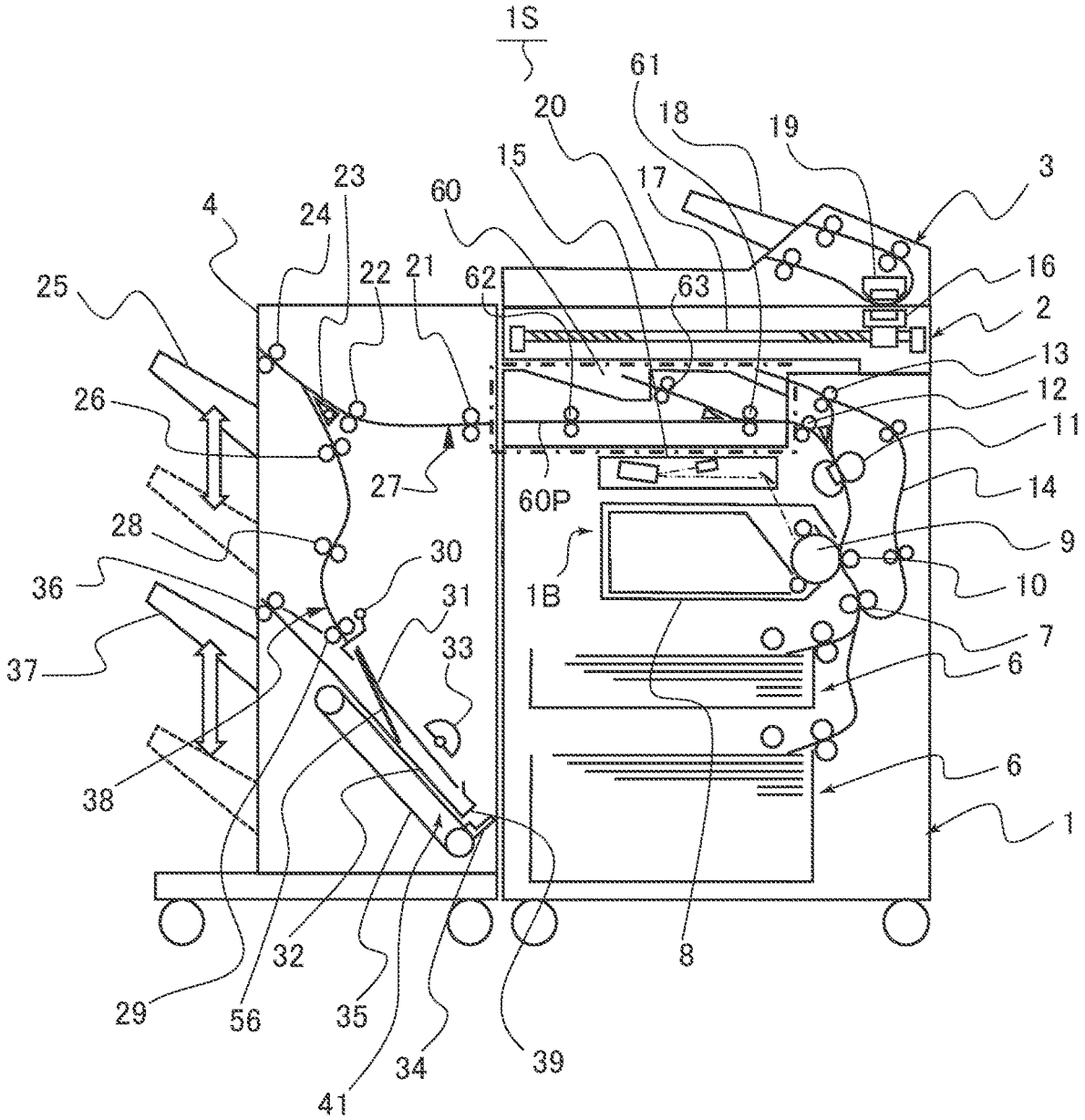
FIG. 1 is a schematic view of an image forming system according to a first embodiment.

FIG. 1 illustrates an entire configuration of an image forming system 1S according to a first embodiment. The image forming system 1S includes an image forming apparatus 1, an image reading apparatus 2, a document sending apparatus 3, an intermediate conveyance apparatus 60, and a postprocessing apparatus 4. The image forming apparatus 1 includes an image forming unit 1B of an electrophotographic system serving as an image forming unit, wherein image is formed while conveying a sheet serving as a recording material one by one. Various types of sheets can be used, examples of which include paper such as normal paper and thick paper, plastic films, cloths, sheet materials subjected to surface treatment such as coated paper, and sheet materials having special shapes such as envelopes and index sheets. The postprocessing apparatus 4 is a sheet processing apparatus that subjects the sheets to which image has been formed to processes such as a binding process or a punching process if necessary, and discharges the sheets as a product of the image forming system 1S.

Figure 2:
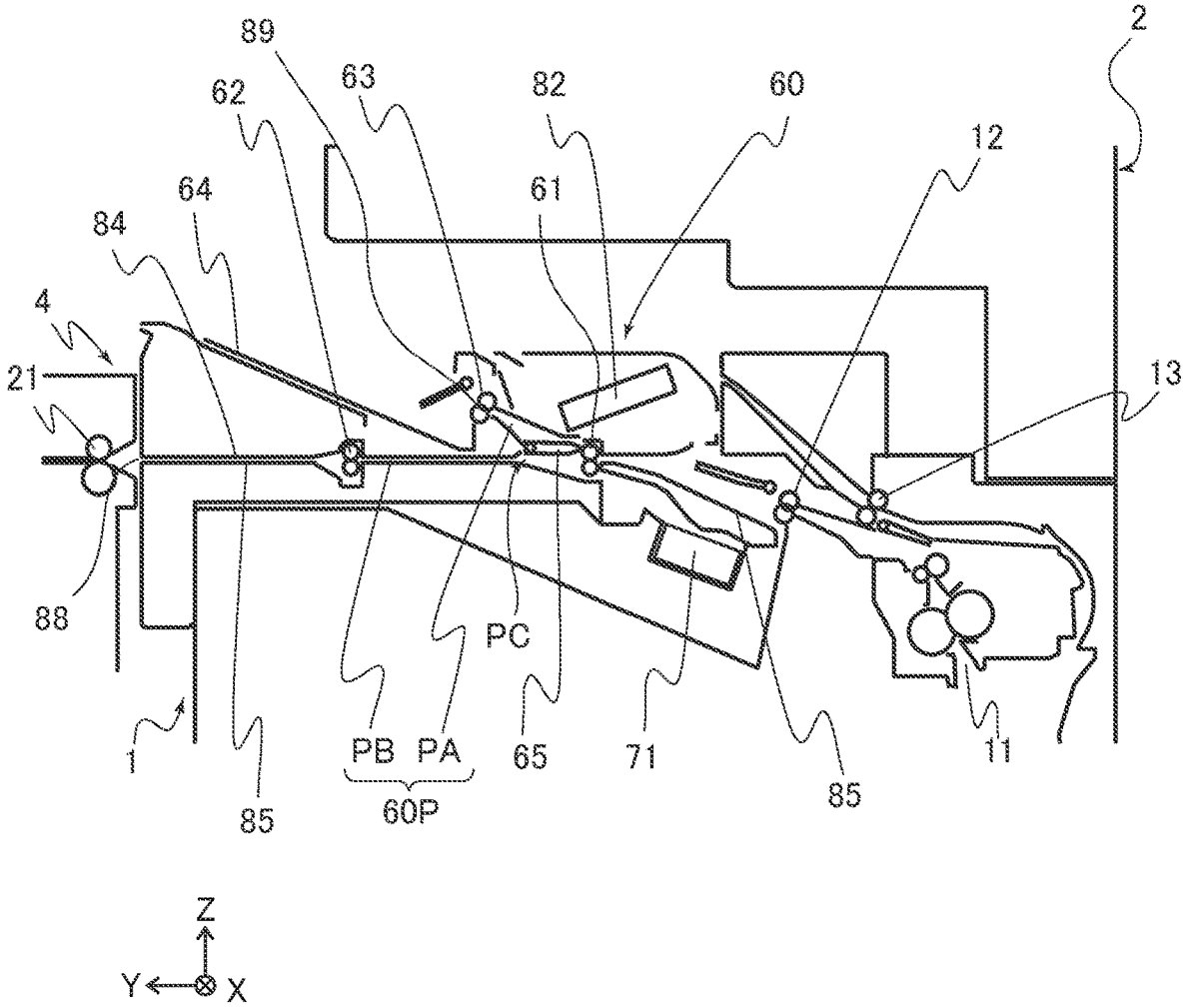
FIG. 2 is a schematic view of an intermediate conveyance apparatus according to the first embodiment.

FIG. 2 is a cross-sectional view illustrating an enlarged view of a vicinity of the intermediate conveyance apparatus 60. The intermediate conveyance apparatus 60 is a sheet conveyance apparatus that conveys sheets from the image forming apparatus 1 to the postprocessing apparatus 4. The intermediate conveyance apparatus 60 is attached additionally to the image forming apparatus 1 when connecting the postprocessing apparatus 4 to the image forming apparatus 1. In FIG. 1, the area surrounded by dot and dash lines is the intermediate conveyance apparatus 60.

As illustrated in FIG. 1, the document placed on a document tray 18 of the document sending apparatus 3 is conveyed to image reading units 16 and 19. The image reading units 16 and 19 can read images on both surfaces of a document in a single sheet conveyance by respectively reading document surfaces facing each of the image reading units 16 and 19. The document is discharged onto a document discharge portion 20. The image reading apparatus 2 can read documents such as a booklet document, which cannot be conveyed in the document sending apparatus 3, by reciprocated scanning of the image reading unit 16 using a driving device 17. The image read by the image reading units 16 and 19 or an image transmitted from a server or a computer not shown is developed and adjusted by a controller (not shown) disposed in the image forming apparatus 1, and an image forming operation is performed.

The image forming apparatus 1 includes a plurality of feeding devices 6 each storing a plurality of sheets and feeding sheets one by one with a predetermined feeding interval. The sheets fed from the feeding device 6 are subjected to skew feed correction at a registration roller 7, and are conveyed to a photosensitive drum 9 rotatably supported on an image forming cartridge 8 and to a transfer roller 10 having a predetermined charge applied thereto. A toner image is formed on a surface of the photosensitive drum 9 through various steps of exposure, charge, latent image formation, and image development within the image forming cartridge 8. The latent image formation is performed by a laser scanner unit 15 that scans a blinking laser light in a conveying direction and a perpendicular direction using a polygon mirror and lens and forms an image. The sheet to which the toner image has been transferred passes through a fixing unit 11 where toner on the sheet is heated, pressed, and fixed, is conveyed to a sheet discharge roller pair 12, and is sent to the intermediate conveyance apparatus 60. When performing duplex printing, the sheet is temporarily conveyed to a reverse conveyance roller pair 13, subjected to switchback conveyance when a leading edge and a trailing edge of the sheet are switched, and then sent to a refeeding conveyance portion 14, before being conveyed again at a predetermined timing to the registration roller 7 where image formation is executed for the second time.

As illustrated in FIG. 2, the intermediate conveyance apparatus 60 has a conveyance path 60P formed in an interior thereof through which sheets are conveyed. The conveyance path 60P includes a through path PB extending from the image forming apparatus 1 to the postprocessing apparatus 4, and a sheet discharge path PA branched from the through path PB. An intermediate sheet discharge tray 64 serving as a supporting portion for supporting sheets is provided on an upper surface of the intermediate conveyance apparatus 60.

If a sheet discharge destination of the sheet is the intermediate sheet discharge tray 64, the sheet passes through the sheet discharge path PA and is conveyed to a sheet discharge roller pair 63, and thereafter, discharged onto the intermediate sheet discharge tray 64. If the sheet discharge destination is the postprocessing apparatus 4, the sheet passes through the through path PB and is transferred from the intermediate conveyance apparatus 60 to an inlet roller pair 21 of the postprocessing apparatus 4. A sheet conveyance speed by the inlet roller pair 21 of the postprocessing apparatus 4 is set faster than the sheet conveyance speed in the intermediate conveyance apparatus 60. In order to absorb a difference between the conveyance speed by the inlet roller pair 21 and the conveyance speed within the intermediate conveyance apparatus 60, a one-way clutch is provided to conveyance rollers 61 and 62 disposed within the intermediate conveyance apparatus 60. Thereby, when the sheet is pulled in the conveyance direction, the conveyance rollers 61 and 62 rotate idly with respect to the roller shaft and rotate at an angular velocity faster than the roller shaft.

A buffer pre-roller 22 accelerates the sheet at a predetermined timing based on a timing of passing of the trailing edge of the sheet at an inlet sensor 27 of the postprocessing apparatus 4. If the sheet discharge destination is an upper sheet discharge tray 25, the sheet is decelerated to a predetermined sheet discharge speed when the trailing edge of the sheet reaches an area between the buffer pre-roller 22 and a second reverse conveyance roller 24, and the sheet is discharged onto the upper sheet discharge tray 25.

If the sheet discharge destination is a lower sheet discharge tray 37, the sheet is switched back after the trailing edge of the sheet has passed through a reverse flow preventing valve 23, and the sheet is conveyed to an inner discharge roller 26. After the leading edge of the sheet has reached the inner discharge roller 26, the nip of the second reverse conveyance roller 24 is released to prepare for reception of a succeeding sheet conveyed toward the second reverse conveyance roller 24. Driving of the inner discharge roller 26 is temporarily stopped in a state where the sheet is nipped by the inner discharge roller 26, and at a matched timing with the passing of the succeeding sheet, the inner discharge roller 26 is driven in reverse rotation to convey the preceding sheet again toward the upper sheet discharge tray 25. As described, sheet buffering is performed by overlapping the preceding and succeeding sheets. Sheet buffering enables to buffer a plurality of sheets by repeating the above-described operation for multiple times.

After buffering a predetermined number of sheets, the sheet conveyed from the inner discharge roller 26 is passed through an intermediate conveyance roller 28 and sent to a kick-out roller 29, and conveyed to an intermediate supporting portion 41 composed of an intermediate support upper guide 31 and an intermediate support lower guide 32. A vertical alignment reference plate 39 is arranged at a most downstream portion of the intermediate supporting portion 41. Alignment of the sheet bundle is performed by abutting a sheet edge portion in the conveyance direction to the vertical alignment reference plate 39.

Further, a pressing guide 56 having flexibility is fixed to the intermediate support upper guide 31, and the passing guide 56 abuts against the sheets supported on the intermediate supporting portion 41 with a predetermined pressing force. Further, a half-moon roller 33 for pressing the sheet having passed through the kick-out roller 29 to the vertical alignment reference plate is supported rotatably on the intermediate support upper guide 31 downstream of the pressing guide 56. After the trailing edge of the sheet has passed through an intermediate support pre-sensor 38, the half-moon roller 33 conveys the sheet at a predetermined timing toward the vertical alignment reference plate 39. After the leading edge of the sheet has been abutted against the vertical alignment reference plate 39, conveyance pressure of the half-moon roller 33 is adjusted so that the half-moon roller 33 slips on the sheet.

Further, a bundle pressing flag 30 for suppressing the trailing edge of the sheet from lifting up so that the trailing edge of the sheet supported on the intermediate supporting portion 41 does not interfere with the leading edge of the succeeding sheet is supported rotatably at a position downstream of the kick-out roller 29. After the sheet has reached the vertical alignment reference plate, a horizontal alignment jogger not shown performs an alignment operation of a horizontal alignment reference plate not shown toward front and rear directions of the sheet surface of FIG. 1, and aligns the sheet bundle.

After the alignment process of a predetermined number of sheets has been completed, a binding operation is performed by a stapler not shown. Thereafter, the sheet bundle is pushed from the intermediate supporting portion 41 toward the lower sheet discharge tray 37 by a sheet bundle discharge guide 34 connected to a guide drive portion 35 being moved in parallel from a standby position toward a sheet bundle discharge unit 36.

In a state where the leading edge of the sheet bundle has reached the sheet bundle discharge unit 36, the sheet bundle discharge guide 34 is stopped and returned again to the standby position. The sheet bundle discharge unit 36 discharges the sheet bundle received from the sheet bundle discharge guide 34 to the lower sheet discharge tray 37. The sheets supported on the upper sheet discharge tray 25 and on the lower sheet discharge tray 37 are subjected to detection of position of an upper surface of the sheet, that is, stacked height of the sheet bundle, successively by a sheet surface detection sensor not shown. If the sheets are stacked higher than a predetermined height, the upper sheet discharge tray 25 and the lower sheet discharge tray 37 are moved downward, and when the removal of the stacked sheets is detected, the trays are moved upward. As described, control is performed to maintain the height of the tray or the upper surface of the sheets supported on the tray to a certain level.

Intermediate Conveyance Apparatus

A configuration of the intermediate conveyance apparatus 60, which is denoted by the area within the dot and dash line of FIG. 1, will be described in detail with reference to FIG. 2. In FIG. 2 and subsequent figures, arrow Z denotes upward in a vertical direction in a state where the image forming system 1S is installed on a horizontal plane. Arrow X denotes a direction from a front side toward a back side of the intermediate conveyance apparatus 60 along a horizontal plane orthogonal to arrow Z. Arrow Y is a direction orthogonal to both the arrow X and arrow Z directions, denoting a direction from the image forming apparatus 1 toward the postprocessing apparatus 4. In the present embodiment, arrow X is approximately parallel to a sheet width direction orthogonal to a sheet conveyance direction of the sheet conveyed within the intermediate conveyance apparatus 60. Further, in a description illustrating the intermediate conveyance apparatus 60 and arrangements and shapes of components thereof, unless denoted otherwise, a state in which the intermediate conveyance apparatus 60 is assembled to the image forming system 1S is set as reference.

A front side of the intermediate conveyance apparatus 60 refers to a side on which a handle 75 described later is arranged. Further, a front side of the intermediate conveyance apparatus 60 is the same as a front side of the image forming system 1S. The front side of the image forming system 1S is a side from where the user is assumed to mainly access the apparatus, and specifically, it is a side on which an operation panel serving as a user interface is arranged, and from which a storage of the feeding device 6 is drawn out.

The intermediate conveyance apparatus 60 includes the conveyance path 60P in which the sheet discharge path PA is branched from the through path PB, and a switching guide 65 for switching a conveyance route of sheets between the sheet discharge path PA and the through path PB, as described above. The switching guide 65 is arranged at a branch portion PC between the sheet discharge path PA and the through path PB. The switching guide 65 is a plate-shaped, or flap-shaped, guide member configured to swing, or pivot, about an axis that extends in the sheet width direction, and it is also referred to as a switching member or a switching portion.

The through path PB is composed of an upper conveyance guide 84 and a lower conveyance guide 85 that face each other with a space through which the sheets are conveyed interposed therebetween. The sheet discharge path PA is composed of an upper conveyance guide and a lower conveyance guide that face each other with a space through which the sheets are conveyed interposed therebetween.

The intermediate conveyance apparatus 60 includes a first roller pair 61, a second roller pair 62, and the sheet discharge roller pair 63, which serves as a conveyance member for conveying sheets. These roller pairs are each a roller pair that convey sheets by nipping a sheet and rotating. Other conveyance members such as a belt conveyor can also be used. The first roller pair 61 is arranged on an upstream portion of the through path PB, that is, an area upstream of the branch portion PC. The second roller pair 62 is arranged on the through path PB. The sheet discharge roller pair 63 is arranged on the sheet discharge path PA, especially at an opening portion of the casing of the intermediate conveyance apparatus 60.

When the intermediate conveyance apparatus 60 conveys the sheet to the intermediate sheet discharge tray 64, the switching guide 65 is moved from a position illustrated in FIG. 2, i.e., first position, to a position, i.e., second position, where it is rotated in a clockwise direction about a fulcrum of rotation, i.e., a boss 65*a* described below. In this state, the sheet conveyed from the image forming apparatus 1 is guided by the switching guide 65 to the sheet discharge path PA, and discharged onto the intermediate sheet discharge tray 64 by the sheet discharge roller pair 63.

When the intermediate conveyance apparatus 60 conveys the sheet to the postprocessing apparatus 4, the switching guide 65 is retained at the position illustrated in FIG. 2. In this case, the sheet conveyed from the image forming apparatus 1 is guided by the switching guide 65 to a downstream portion of the through path PB, i.e., an area downstream of the branch portion PC, and conveyed toward the postprocessing apparatus 4 by the second roller pair 62 to be transferred to the inlet roller pair 21 within the postprocessing apparatus 4.

Figure 3A:
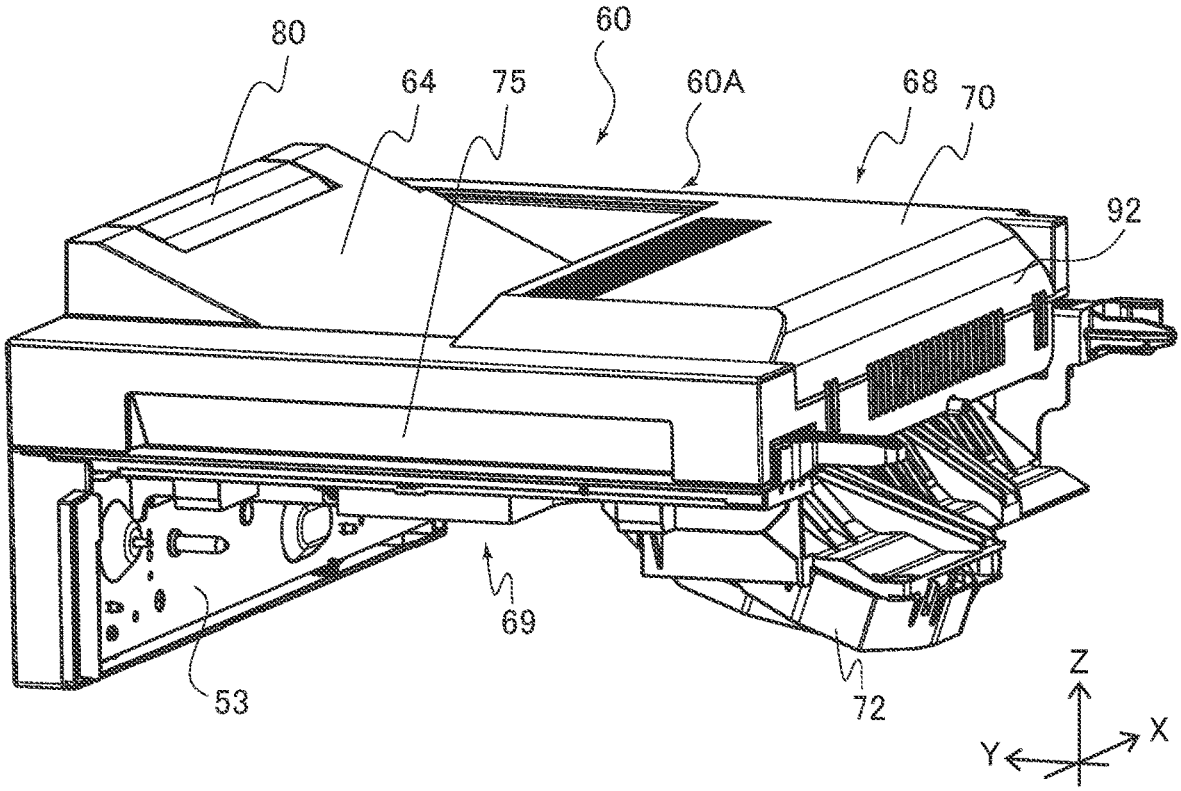
FIG. 3A is a perspective view of the intermediate conveyance apparatus according to the first embodiment.
Figure 3B:
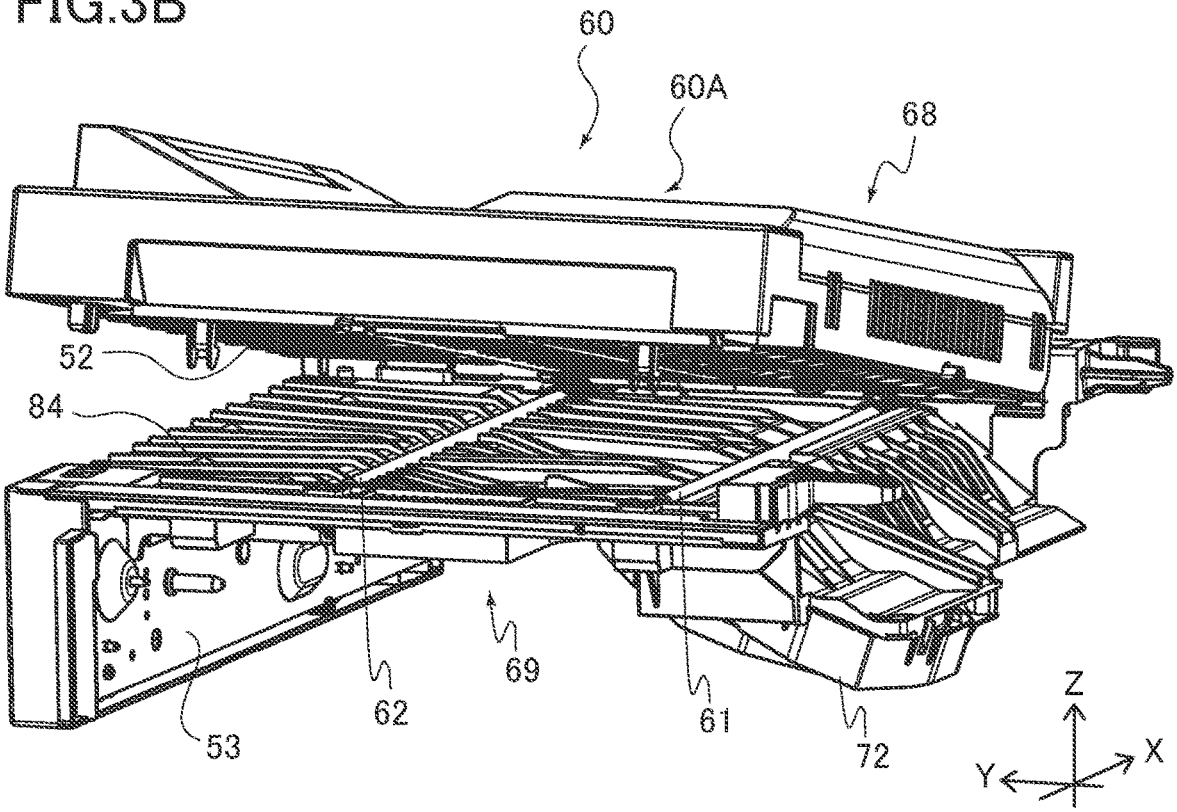
FIG. 3B is a perspective view of the intermediate conveyance apparatus according to the first embodiment.

FIG. 3A is a perspective view of the intermediate conveyance apparatus 60. The intermediate conveyance apparatus 60 is divided into two units, which are an upper unit 68 and a lower unit 69, with the through path PB serving as a boundary. The upper unit 68 is configured such that by operating the handle 75, a front side of the apparatus is lifted up with a hinge disposed on a back side of the apparatus described later serving as a pivot center, by which a front side of the intermediate conveyance apparatus 60 is opened. In a state where a jammed sheet remains in the through path PB of the intermediate conveyance apparatus 60, by opening the upper unit 68, the through path PB can be exposed to remove the jammed sheet.

Figure 4A:
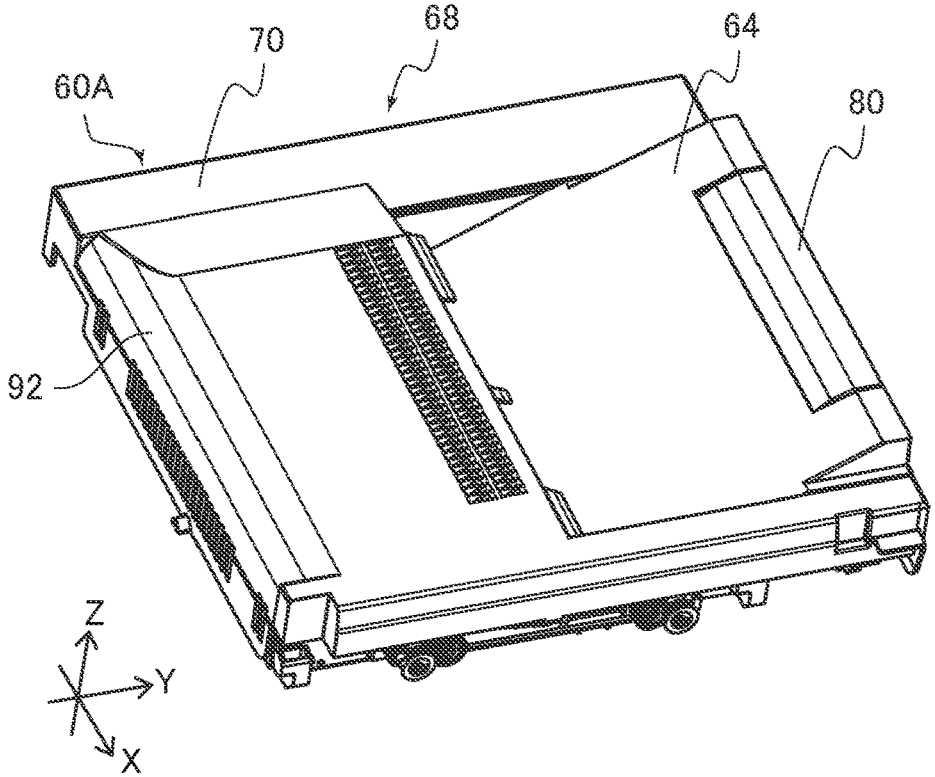
FIG. 4A is a perspective view of an upper unit of the intermediate conveyance apparatus according to the first embodiment.
Figure 4B:
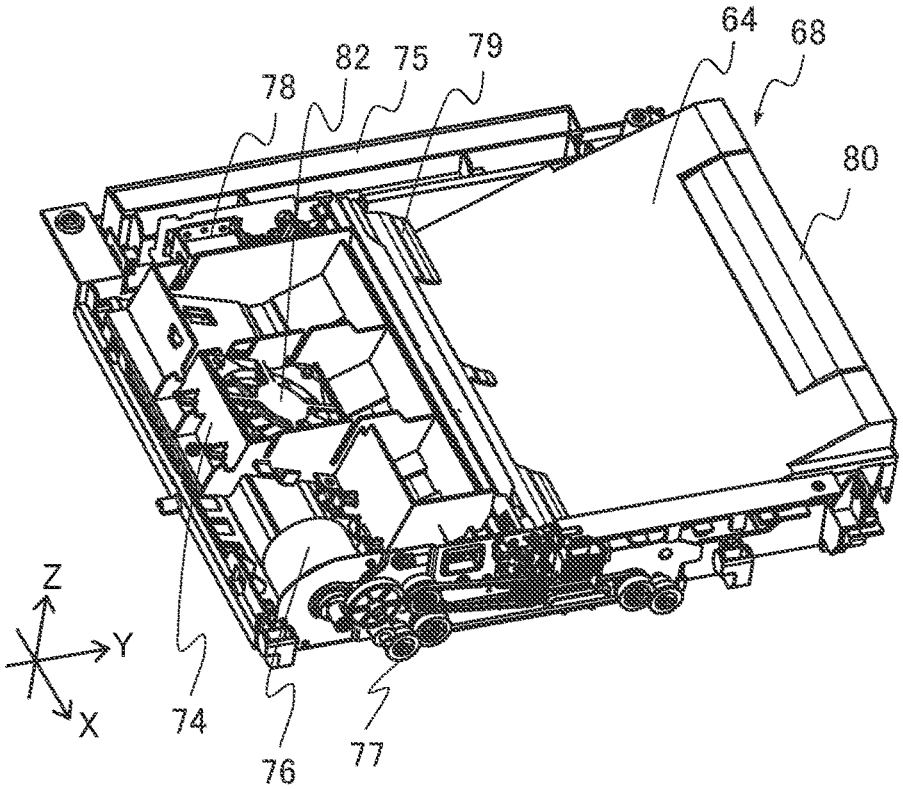
FIG. 4B is a partial perspective view of FIG. 4A.

FIG. 4A is a perspective view of the upper unit 68. FIG. 4B illustrates a state in which an upper cover 70 is removed from FIG. 4A. The upper unit 68 includes a motor 76 that drives the first roller pair 61, the second roller pair 62, and the sheet discharge roller pair 63, and a drive mechanism 77 that transmits the drive from the motor 76 to the respective rollers, which are disposed on a rear side of the unit. The upper unit 68 includes a solenoid 78 for switching the position of the switching guide 65, and a link member described later that connects the solenoid 78 and the switching guide 65. Further, the upper unit 68 includes a full load detection flag 79 for detecting whether the sheets on the intermediate sheet discharge tray 64 have reached a full load state, and an extension tray 80 that can be extended along a sheet conveyance direction.

Air Blowing Mechanism

An air blowing mechanism provided in the intermediate conveyance apparatus 60 will be described. As illustrated in FIG. 2, the intermediate conveyance apparatus 60 includes a first fan 71 and a second fan 82 serving as air blowing units for cooling and drying the sheets or the conveyance path. The first fan 71 is arranged on the lower unit 69 and the second fan 82 is arranged on the upper unit 68.

Figure 5:
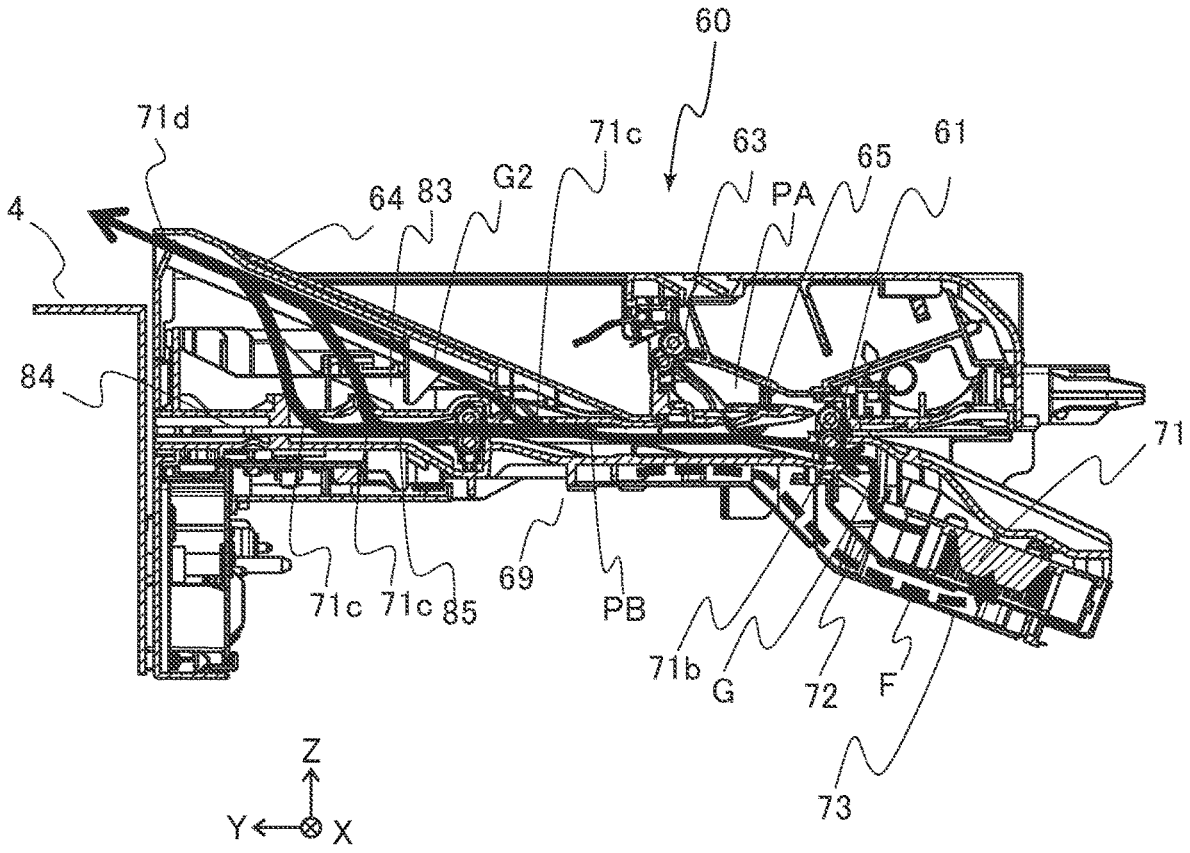
FIG. 5 is a cross-sectional view of the intermediate conveyance apparatus according to the first embodiment.

FIG. 5 is a cross-sectional view of the intermediate conveyance apparatus 60. As illustrated in FIG. 5, the lower unit 69 includes the first fan 71 and a first fan holder 72 that also serves as an air intake and discharge duct. The first fan 71 is held by the first fan holder 72. The first fan holder 72 is fixed to the lower conveyance guide 85 of the through path PB, and constitutes a frame body, or casing, of the lower unit 69 together with the lower conveyance guide 85.

The first fan 71 sucks outer air through an air intake port 71*a* (FIG. 8A) that opens to an outer side of the intermediate conveyance apparatus 60, and takes in air through a path, or air intake duct, illustrated by a dashed line arrow F. The air discharged from the first fan 71 is spread throughout the entire sheet width direction through a path illustrated by a solid line arrow G, that is, an air blow duct. Further, air is flown through an air blowing port 71*b* disposed below the first roller pair 61 into the sheet discharge path PA and the through path PB. The configuration of a vicinity of the switching guide 65 and the air blowing port 71*b* for guiding the air from the first fan 71 to the sheet discharge path PA and the through path PB will be described later.

In the present embodiment, a sirocco fan is used as the first fan 71. The use of the sirocco fan enables to ensure necessary wind pressure even in a case where it is necessary to elongate the length of the duct of the air intake and discharge path. Further, unlike an axial fan, the sirocco fan discharges air in a direction approximately orthogonal to the air intake direction, such that the air intake and discharge path is relatively easy to adopt in the configuration of the present embodiment in which the fan is arranged below the lower unit 69.

The air flown into the through path PB is discharged through the path illustrate by a solid line arrow G2. Specifically, the air is flown downstream in the sheet conveyance direction along the through path PB and passes through at least one air vent port 71*c* provided on the upper conveyance guide 84 to be guided to a space 83 below the intermediate sheet discharge tray 64.

An inner side of the intermediate sheet discharge tray 64 constitutes a space 83 that is surrounded by the intermediate sheet discharge tray 64 and the exterior of the intermediate conveyance apparatus 60. A plurality of air vent ports 71*c* are disposed at different positions in the sheet conveyance direction as a first opening portion in the upper conveyance guide 84 to send air flowing through the through path PB into this space. A plurality of air vent ports 71*c* that are positioned at the same position in the sheet conveyance direction are disposed along the sheet width direction, i.e., front-back direction of the apparatus intersecting the sheet conveyance direction. That is, a plurality of air vent ports 71*c* for allowing air to flow into the space 83 surrounded by the intermediate sheet discharge tray 64 and the exterior of the intermediate conveyance apparatus 60 is aligned in the sheet conveyance direction and the sheet width direction on the upper conveyance guide 84.

An air discharge port 71*d* is disposed on a side surface of the intermediate conveyance apparatus 60 at a height at which discharge of air is not blocked by the postprocessing apparatus 4. The air sent into the space 83 is discharged to the exterior of the apparatus through the air discharge port 71*d*. The air vent port 71*c* and the air discharge port 71*d* are provided at multiple locations across the front-back direction of the apparatus. The air discharge port 71*d* can also be disposed on a front side or a rear side of the apparatus.

The air sent into the sheet discharge path PA is flown downstream in the sheet conveyance direction along the sheet discharge path PA, and is discharged to the exterior of the apparatus through a space in the vicinity of the sheet discharge roller pair 63, that is, opening portion on the casing of the upper unit 68.

According to the above-mentioned configuration, the image on the sheet can be cooled by blowing cooled air that is sent out through the first fan 71 to an image surface of the sheet. The image surface is a surface on which image has been formed in the image forming apparatus 1 immediately before the sheet is conveyed to the intermediate conveyance apparatus 60, which according to duplex printing is a second surface on which image is formed after formation of image on the first surface and having passed through reverse conveyance. Thereby, the possibility of occurrence of damaged image caused by roller marks on the sheet or rubbing of the sheet against the conveyance guide can be reduced.

Further, by creating an air flow within the intermediate conveyance apparatus 60, for example, it becomes possible to prevent vapor from gathering in the space 83 between the upper conveyance guide 84 and the rear side of the intermediate sheet discharge tray 64, and to reduce dew condensation within the intermediate conveyance apparatus 60.

A mechanism of generation of dew condensation will be described below. Dew condensation occurs, for example, by warm air having been discharged from the inner side of the intermediate conveyance apparatus 60 through the sheet discharge roller pair 63 being cooled abruptly by colliding against the intermediate sheet discharge tray 64 in a state where the intermediate sheet discharge tray 64 is cold. In the present embodiment, as described above, a part of the air flowing downstream in the sheet conveyance direction along the through path PB is passed through at least one air vent port 71*c* provided on the upper conveyance guide 84 and sent to the space 83 below the intermediate sheet discharge tray 64. According to this configuration, the intermediate sheet discharge tray 64 is warmed by the air within the through path PB, such that the occurrence of dew condensation can be suppressed.

Further, by creating a flow of air within the intermediate conveyance apparatus 60 by the first fan 71, for example, it becomes possible to suppress vapor from gathering in the space 83 between the upper conveyance guide 84 and the back side of the intermediate sheet discharge tray 64, and to reduce dew condensation within the intermediate conveyance apparatus 60. By creating a flow of air by the first fan 71, the warm air residing in the through path PB can easily reach the space 83, by which the generation of dew condensation on the surface, i.e., outer surface, of the intermediate sheet discharge tray 64 can be suppressed.

Figure 6:
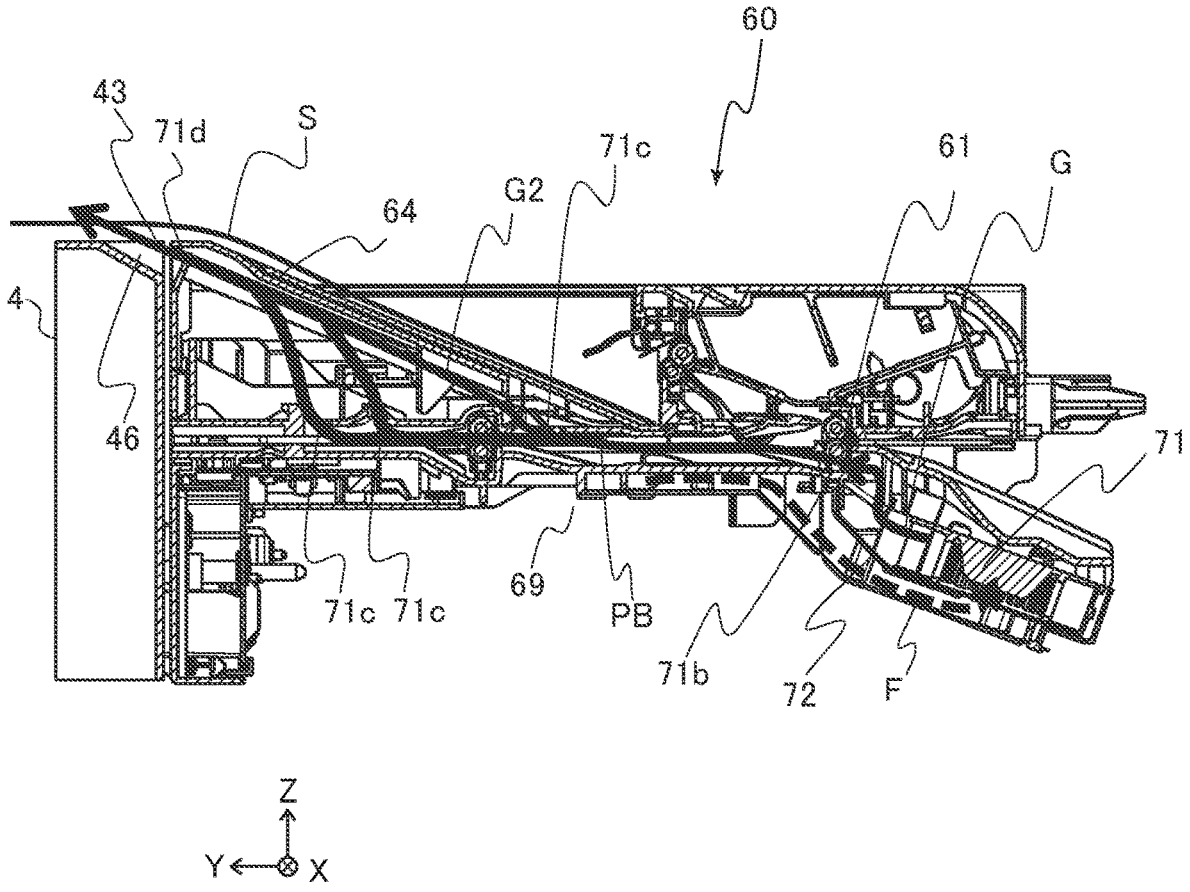
FIG. 6 is a cross-sectional view of an intermediate conveyance apparatus and a postprocessing apparatus according to a modified example.

Further, as illustrated in FIG. 6, it is possible to set the height of the upper surface of the postprocessing apparatus 4 to be higher compared to the example illustrated in FIG. 5, such that a highest portion of the upper surface of the postprocessing apparatus 4 can exceed the height of the air discharge port 71*d* of the intermediate conveyance apparatus 60. In this case, a cutout 43 is preferably formed to a portion at an upper right corner of the postprocessing apparatus 4 so as not to block the air discharged from the air discharge port 71*d* by the postprocessing apparatus 4. Moreover, the width of the cutout 43 is preferably set to a width wider than a maximum sheet width of the sheet being supported on the intermediate sheet discharge tray 64. Further, the cutout 43 is preferably provided with at least one rib 46 that extends along a sheet discharge direction with respect to the intermediate sheet discharge tray 64 so as to ensure a gap serving as a pathway of air from the air discharge port 71*d*.

In the example of FIG. 6, the height of the postprocessing apparatus 4 can be increased to expand the internal space of the postprocessing apparatus 4, such that the design freedom of the space inside the postprocessing apparatus 4 can be increased.

The second fan 82 takes in air through an air intake port that faces the space between the image forming apparatus 1 and the intermediate conveyance apparatus 60, and discharges air through an upper face portion of the intermediate conveyance apparatus 60. The air current generated by the second fan 82 disperses vapor discharged from the sheet immediately after being discharged from the sheet discharge roller pair 12 of the image forming apparatus 1 to suppress dew condensation within the intermediate conveyance apparatus 60 and to cool the sheet. The details of the second fan 82 will be described below.

Air Passage Configuration within Vicinity of Branch Portion

Figure 7:
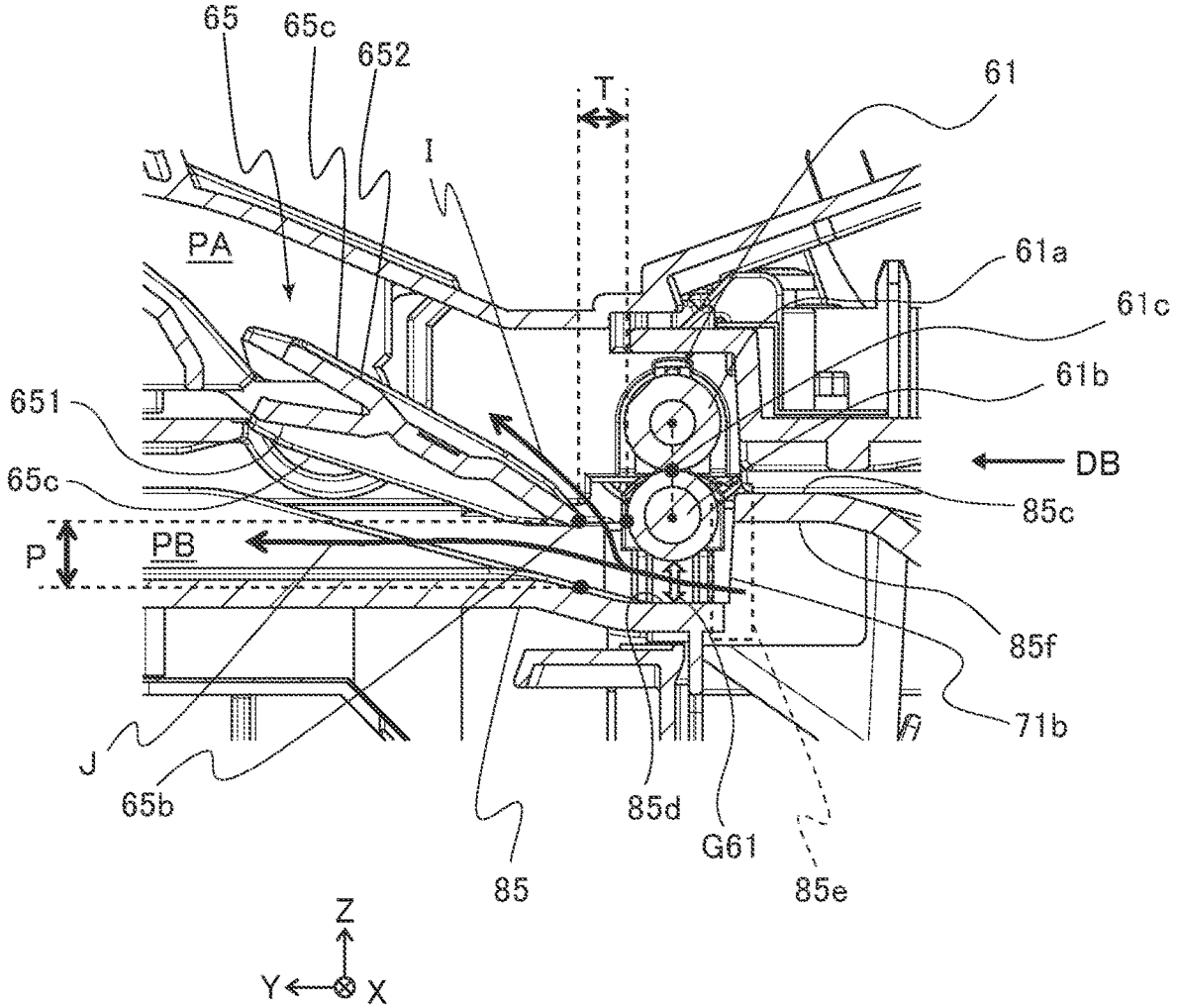
FIG. 7 is a cross-sectional view of a vicinity of a switching guide of an intermediate conveyance apparatus according to the first embodiment.
Figure 8A:
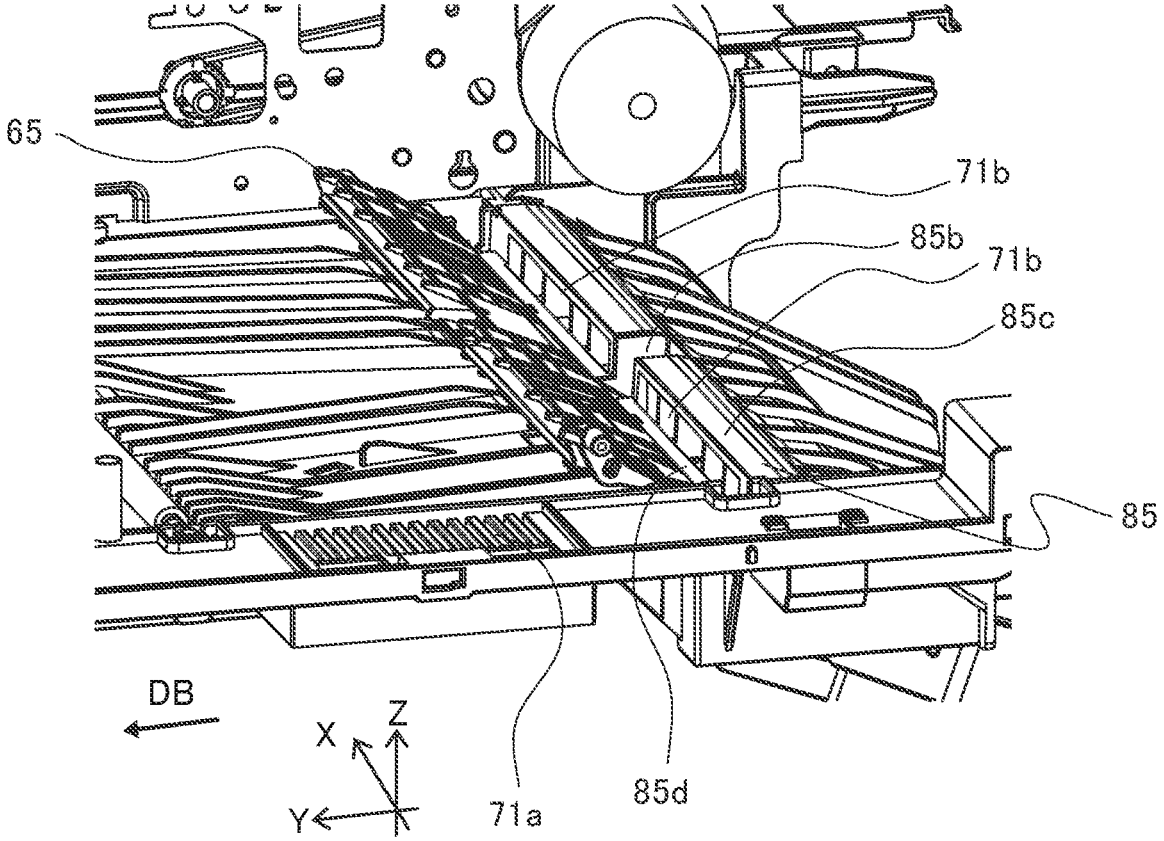
FIG. 8A is a perspective view of the vicinity of the switching guide of the intermediate conveyance apparatus according to the first embodiment.
Figure 8B:
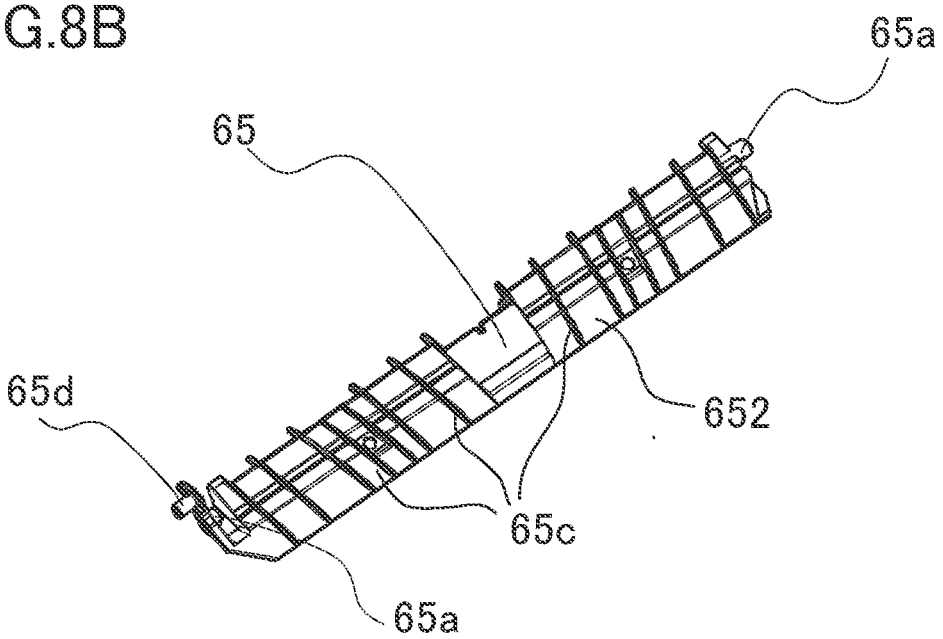
FIG. 8B is a perspective view of the switching guide.

An air passage in a vicinity of a branch portion will be described. FIG. 7 is a cross-sectional view illustrating a vicinity of the switching guide 65 of the intermediate conveyance apparatus 60. FIG. 8A is a perspective view illustrating a vicinity of the switching guide 65 of the intermediate conveyance apparatus 60. FIG. 8B is a perspective view of the switching guide 65. In FIG. 8A, the first roller pair 61 is omitted from the drawing.

Figure 9A:
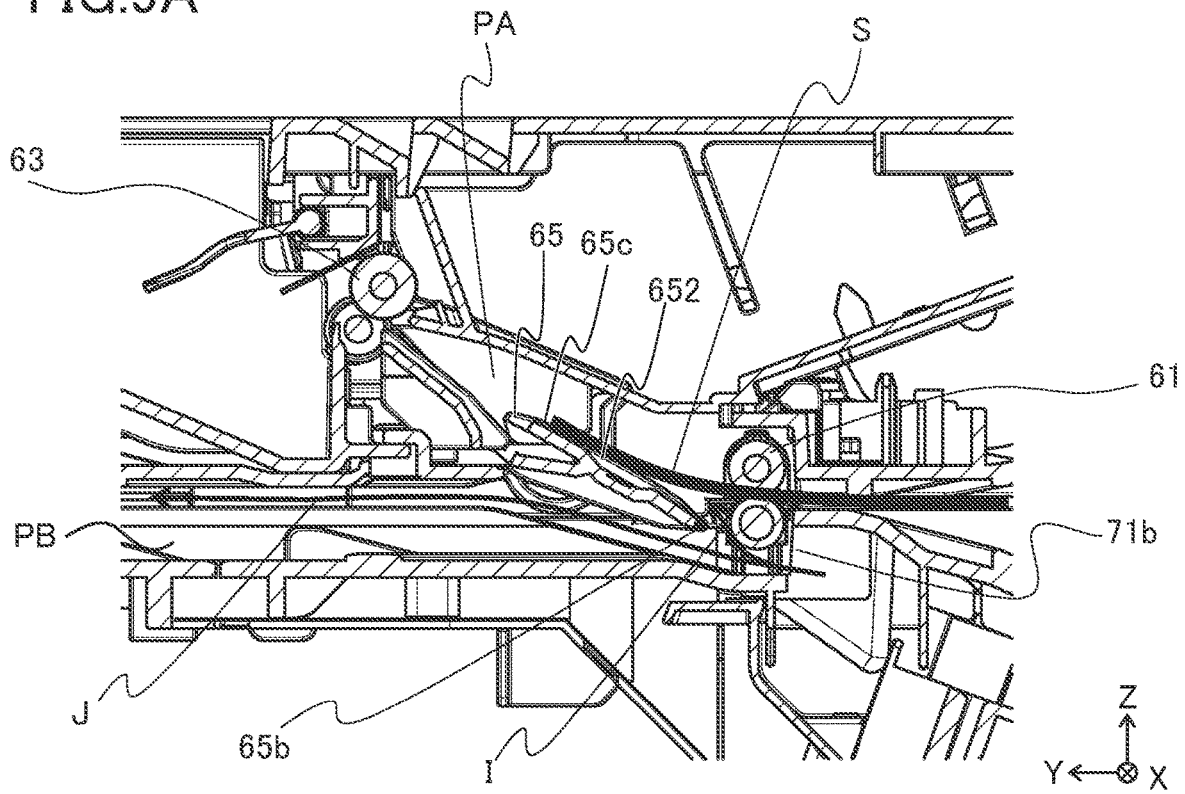
FIG. 9A is a view illustrating a flow of air according to the first embodiment.
Figure 9B:
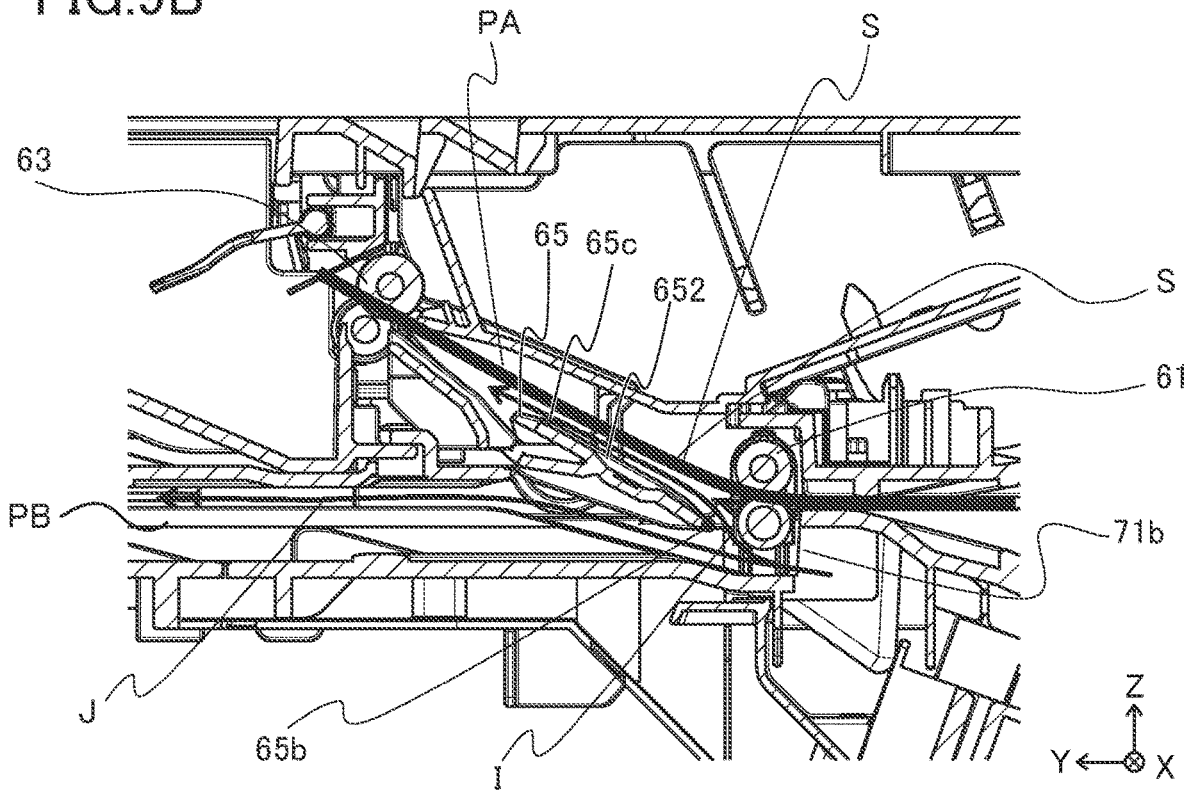
FIG. 9B is a view illustrating a flow of air according to the first embodiment.
Figure 10A:
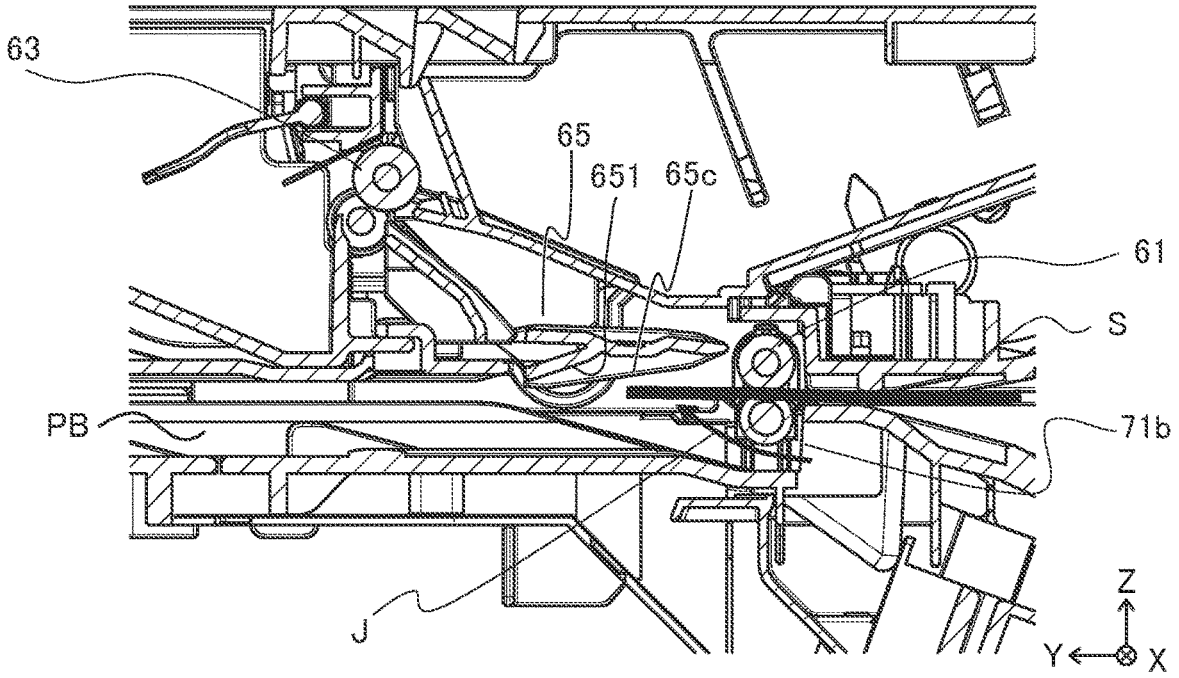
FIG. 10A is a view illustrating the flow of air according to the first embodiment.
Figure 10B:
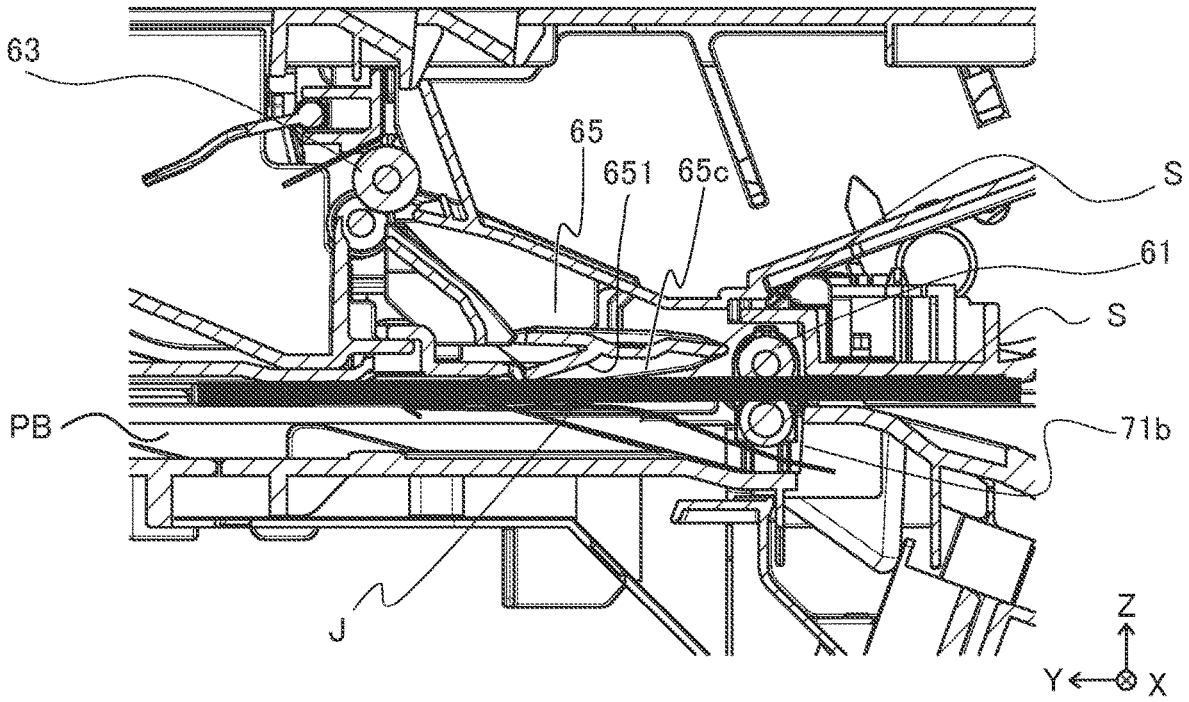
FIG. 10B is a view illustrating the flow of air according to the first embodiment.

Hereafter, a position of the switching guide 65 in a state where the switching guide 65 guides the sheet to the through path PB, that is, the position illustrated in FIG. 5 and FIGS. 10A and 10B, will be referred to as a first position. A position of the switching guide 65 in a state where the switching guide 65 guides the sheet to the sheet discharge path PA, that is, the position illustrated in FIG. 7 and FIGS. 9A and 9B, will be referred to as a second position. A drive configuration of the switching guide 65 will be described below.

The first roller pair 61 is composed of a first upper roller 61*a* and a first lower roller 61*b*. The first upper roller 61*a* and the first lower roller 61*b* are each a so-called wide nipped roller. That is, each roller is a roller having a cylindrical shape that extends across an entire area in a sheet width direction, or arrow X, through which a sheet having a maximum size in the sheet width direction among the sheets that are conveyed at least by the first roller pair 61 can pass. The first roller pair 61 has outer circumference surfaces of the respective rollers contact one another across the entire sheet passing area. Therefore, even when the first lower roller 61*b* contacts the image surface of the sheet that has been heated in the fixing unit 11 in the image forming apparatus 1 (FIG. 1) and toner thereon has been softened, the damages such as roller marks on the image formed on the sheet can be reduced.

As illustrated in FIGS. 7 and 8A, the air blowing port 71*b*, i.e., air discharge port, through which air from the first fan 71 is blown into the conveyance path 60P is arranged upstream of the switching guide 65 with respect to a sheet conveyance direction DB in the through path PB. Further, the air blowing port 71*b* is arranged to blow the air from the first fan 71 toward a downstream side in the sheet conveyance direction DB. In other words, the air blowing port 71*b* is opened toward a downstream side in the sheet conveyance direction DB.

Therefore, the air blown through the air blowing port 71*b* toward the downstream side in the sheet conveyance direction DB is flown toward the switching guide 65 arranged at a branch portion between the through path PB and the sheet discharge path PA. Then, the air flows into the through path PB and/or the sheet discharge path PA by the switching guide 65 (arrows I, J). Thereby, air can be sent efficiently to the through path PB and the sheet discharge path PA that has been branched within the intermediate conveyance apparatus 60. In other words, the air from the first fan 71 can cool the guide members constituting the through path PB and the sheet discharge path PA and the sheets conveyed through the respective paths.

As illustrated in FIG. 7, the air blowing port 71*b* of the present embodiment is arranged further upstream than the first roller pair 61 arranged upstream of the switching guide 65, that is, upstream of a downstream end position of the first roller pair 61. According to this configuration, not only the guide member and the sheets but also the first roller pair 61 can be cooled by the air from the first fan 71.

More specifically, the present embodiment is configured such that air is flown through a gap G61 formed between the first lower roller 61*b* and a guide surfacer 85*d* of a portion downstream of the air blowing port 71*b* of the lower conveyance guide 85 of the through path PB. According to this configuration, the first lower roller 61*b* can be cooled. Further, air flow path from the first fan 71 can be ensured even according to the configuration of the present embodiment in which each of the rollers of the first roller pair 61 is a wide nipped roller.

Further according to the present embodiment, a portion of the first lower roller 61*b* is positioned within an opening area of the air blowing port 71*b* when viewed from a downstream side in the sheet conveyance direction DB. Thereby, air can be blown directly to the first lower roller 61*b* to cool the first lower roller 61*b*.

A configuration of the air blowing port 71*b* according to the present embodiment will be described further. The lower conveyance guide 85, i.e., guide member, constituting the through path PB includes a stepped portion 85*e* that is formed such that a guide surface 85*d* positioned downstream is receded from a sheet passing position, that is, a position of a nip 61*c* of the first roller pair 61, compared to an upper guide surface 85*c*. In other words, the lower conveyance guide 85 includes a guide surface 85*c* serving as a first guide surface that guides the sheet along the through path PB, the guide surface 85*d* serving as a second guide surface that is arranged downstream of the guide surface 85*c* in the sheet conveyance direction DB and that is arranged at a position farther from the through path PB than the guide surface 85*c*, and the stepped portion 85*e* formed between the guide surface 85*c* and the guide surface 85*d*. The stepped portion 85*e* extends in a thickness direction of the sheet conveyed through the through path PB. The air blowing port 71*b* is disposed on the stepped portion 85*e* of the lower conveyance guide 85. By disposing the air blowing port 71*b* on the stepped portion 85*e*, a configuration is adopted in which air is blown out from the air blowing port 71*b* along the sheet conveyance direction DB. The guide surface 85*d* is inclined gently toward the downstream side in the sheet conveyance direction DB to approach the sheet passing position at a position downstream of the stepped portion 85*e*. By the inclination of the guide surface 85*d*, the air blowing out from the air blowing port 71*b* is guided toward the switching guide 65.

The lower conveyance guide 85 includes a duct surface 85*f* that forms a duct for guiding the air from the first fan 71 to the conveyance path 60P. the duct surface 85*f* is arranged on a opposite side to the guide surface 85*c* disposed upstream of the stepped portion 85*e* in the sheet conveyance direction DB. The duct surface 85*f* extends along the sheet conveyance direction DB at least at a portion adjacent to the air blowing port 71*b*, and the air blowing port 71*b* is formed at a downstream end of the duct surface 85*f* in the sheet conveyance direction DB. According to this configuration, the direction of air blowing through the air blowing port 71*b* can be guided along the sheet conveyance direction DB by the duct surface 85*f*. Further, since the lower conveyance guide 85 is used as a part of the duct extending from the first fan 71 to the conveyance path 60P, the number of components can be cut down.

The path through which air blowing out through the air blowing port 71*b* passes changes according to the position of the switching guide 65. In the present embodiment, at least in a state where the switching guide 65 is positioned at a second position in which the sheet is guided to the sheet discharge path PA, the air blowing out through the air blowing port 71*b* is configured to flow to both the sheet discharge path PA and the through path PB. According to this arrangement, air can be blown simultaneously through the through path PB and the sheet discharge path PA branched within the intermediate conveyance apparatus 60.

Specifically, as illustrated in FIG. 7, in a state where the switching guide 65 is positioned at the second position, a gap P, i.e., clearance, is set between a leading edge 65*b* of the switching guide 65 and the lower conveyance guide 85. Further, a gap T is set between the leading edge 65*b* of the switching guide 65 and the first roller pair 61. In other words, in a state where the switching guide 65 is positioned at the second position, the gap P exists between a member facing the switching guide 65 interposing the through path PB, i.e., first path, and the switching guide 65. Further, the gap T exists between a member facing the switching guide 65 interposing the sheet discharge path PA, i.e., second path, and the switching guide 65. According to this configuration, in a state where the switching guide 65 is positioned at the second position, air can be blown simultaneous to the through path PB and the sheet discharge path PA (arrows I and J).

In the present embodiment, a path length of the through path PB from the switching guide 65 to a sheet discharge port 88, that is, opening facing the postprocessing apparatus 4 (refer to FIG. 2), is longer than a path length of the sheet discharge path PA. That is, the intermediate conveyance apparatus 60 includes a sheet discharge port 88 serving as a first sheet discharge port through which the sheet having passed through the through path PB is discharged toward the postprocessing apparatus 4, and a sheet discharge port 89 (refer to FIG. 2) serving as a second sheet discharge port through which the sheet having passed through the sheet discharge path PA is discharged to an exterior of the intermediate conveyance apparatus 60. The path length of the through path PB from the switching guide 65 to the sheet discharge port 88 is longer than the path length of the sheet discharge path PA from the switching guide 65 to the sheet discharge port 89. According to this configuration, a part of the air blowing from the first fan 71 is configured to flow to the through path PB even in a state where the switching guide 65 is positioned at the second position for guiding the sheets to the sheet discharge path PA. Accordingly, the possibility of heat being stored in a vicinity of the through path PB and causing excessive temperature rise of the lower conveyance guide 85 can be reduced. The path length of the sheet discharge path PA refers to a path length extending from the switching guide 65 to the sheet discharge roller pair 63 (FIG. 2). In the present embodiment, the sheet discharge port 89 is a nip of the sheet discharge roller pair 63. Further, the position of the switching guide 65 that serves as an origin of path length is a position of the leading edge 65*b* of the switching guide 65 at the first position in the case of the through path PB, and it is a position of the leading edge 65*b* of the switching guide 65 at the second position in the case of the sheet discharge path PA.

It is also possible to have air blown simultaneously to the through path PB and the sheet discharge path PA in a state where the switching guide 65 is positioned at the first position. Furthermore, it is possible to have air blown simultaneously to the through path PB and the sheet discharge path PA in both states where the switching guide 65 is positioned at the first position and where the switching guide 65 is positioned at the second position. Moreover, the member opposing the switching guide 65 interposing the through path PB or the sheet discharge path PA is not necessarily the lower conveyance guide 85 or the first roller pair 61 described above.

In the present embodiment, the air from the air blowing port 71*b* flows toward the switching guide 65, such that a ratio of the amount of air flowing through the through path PB and the amount of air flowing through the sheet discharge path PA changes according to the position of the switching guide 65. The amount of air flowing through the through path PB is greater in a case where the switching guide 65 is positioned at the first position compared to the case where the switching guide 65 is positioned at the second position. Further, the amount of air flowing through the sheet discharge path PA is greater in a case where the switching guide 65 is positioned at the second position compared to the case where the switching guide 65 is positioned at the first position.

Further, the amount of air, i.e., airflow, flowing to the through path PB and the sheet discharge path PA can be changed by varying the size of the gap formed between the switching guide 65 at each position and a member facing the switching guide 65 interposing the through path PB or the sheet discharge path PA. For example, the gap P, i.e., clearance, between the switching guide 65 and the lower conveyance guide 85 in FIG. 7 can be made small such that air is basically flown only through the sheet discharge path PA, i.e., arrow I, in a state where the switching guide 65 is positioned at the second position.

It is preferable that the air blowing port 71*b* is arranged on a side to which the image surface of the sheet faces with respect to the through path PB. Such a configuration allows the image on the sheet heated by the fixing unit 11 (FIG. 1) of the image forming apparatus 1 to be cooled efficiently.

The switching guide 65 will be described in detail. As illustrated in FIG. 7, the switching guide 65 includes a first surface 651 for guiding the sheet to the through path PB and a second surface 652 for guiding the sheet to the sheet discharge path PA. The first surface 651 and the second surface 652 are each a surface that spreads across the entire sheet passing area in the sheet width direction, i.e., X direction, and that extends along the sheet conveyance direction. As illustrated in FIGS. 8A and 8B, a plurality of ribs 65*c* are formed to protrude along the sheet conveyance direction to at least one of the first surface 651 and the second surface 652. In the present embodiment, a plurality of ribs 65*c* are disposed on both the first surface 651 and the second surface 652.

By providing the plurality of ribs 65*c*, the ribs 65*c* come into contact with and guide the sheets with a gap through which air flows formed between the sheets and the first surface 651 or the second surface 652.

The flow of air during sheet conveyance is described with reference to FIGS. 9A and 9B, and FIGS. 10A and 10B. FIGS. 9A and 9B are each a cross-sectional view illustrating a vicinity of the switching guide 65 in a state where the switching guide 65 is positioned at the second position. FIG. 9A illustrates a state before the sheet S reaches the sheet discharge roller pair 63, and FIG. 9B illustrates a state after the sheet S has reached the sheet discharge roller pair 63.

As illustrated in FIG. 9A, before the sheet S reaches the sheet discharge roller pair 63, the sheet S slides against the switching guide 65 while being conveyed, such that the air blown out through the air blowing port 71*b* mainly flows to the through path PB. However, a part of the air flows through the gap formed between the sheet S and the second surface 652 of the switching guide 65 by the plurality of ribs 65*c* mentioned above (arrow I), such that air blows onto the image surface of the sheet S and the image is cooled thereby.

As illustrated in FIG. 9B, even in a state after the sheet S has reached the sheet discharge roller pair 63, at least a gap corresponding to the height of the plurality of ribs 65*c* is formed between the sheet S and the second surface 652 of the switching guide 65, such that air is blown to the image surface of the sheet S and the image is cooled thereby (arrow I).

Even in a state where the switching guide 65 is positioned at the second position and no sheet is passed through the switching guide 65, a part of the air from the air blowing port 71*b* is flown to the sheet discharge path PA by the switching guide 65. Thereby, the switching guide 65, the guide member of the sheet discharge path PA, and the sheet discharge roller pair 63 are cooled.

FIGS. 10A and 10B are each a cross-sectional view illustrating the vicinity of the switching guide 65 in a state where the switching guide 65 is positioned at the first position. FIG. 10A illustrates a state before the sheet S reaches the switching guide 65, and FIG. 10B illustrates a state after the sheet S has passed through the switching guide 65.

As illustrated in FIGS. 10A and 10B, according to the present embodiment, in a state where the switching guide 65 is positioned at the first position, the air passage leading to the sheet discharge path PA is blocked by the sheet S while the sheet S is passing through the switching guide 65. Therefore, the air from the air blowing port 71*b* basically flows to the through path PB, and the air basically does not flow to the sheet discharge path PA. For example, if an air speed in the sheet discharge path PA is measured using an air speed meter during the period in which the sheet is passed through the switching guide 65 (FIG. 10B), the air speed is extremely small, such as less than 5%, compared to the air speed in the through path PB during the same period.

Drive Configuration of Switching Guide

Figure 11A:
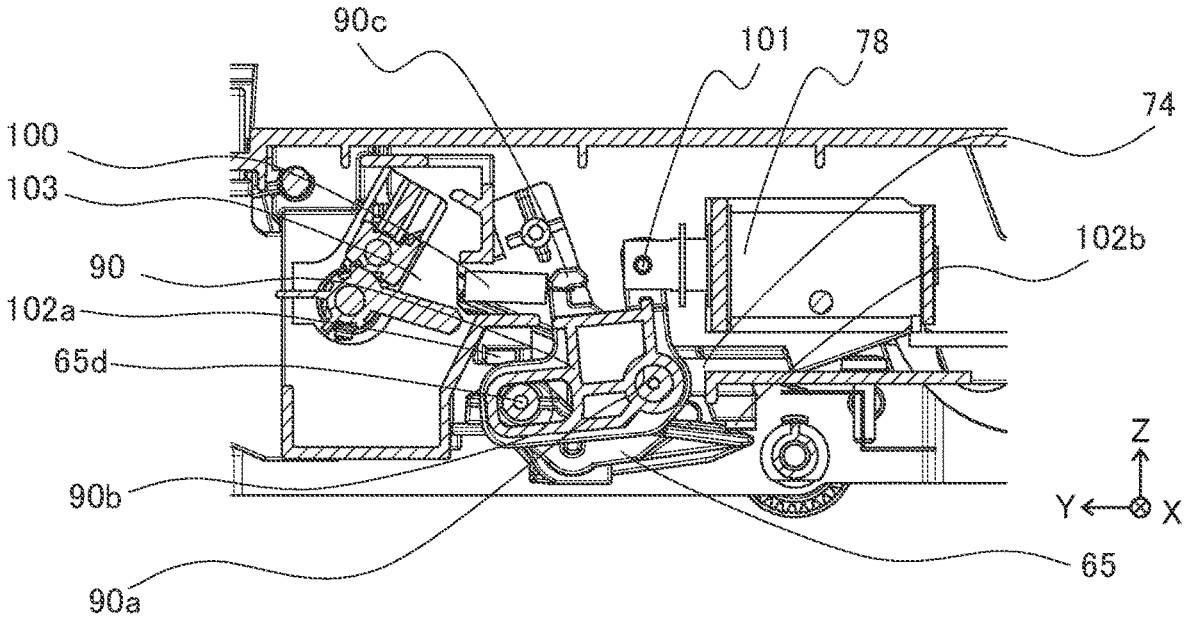
FIG. 11A is a view illustrating a drive mechanism of the switching guide according to the first embodiment.
Figure 11B:
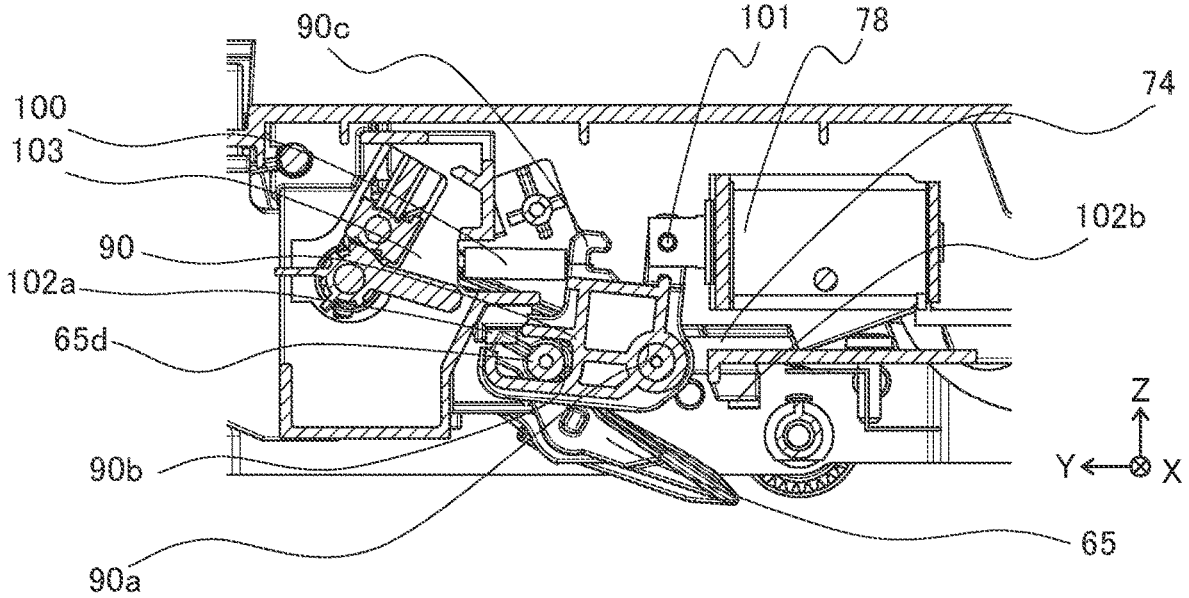
FIG. 11B is a view illustrating a drive mechanism of the switching guide according to the first embodiment.

Next, a drive configuration of the switching guide 65 will be described using FIGS. 11A and 11B. FIG. 11A is a cross-sectional view of the switching guide 65 at the first position and the drive mechanism, and FIG. 11B is a cross-sectional view of the switching guide 65 at the second position and the drive mechanism. In FIGS. 11A and 11B, for sake of description, a portion of a link member 90 described below and the upper conveyance guide 84 are omitted from the drawing.

As illustrated in FIG. 8B, the switching guide 65 includes bosses 65*a* serving as a rotation center, i.e., swing center, on both ends thereof in the sheet width direction. Further, the switching guide 65 includes a drive boss 65*d* at an end portion thereof in the sheet width direction. The drive boss 65*d* is disposed at a position distant from the center of the boss 65*a*.

As illustrated in FIGS. 11A and 11B, by having the boss 65*a* inserted to a hole on a frame 103 of the intermediate conveyance apparatus 60, the switching guide 65 is supported in a pivotable manner. The frame 103 is a member constituting a frame body of the upper unit 68, and a part of the frame 103, i.e., portion facing the through path PB, functions as the upper conveyance guide 84 (FIGS. 2 and 5). Further, the upper conveyance guide 84 can be fixed to the frame 103 as a separate member as the frame 103.

As illustrated in FIGS. 11A and 11B, a drive mechanism of the switching guide 65 includes the solenoid 78, the link member 90, and a retention spring 100. The link member 90 includes holes 90*a* that are supported pivotably by a supporting shaft fixed to the frame 103, a long hole 90*b* that engages with the drive boss 65*d* of the switching guide 65, and a hook portion 90*c* engaged with the retention spring 100. Further, the link member 90 is connected to a plunger of the solenoid 78 through a connecting pin 101. The retention spring 100 has one end engaged to the frame 103 and the other end engaged to the hook portion 90*c* of the link member 90.

Further, pads 102*a* and 102*b* serving as a regulation member, i.e., stopper, for regulating a pivoting range of the switching guide 65 by abutting against the switching guide 65 are provided. In the present embodiment, the pad 102*a* is attached to the frame 103, and the pad 102*b* is attached to a fan holder 74 holding the second fan 82 (FIG. 2), with both pads fixed to the frame 103.

The switching guide 65 is urged from one of the first and second positions to the other position by a repulsive force of the retention spring 100. Further, the solenoid 78 moves the switching guide 65 from one of the first and second positions to the other position against the repulsive force of the retention spring 100.

Specifically, according to the present embodiment, the switching guide 65 is urged toward the first position by the repulsive force of the retention spring 100. Therefore, as illustrated in FIG. 11A, in a state where electricity is not conducted to the solenoid 78, the switching guide 65 is retained at a position abutting against the pad 102*b*, that is, at the first position, by urging force in a counterclockwise direction in the drawing received through the link member 90.

When electricity is conducted to the solenoid 78, as illustrated in FIG. 11B, the link member 90 pivots in the clockwise direction in the drawing against the repulsive force of the retention spring 100, and the switching guide 65 pivots in the clockwise direction in the drawing together with the link member 90. Then, the switching guide 65 is retained at a position abutted against the pad 102*a*, that is, at the second position.

In order to move the switching guide 65 from the second position to the first position, by shutting off the electric conduction to the solenoid 78, the switching guide 65 is returned to the first position by the urging force of the retention spring 100 (FIG. 11A).

In the present embodiment, a configuration in which the solenoid 78 is used as an actuator is illustrated, but other actuators can also be used. For example, it is possible to connect a stepper motor capable of rotating in both normal and reverse directions to the switching guide 65, or to adopt a mechanism in which a motor and a cam mechanism are assembled to drive the switching guide 65.

Extension Tray

Figure 12:
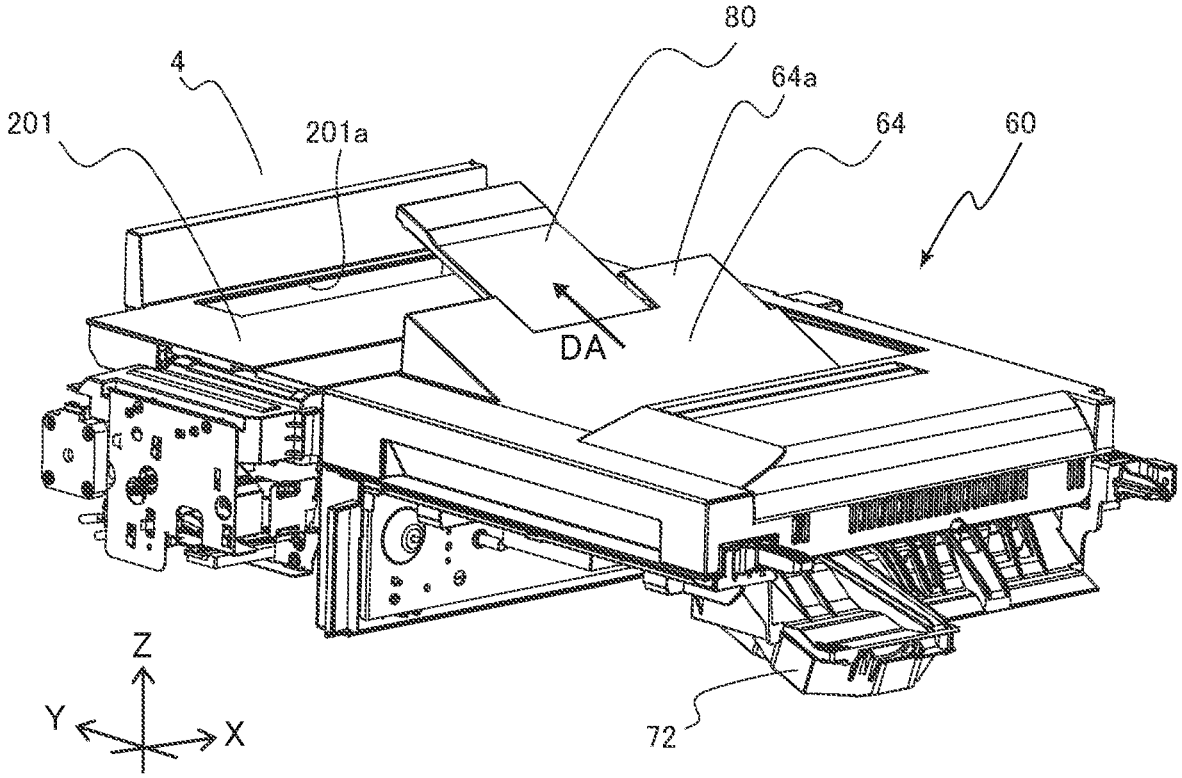
FIG. 12 is a perspective view illustrating an extension tray of the intermediate conveyance apparatus and a part of the postprocessing apparatus according to the first embodiment.
Figure 13A:
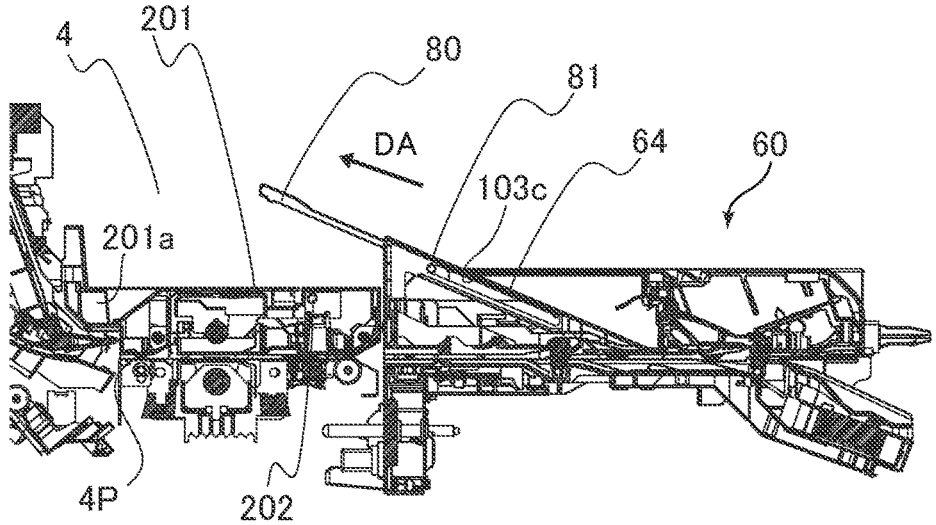
FIG. 13A is a view illustrating an operation of the extension tray according to the first embodiment.
Figure 13B:
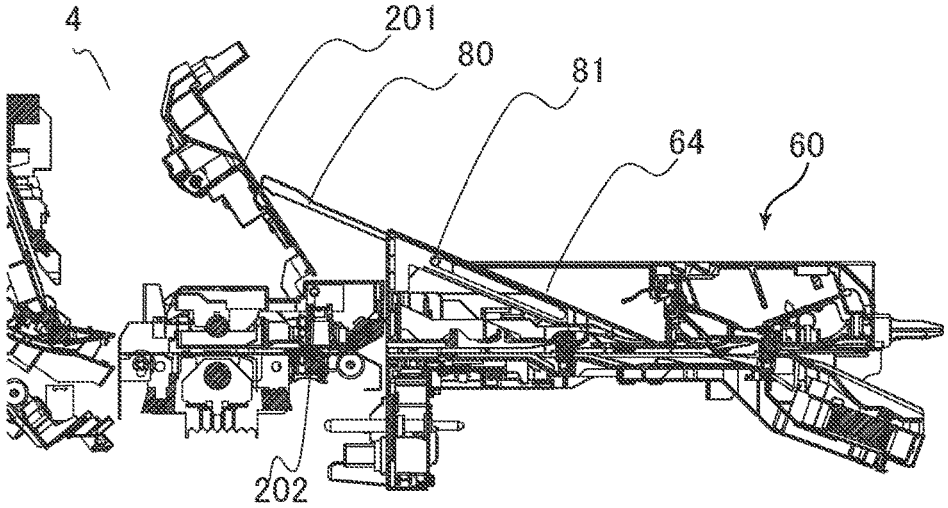
FIG. 13B is a view illustrating an operation of the extension tray according to the first embodiment.
Figure 13C:
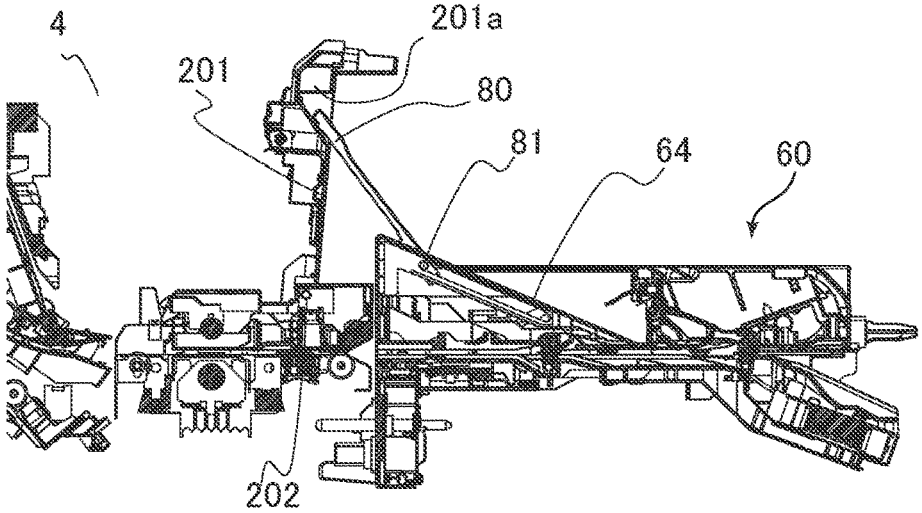
FIG. 13C is a view illustrating an operation of the extension tray according to the first embodiment.

Next, an extension tray provided on the intermediate sheet discharge tray 64 will be described. FIG. 12 is a perspective view illustrating a part of the intermediate conveyance apparatus 60 and the postprocessing apparatus 4. FIG. 13A is a cross-sectional view of a configuration illustrated in FIG. 12. FIGS. 13B and 13C are each a cross-sectional view illustrating a state in which a door 201 of the postprocessing apparatus 4 is opened from the state illustrated in FIG. 13A.

As illustrated in FIG. 12, the intermediate sheet discharge tray 64 is provided on an upper face of the intermediate conveyance apparatus 60, and the extension tray 80 is provided on the intermediate sheet discharge tray 64. The extension tray 80 is movable with respect to a support surface 64*a* of the intermediate sheet discharge tray 64 between a protruded position protruded downstream in a sheet discharge direction DA and a stored position stored in the intermediate sheet discharge tray 64.

As illustrated in FIG. 13A, in a state where the extension tray 80 is positioned at the protruded position, a leading edge of the extension tray 80 is protruded downstream of a side face 60D on a downstream side in the sheet discharge direction DA of the intermediate conveyance apparatus 60, and a portion of the extension tray 80 is superposed with the postprocessing apparatus 4 when viewed from the upper side. Meanwhile, in a state where the extension tray 80 is stored in the stored position, the extension tray 80 is not protruded from the side face 60D of the intermediate conveyance apparatus 60 (FIG. 3A).

As illustrated in FIGS. 12 and 13A, the door 201 serving as an opening and closing member, i.e., movable member, is disposed on an upper face portion of the postprocessing apparatus 4. The door 201 is pivotable about a hinge 202. As illustrated in FIG. 13B, when the door 201 is opened, at least a part of a conveyance path 4P (FIG. 13A) inside the postprocessing apparatus 4 is exposed to an exterior of the apparatus. Therefore, the user can remove jammed sheets by opening the door 201. When the door 201 is closed, the postprocessing apparatus 4 can convey sheets through the conveyance path 4P.

The door 201 according to the present embodiment is opened by pivoting upward about an upstream edge in the sheet conveyance direction of the sheet received from the intermediate conveyance apparatus 60, that is, right side edge in the drawing, and closes by pivoting in the opposite direction.

The position of the extension tray 80 positioned at the protruded position and the space through which the door 201 passes when the door is opened and closed partially overlap. Meanwhile, the extension tray 80 is designed to pivot with respect to the intermediate sheet discharge tray 64 and move along the sheet discharge direction DA by having its shaft 81 retained in a long hole 103*c* provided on the frame 103.

Therefore, if the door 201 is opened in a state where the extension tray 80 is drawn out to the protruded position, as illustrated in FIG. 13C, the extension tray 80 abutted against the door 201 moves in linkage with the door 201 and pivots in the counterclockwise direction in the drawing. That is, the extension tray 80 recedes from a movement locus of the door 201 in linkage with the movement of the door 201 serving as a movable member.

Thereby, the opening angle of the door 201 can be set to improve the workability of jam removal processing without being blocked by the extension tray 80 while allowing a large sheet to be supported on the extension tray 80. Further, the operation of moving the extension tray 80 to the stored position when opening the door 201 can be omitted. It is also possible to provide a recess portion 201*a* to the door 201, allowing the user to open the door 201 by hooking his/her fingers to the recess portion 201*a*. It is also possible to allow the leading edge of the extension tray 80 to be stored in the recess portion 201*a* in a state where the door 201 is opened.

It is preferable to adopt a configuration in which, in a state where the door 201 is opened to a maximum angle (FIG. 13C), the extension tray 80 does not fall toward the intermediate sheet discharge tray 64, that is, a center of gravity of the extension tray 80 is positioned on a left side in the drawing of the shaft 81. Thereby, when the door 201 is closed after the jam removal processing has been completed, the extension tray 80 will return to its original position (FIG. 13B) by its own weight, such that the workability is improved.

The door 201 for opening the conveyance path is one example of a movable member, and it is also possible to have the extension tray 80 recede in linkage with the movement of the movable member for exposing units other than the conveyance path for maintenance.

Duct Configuration of First Fan

Figure 14:
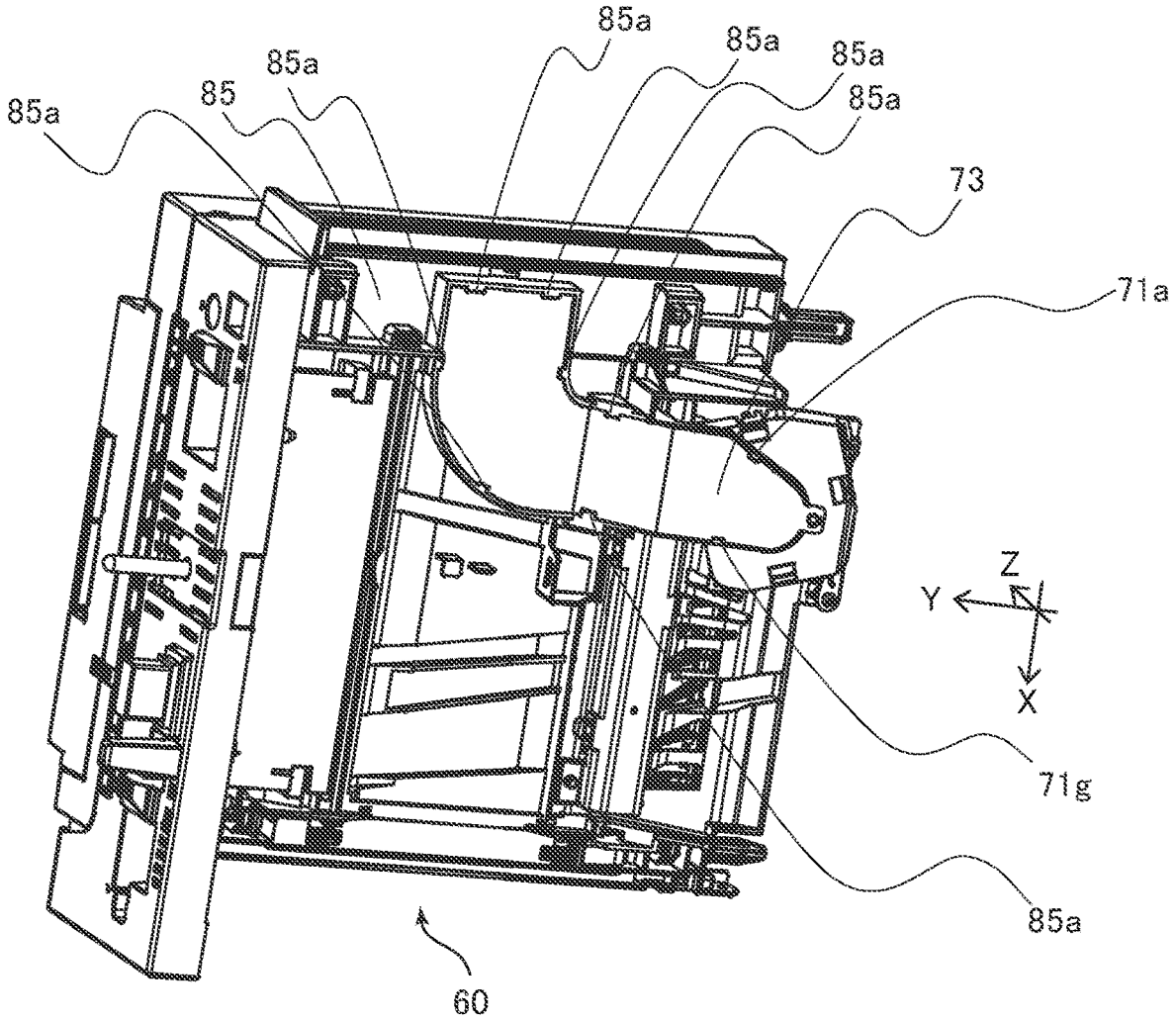
FIG. 14 is a perspective view illustrating the intermediate conveyance apparatus according to the first embodiment from a lower side.

Next, a duct configuration of the first fan 71 will be described in detail with reference to FIGS. 5 and 14. FIG. 14 is a perspective view illustrating the intermediate conveyance apparatus 60 from below.

As illustrated in FIG. 14, a duct sheet 73 is attached to the lower unit 69 of the intermediate conveyance apparatus 60. The duct sheet 73 is a sheet member having flexibility and is composed of a resin material. Polyethylene terephthalate (PET) can be used, for example, as the resin material.

The path illustrated by arrow F in FIG. 5 is an air intake duct surrounded by the lower conveyance guide 85, the first fan holder 72, and the duct sheet 73. The air intake duct connects the air intake port 71*a* disposed on a leading edge portion of the intermediate conveyance apparatus 60 at the upper face side of the lower unit 69 (FIG. 8A) to the first fan 71 disposed on an upstream edge of the intermediate conveyance apparatus 60 in the sheet conveyance direction of the through path PB at the lower face side of the lower unit 69.

The upstream portion of the air intake duct, that is, a portion on the side of the air intake port 71*a*, is formed of a lower face of the lower conveyance guide 85, that is, rear side of the surface facing the through path PB, a side wall portion protruding downward from the lower face, and the duct sheet 73. The downstream portion of the air intake duct, that is, a portion on the side of the first fan 71, is formed of the lower face of the first fan holder 72, the side wall portion protruding downward from the lower face, and the duct sheet 73.

As illustrated in FIG. 14, by hooking the duct sheet 73 to hook portions 71*g* and 85*a* that are provided on each of the first fan holder 72 and the lower conveyance guide 85 with the duct sheet 73 bent, the duct sheet 73 is assembled to the intermediate conveyance apparatus 60.

That is, according to the present embodiment, a duct configuration is formed by retrofitting a sheet member made of resin to the lower conveyance guide 85 and the first fan holder 72 constituting the casing of the intermediate conveyance apparatus 60. As a comparative example, in a case where a tubular duct shape is molded by resin using a mold, the mold shape becomes complex if the duct is molded integrally with the conveyance guide or the fan holder, however, if the duct is formed as a separate member, the number of steps is increased to attach and fix the duct. In contrast, according to the present embodiment, a part of the duct shape is disposed on the lower conveyance guide 85 and the first fan holder 72, and another portion of the duct shape, i.e., the lower face portion, is composed of a sheet member having flexibility, such that costs related to molds, the size of the apparatus, and the number of assembling steps can be reduced.

The intermediate conveyance apparatus 60 according to the present embodiment is disposed on an upper portion of the image forming apparatus 1. Therefore, the temperature of air near the first fan 71 arranged on the lower portion of the intermediate conveyance apparatus 60 that is the part facing the image forming apparatus 1 tends to rise by the heat generated in the image forming apparatus 1 during image formation. Fresh air can be taken in by arranging the air intake port 71*a* at the above-mentioned position, but the air intake duct connecting the air intake port 71*a* and the first fan 71 will have a long and bent shape. Especially, according to such a case, the above-mentioned advantages, such as saving of mold-related costs, can be realized by configuring the air intake duct using the duct sheet 73 as according to the present embodiment.

The duct sheet 73 can also be adopted in only a portion of the air intake duct. Further, the shape of the air intake duct can be changed arbitrarily according to the position of the air intake port and the first fan.

Inlet Sensor and Second Fan

Figure 15A:
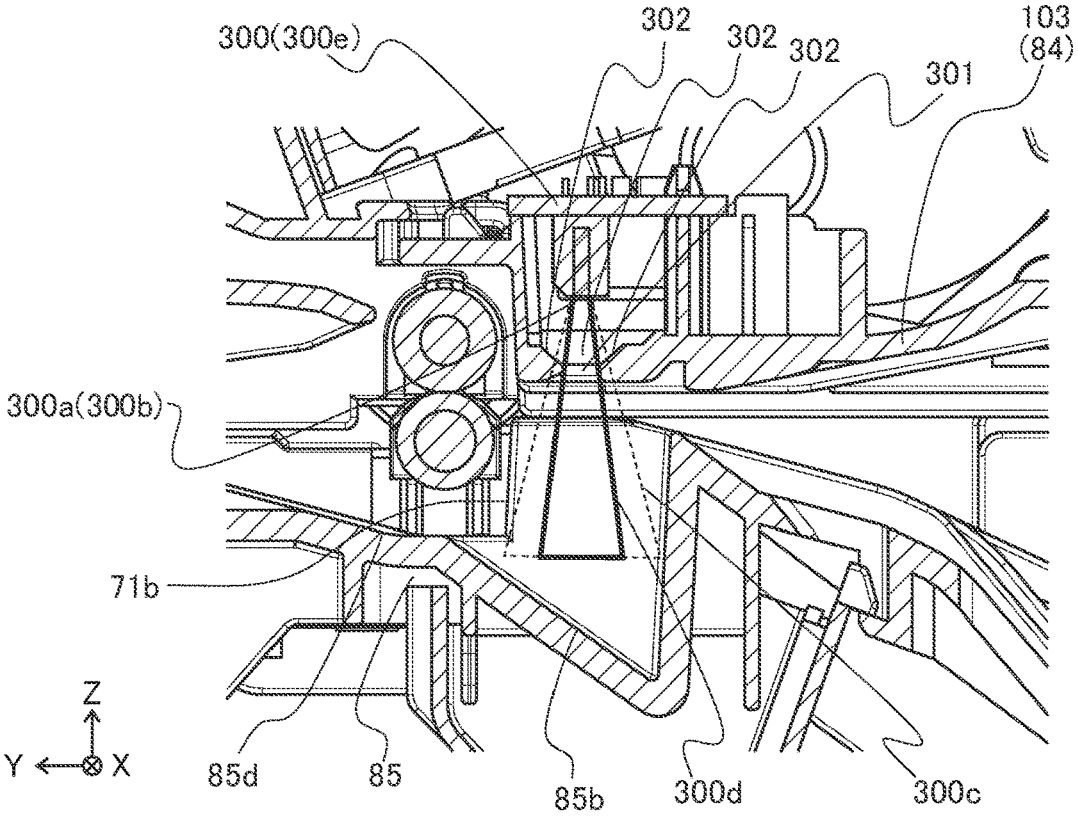
FIG. 15A is a view illustrating an inlet sensor of the intermediate conveyance apparatus according to the first embodiment.
Figure 15B:
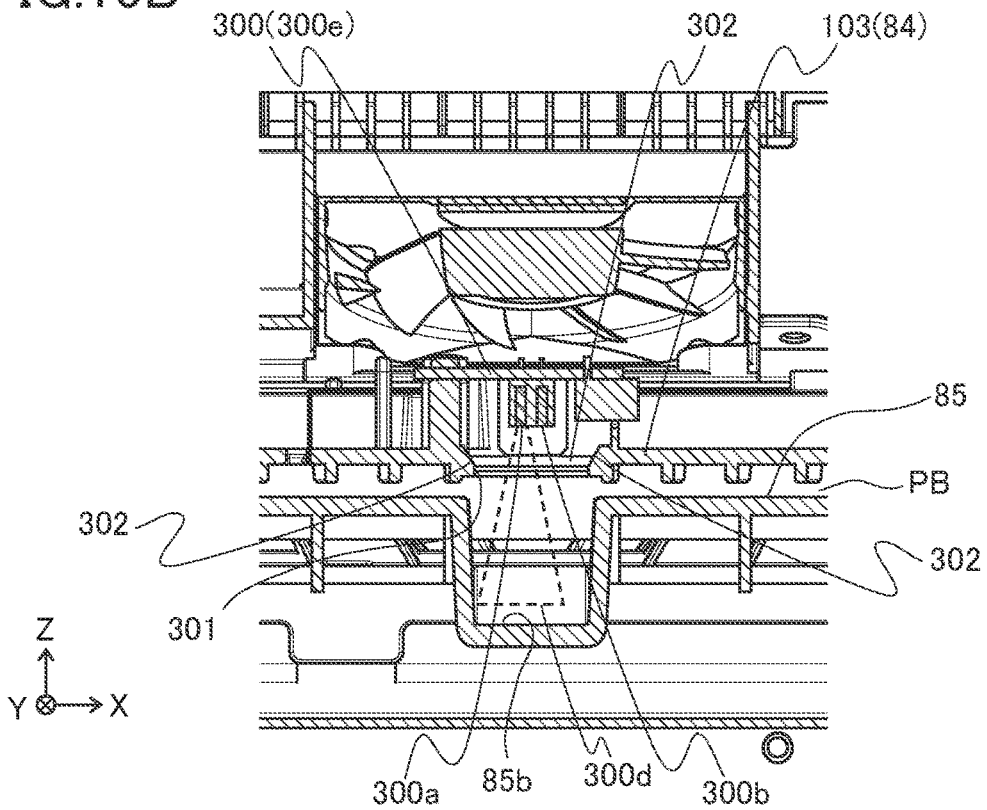
FIG. 15B is a view illustrating an inlet sensor of the intermediate conveyance apparatus according to the first embodiment.

The configuration of a vicinity of an inlet sensor 300 equipped in the intermediate conveyance apparatus 60 will be described with reference to FIGS. 15A to 18. FIG. 15A is a cross-sectional view in which a vicinity of the inlet sensor 300 is viewed from the front side of the apparatus. FIG. 15B is a cross-sectional view in which the vicinity of the inlet sensor 300 is viewed from the upstream side in the sheet conveyance direction.

As illustrated in FIGS. 15A and 15B, the inlet sensor 300 is attached to the frame 103 of the upper unit 68 and arranged on a rear side, i.e., upper side, of a guide surface of the upper conveyance guide 84. The inlet sensor 300 includes a board 300*e* on which a light emitting portion 300*a* and a light receiving portion 300*b* are mounted. The inlet sensor 300 according to the present embodiment is a reflection-type sensor, wherein the light emitted by the light emitting portion 300*a* is reflected on a sheet through a hole 301 on the frame 103, and by detecting the reflected light by the light receiving portion 300*b*, a signal corresponding to the presence and absence of a sheet is emitted. The inlet sensor 300 can be installed above the conveyance path to reduce the possibility of soiling of the light emitting portion 300*a* and the light receiving portion 300*b*, and the inlet sensor 300 is less likely to be influenced by paper dust and the like released from the sheet.

An area 300*c* denoted by dashed lines in FIGS. 15A and 15B indicates an irradiation range of light emitted from the light emitting portion 300*a*, for example, a range corresponding to a half-value angle, and an area 300*d* denoted by solid lines indicates an irradiation range of light focused by the hole 301 on the frame 103. The irradiation range of light is determined by the position of the edge of the hole 301. By focusing the irradiation range of light as described, detection accuracy of the sheet regarding the sheet conveyance direction can be improved. In other words, if the irradiation range of light is not focused, the sheet position in the sheet conveyance direction to which the inlet sensor 300 reacts may be dispersed by attachment angles of the light emitting portion 300*a* and the light receiving portion 300*b* or attachment tolerance of the board 300*e*. By focusing the irradiation range of light by the hole 301, the presence or absence of the sheet can be detected at a fixed position in the sheet conveyance direction.

It is preferable to form the wall surface of the hole 301 as an inclined plane 302 inclined toward the inlet sensor 300, and to form the surface of the inclined plane 302 to have a lower surface roughness compared to surfaces other than the hole 301. Thereby, the possibility of erroneous detection caused by irregularly reflected light on the inclined plane 302 entering the light receiving portion 300*b* can be reduced. Further, it is more preferable for the angle of the inclined plane 302 to be set such that light emitted by the light emitting portion 300*a* and directly reflected on the inclined plane 302 does not enter the light receiving portion 300*b*.

Meanwhile, as illustrated in FIG. 15B, regarding the sheet width direction, a width of the hole 301 is set wider than the irradiation range of light (300*c*) emitted from the light emitting portion 300*a*. Thereby, the possibility of erroneous detection of the presence or absence of the sheet S caused by the light reflected on the inclined plane 302 entering the light receiving portion 300*b* can be reduced.

Even if the detection position of the inlet sensor 300 is somewhat varied in the sheet width direction, there is no problem in detecting the passing timing of a sheet using the inlet sensor 300. Therefore, there is little need to focus the irradiation range of light by the hole 301 in respect to the sheet width direction. However, if a metal material having a high glossiness is arrange near the position of the lower conveyance guide 85 facing the inlet sensor 300, for example, it is possible to adopt a configuration in which the irradiation range of light is focused by the hole 301 also in the sheet width direction by narrowing the width of the hole 301 so as to reduce the possibility of erroneous detection.

Further, as illustrated in FIGS. 15A and 15B, the lower conveyance guide 85 includes a recess portion 85*b* formed at a position facing the light emitting portion 300*a* in an optical axis direction of the light emitting portion 300*a*. As illustrated in FIG. 15A, a bottom surface of the recess portion 85*b* is designed such that the light emitted from the light emitting portion 300*a* and subjected to specular reflection at the bottom surface of the recess portion 85*b* does not enter the light receiving portion 300*b*. Thereby, erroneous detection caused by light reflected on the bottom surface of the recess portion 85*b* entering the light receiving portion 300*b* can be reduced.

As illustrated in FIGS. 8A and 15B, the air blowing port 71*b* for blowing out air from the first fan 71 is not arranged at a position where the recess portion 85*b* is disposed on the lower conveyance guide 85. Further, as illustrated in FIG. 15B, when viewed in the sheet width direction, the area 300*d* to which light from the inlet sensor 300 is irradiated and the air passage through which air from the first fan 71 flows toward the air blowing port 71*b* overlap. The area that the inlet sensor 300 requires to detect the sheet is relatively small, and the air blowing out through the air blowing port 71*b* flows while spreading in the sheet width direction. Therefore, by adopting the above-described arrangement, the apparatus can be downsized while maintaining the performances of the inlet sensor 300 and the air blowing port 71*b*.

Figure 16:
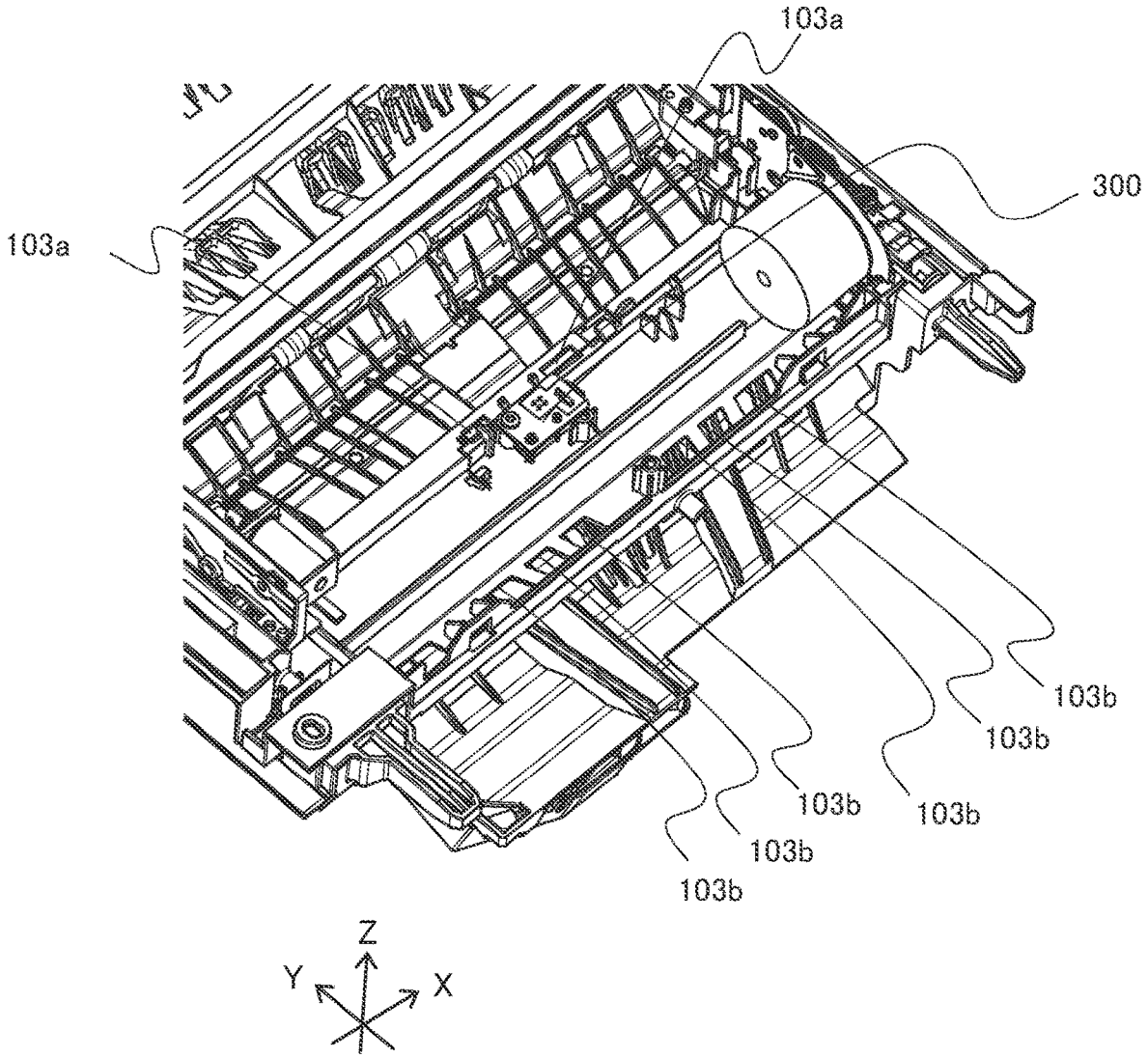
FIG. 16 is a view illustrating the inlet sensor of the intermediate conveyance apparatus according to the first embodiment.
Figure 17:
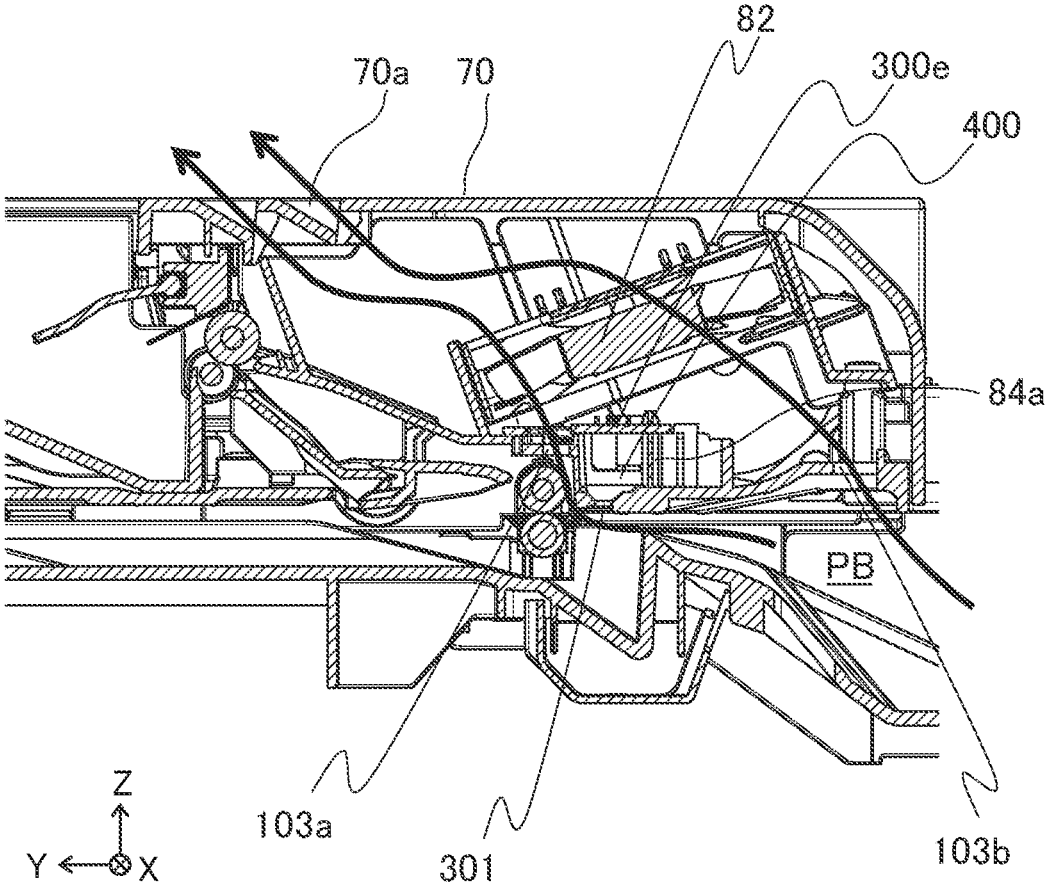
FIG. 17 is a view illustrating the inlet sensor of the intermediate conveyance apparatus according to the first embodiment.
Figure 18:
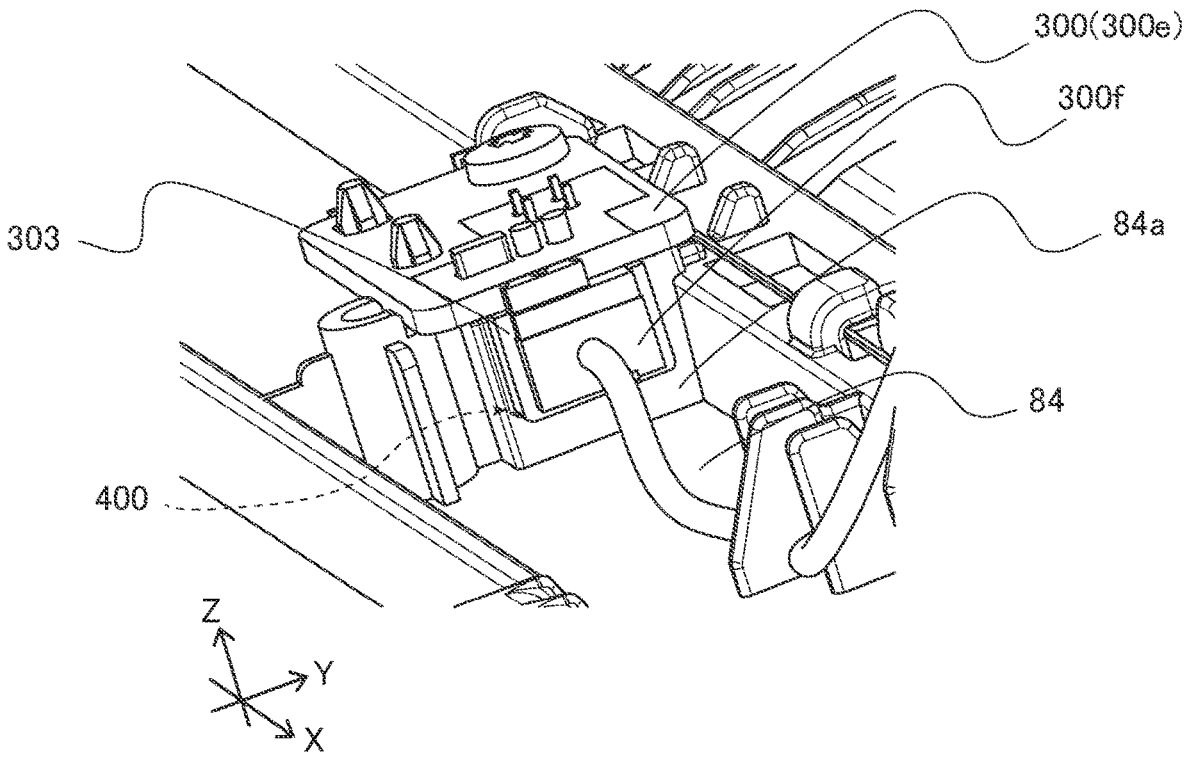
FIG. 18 is a view illustrating the inlet sensor of the intermediate conveyance apparatus according to the first embodiment.

FIG. 16 is a perspective view of a state in which the vicinity of the inlet sensor 300 of the upper unit 68 is viewed from above. In FIG. 16, a part of the members, such as the upper cover 70 of the upper unit 68 (FIG. 4A), is illustrated in perspective. FIG. 17 is a cross-sectional view of a vicinity of the inlet sensor 300 of the intermediate conveyance apparatus 60. FIG. 18 is a perspective view illustrating the vicinity of the inlet sensor 300 from a rear side of the intermediate conveyance apparatus 60.

As illustrated in FIGS. 16 and 17, air vent ports 103*a* and 103*b* are provided upstream and downstream in the sheet conveyance direction of the inlet sensor 300. The air vent ports 103*a* and 103*b* are formed to pass through from the face on the through path PB side of the frame 103, i.e., the upper conveyance guide 84, to a rear face thereof.

The second fan 82 is arranged in a space, i.e., inner space of the upper unit 68, between the frame 103, i.e., the upper conveyance guide 84, and the upper cover 70. The second fan 82 according to the present embodiment is an axial fan, i.e., propeller fan, that is arranged so as to send out the air sucked in from a lower side toward an upper side thereof. The second fan 82 takes in air from the through path PB through the air vent ports 103*a* and 103*b*, and discharges air through an air discharge port 70*a* disposed on the upper cover 70.

The second fan 82 can reduce the possibility of paper dust entering a space 400 in which the inlet sensor 300 is arranged by sucking in paper dust together with air from the conveyance path through the air vent ports 103*a* and 103*b*. The space 400 is a space formed by a rib 84*a* (FIGS. 17 and 18) protruded tubularly upward from the upper conveyance guide 84 in the area surrounding the hole 301, and it is a space receded toward a side separating from the through path PB with respect to the hole 301.

As illustrated in FIG. 18, the board 300*e* is attached to the rib 84*a* such that the board 300*e* of the inlet sensor 300 serves as a top cover of the space 400. Further, it is preferable to have an elastic member 303 inserted between the rib 84*a* and a connector 300*f* of the inlet sensor 300 to eliminate any gaps formed thereto. According to this configuration, the space 400 is sealed in an airtight manner, such that the possibility of paper dust entering the space 400 through the hole 301 is reduced even further. Therefore, attachment of paper dust and other soiling substances on the light emitting portion 300*a* and the light receiving portion 300*b* of the inlet sensor 300 can be suppressed.

Hinge Mechanism

Figure 19A:
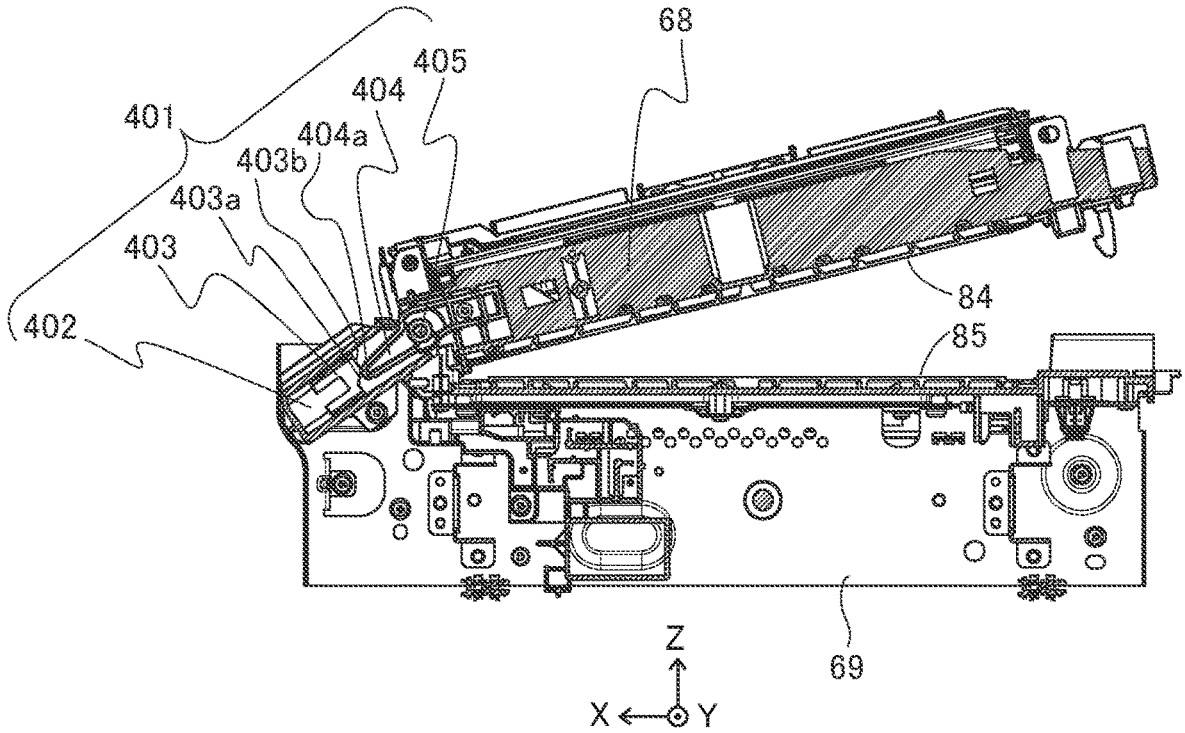
FIG. 19A is a view illustrating a hinge mechanism of the intermediate conveyance apparatus according to the first embodiment.
Figure 19B:
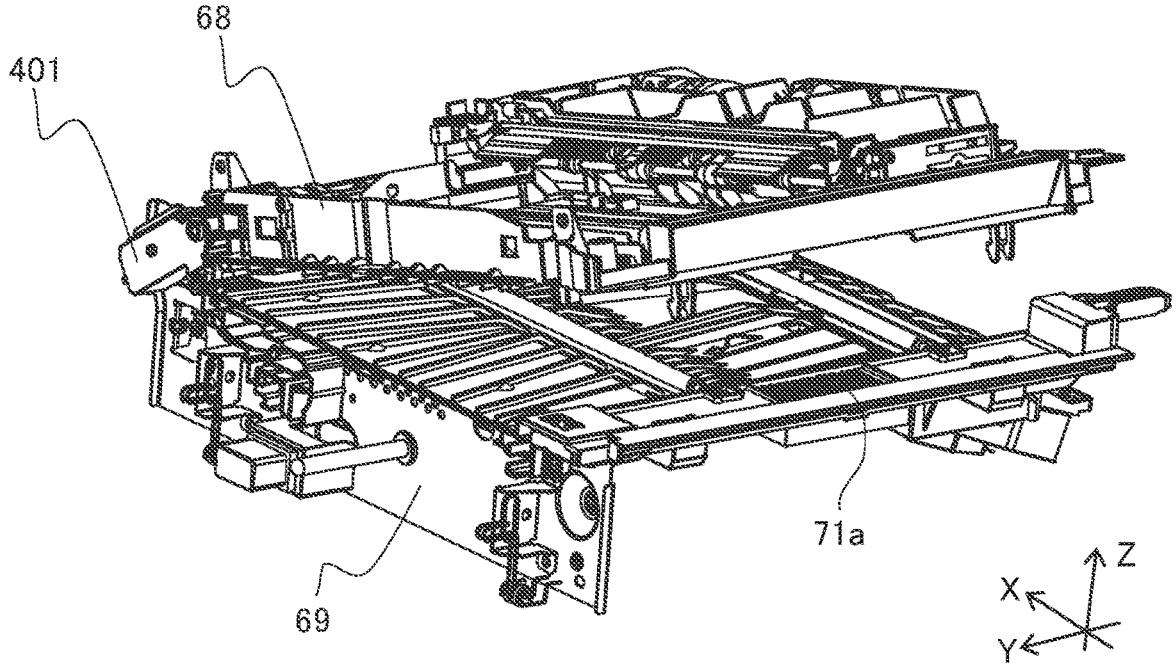
FIG. 19B is a view illustrating a hinge mechanism of the intermediate conveyance apparatus according to the first embodiment.

Next, with reference to FIGS. 19A and 19B, a hinge mechanism for opening and closing the upper unit 68 of the intermediate conveyance apparatus 60 will be described. FIG. 19A is a cross-sectional view illustrating the intermediate conveyance apparatus 60 in a state where the upper unit 68 is at an open position from the downstream side in the sheet conveyance direction (left side of FIG. 2). FIG. 19B is a perspective view of the intermediate conveyance apparatus 60 in a state where the upper unit 68 is at the open position. In FIG. 19B, a part of an exterior of the intermediate conveyance apparatus 60 is shown in perspective.

As illustrated in FIGS. 19A and 19B, the intermediate conveyance apparatus 60 includes a retention unit 401 serving as a hinge mechanism, or support mechanism, that supports the upper unit 68 in an openable and closable manner with respect to the lower unit 69. The retention unit 401 is composed of an urging spring 402, a holding cam 403, a rotating cam 404, and a rotating cam shaft 405.

The rotating cam 404 is disposed pivotably about the rotating cam shaft 405. The rotational axes of the upper unit 68 and the rotating cam 404 are the same, and the rotating cam 404 rotates integrally with the upper unit 68. The holding cam 403 is urged by the urging spring 402 toward the rotating cam 404. The holding cam 403 includes a first surface 403*a* and a second surface 403*b* as cam surfaces.

In a state where the upper unit 68 is in the open position, a leading edge portion 404*a* of the rotating cam 404 abuts against the first surface 403*a* of the holding cam 403. In this case, by having the holding cam 403 press the rotating cam 404 by the urging force of the urging spring 402, the upper unit 68 is urged toward the counterclockwise direction in the drawing and is held at the open position without closing by its own weight. In other words, the direction of the first surface 403*a* and the repulsive force of the urging spring 402 are set so as to hold the upper unit 68 in the open position.

In a state where the upper unit 68 is at the closed position, the leading edge portion 404*a* of the rotating cam 404 abuts against the second surface 403*b* of the holding cam 403. In this case, by having the holding cam 403 press the rotating cam 404 by the urging force of the urging spring 402, the upper unit 68 is urged toward the clockwise direction in the drawing and is held at the closed position. That is, the second surface 403*b* is inclined against the first surface 403*a* such that a direction of moment of the force acting on the upper unit 68 by the urging force of the urging spring 402 is switched in response to the position of the upper unit 68.

As illustrated in FIG. 19B, the retention unit 401 is arranged only on one side of the upper unit 68, and is attached from the outer side of the upper unit 68. That is, the retention unit 401 is arranged on a side wall portion downstream of the intermediate conveyance apparatus 60 in the sheet conveyance direction of the through path PB. Therefore, when assembling the intermediate conveyance apparatus 60, the retention unit 401 can be attached after assembling the inner structure of the upper unit 68. According to this configuration, low costs can be realized while ensuring accessing ability for jam removal processing and improving the assembling performance.

The intermediate conveyance apparatus 60 according to the present embodiment is attached to an in-drum delivery type image forming apparatus 1 (FIG. 1) in which sheets are discharged to the space between the image reading apparatus 2 and the main body of the image forming apparatus. Therefore, there is enough space for arranging the retention unit 401 on the side wall portion of the intermediate conveyance apparatus 60 on a far side from the sheet discharge roller pair 12 of the image forming apparatus 1 (FIG. 1), and the freedom of design is increased thereby.

In the present embodiment, the retention unit 401 is arranged only on one side, but in a case where the upper unit 68 is heavy, the retention unit 401 can be arranged on either side of the intermediate conveyance apparatus 60.

Modified Example

The present embodiment illustrates a configuration in which the air blowing port 71*b* for blowing out air from the first fan 71 is arranged upstream of the first roller pair 61 so as to simultaneously cool the first roller pair 61. Alternatively, the air blowing port 71*b* can be arranged downstream of the first roller pair 61. As an example, the duct from the first fan 71 can be extended through the gap G61 formed downstream of the first roller pair 61 of FIG. 7 so as to have the air blowing port 71*b* open downstream of the first roller pair 61 and upstream of the switching guide 65 in the sheet conveyance direction DB. Also according to this configuration, air can be sent efficiently to the branched conveyance paths, i.e., the through path PB and the sheet discharge path PA.

The present embodiment also illustrates a configuration in which the air blowing port 71*b* is disposed below the through path PB, such that air from the air blowing port 71*b* is mainly passed through below the first roller pair 61. Alternatively, it is possible to adopt a configuration in which the air blowing port 71*b* is disposed above the through path PB, such that air from the air blowing port 71*b* is mainly passed above the first roller pair 61.

The present embodiment illustrates a configuration in which the image forming system 1S includes the image reading apparatus 2 and the document sending apparatus 3. The air from the first fan 71 is passed through the air passage on the inner side of the intermediate conveyance apparatus 60 and discharged to the exterior of the apparatus through an opening, i.e., an opening where the air discharge pot 71*d* or the sheet discharge roller pair 63 is arranged, formed on the casing of the intermediate conveyance apparatus 60. Therefore, the air generated by the first fan 71 and discharged from the intermediate conveyance apparatus 60 causes the heat and humidity in the vicinity of the intermediate conveyance apparatus 60 to be removed to some extent, such that dew condensation at the lower face of the image reading apparatus 2 is reduced. However, the intermediate conveyance apparatus 60 illustrated in the present embodiment can also be applied to the image forming system 1S that does not include the image reading apparatus 2 and the document sending apparatus 3.

Second Embodiment

Next, a second embodiment according to the present disclosure will be described. It is assumed that the elements denoted with the same reference numbers as the first embodiment basically have the same configurations and functions as those described in the first embodiment.

Figure 20C:
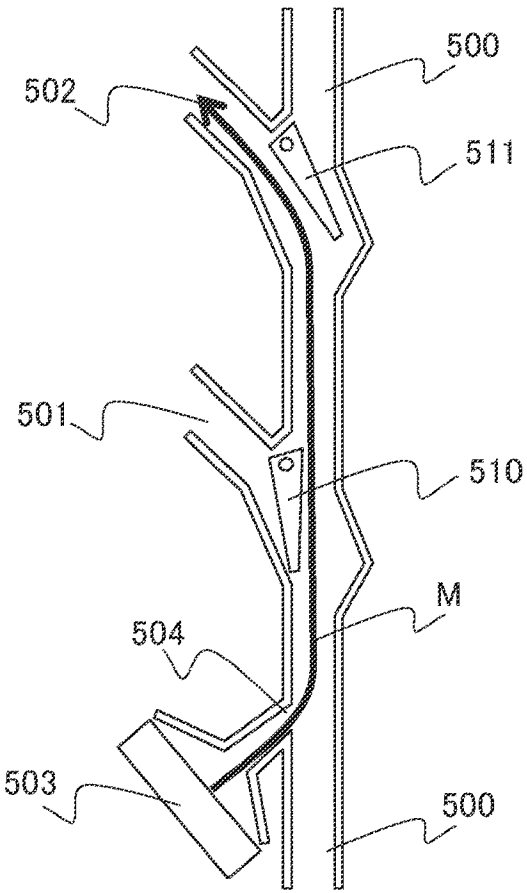
FIG. 20C is a schematic diagram illustrating a configuration of an intermediate conveyance apparatus according to a second embodiment.
Figure 20B:
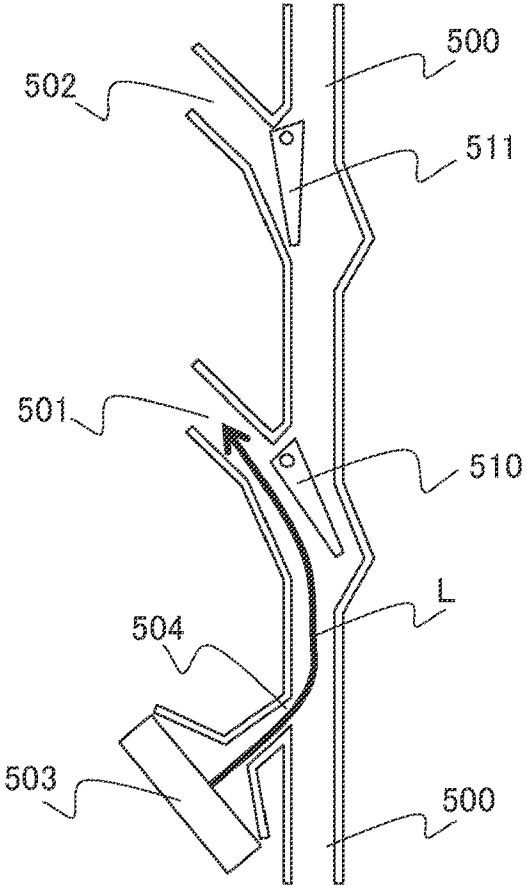
FIG. 20B is a schematic diagram illustrating a configuration of an intermediate conveyance apparatus according to a second embodiment.
Figure 20A:
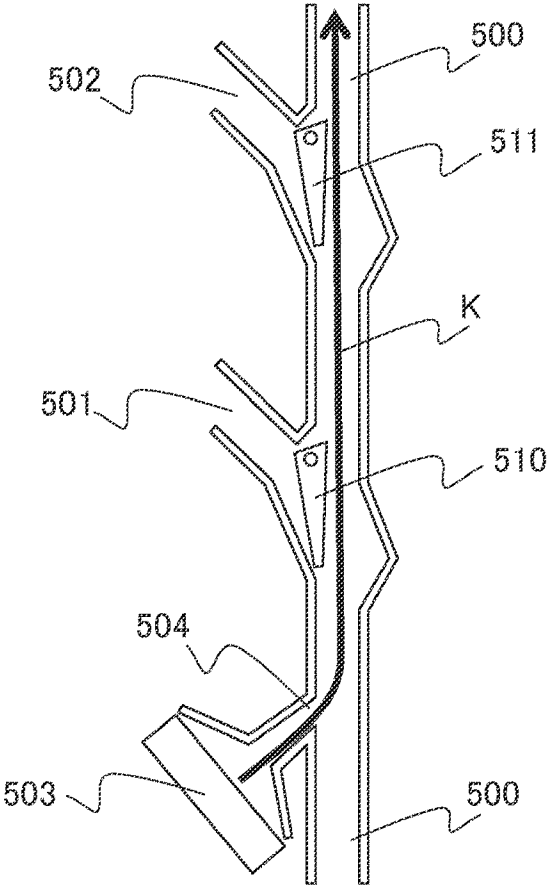
FIG. 20A is a schematic diagram illustrating a configuration of an intermediate conveyance apparatus according to a second embodiment.

FIGS. 20A to 20C schematically illustrate a relationship between the conveyance path 60P of the intermediate conveyance apparatus 60 and a first fan 503 of the intermediate conveyance apparatus 60 according to the present embodiment. The conveyance path 60P includes a through path 500 that extends from the image forming apparatus 1 toward the postprocessing apparatus 4, a first sheet discharge path 501 branched from the through path 500, and a second sheet discharge path 502 branched from the through path 500 at a position positioned downstream of the branch portion of the first sheet discharge path 501 in the sheet conveyance direction of the through path 500. The through path 500 serves as a first path according to the present embodiment, the first sheet discharge path 501 serves as a second path according to the present embodiment, and the second sheet discharge path 502 serves as a third path according to the present embodiment.

The first sheet discharge path 501 and the second sheet discharge path 502 are each a conveyance path for conveying a sheet to a conveyance destination that differs from the through path 500. The conveyance destination that differs from the through path 500 can be, for example, the intermediate sheet discharge tray 64, or if the postprocessing apparatus 4 has a plurality of reception ports, a reception port that differs from a sheet reception port from the through path 500.

A first switching guide 510 is arranged at a first branch portion where the first sheet discharge path 501 is branched from the through path 500. The first switching guide 510 is capable of moving to a position for guiding the sheet to the through path 500 and a position for guiding the sheet to the first sheet discharge path 501. A second switching guide 511 is arranged at a second branch portion where the second sheet discharge path 502 is branched from the through path 500. The second switching guide 511 is capable of moving to a position for guiding the sheet to the through path 500 and a position for guiding the sheet to the second sheet discharge path 502.

As described, the intermediate conveyance apparatus 60 has the conveyance path 60P including a plurality of branch portions, and by controlling the position of the plurality of switching guides, the sheet received from the image forming apparatus 1 can be conveyed to a desired conveyance destination.

An air blowing port 504 for blowing out the air from the first fan 503 to the conveyance path 60P is arranged upstream of a most upstream switching guide, that is, the first switching guide 510, in the sheet conveyance direction of the through path 500. Further, the air blowing port 504 is formed to blow the air from the first fan 503 toward a downstream side in the sheet conveyance direction of the through path 500.

Thereby, the air from the first fan 503 can be sent efficiently to the conveyance path 60P branched at the plurality of branch portions.

The ratio of amount of air from the first fan 503 flowing into each path can be varied according to the positions of the first switching guide 510 and the second switching guide 511.

Specifically, FIG. 20A illustrates a state in which the first switching guide 510 and the second switching guide 511 are positioned at positions for guiding the sheet to the through path 500. In this case, the air from the first fan 503 mainly flows along arrow K and cools the through path 500.

FIG. 20B illustrates a state in which the first switching guide 510 is positioned at a position for guiding the sheet to the first sheet discharge path 501. In this case, the air from the first fan 503 mainly flows along arrow L and cools the first sheet discharge path 501.

FIG. 20C illustrates a state in which the first switching guide 510 is positioned at a position for guiding the sheet to the through path 500 and the second switching guide 511 is positioned at a position for guiding the sheet to the second sheet discharge path 502. In this case, the air from the first fan 503 mainly flows along arrow M and cools the second sheet discharge path 502.

In each of the states illustrated in FIGS. 20A to 20C, gaps may be formed between the first switching guide 510 or the second switching guide 511 and members facing the first or second switching guide so that air is flown to paths other than the main path illustrated by arrows K, L, and M.

Third Embodiment

Figure 21A:
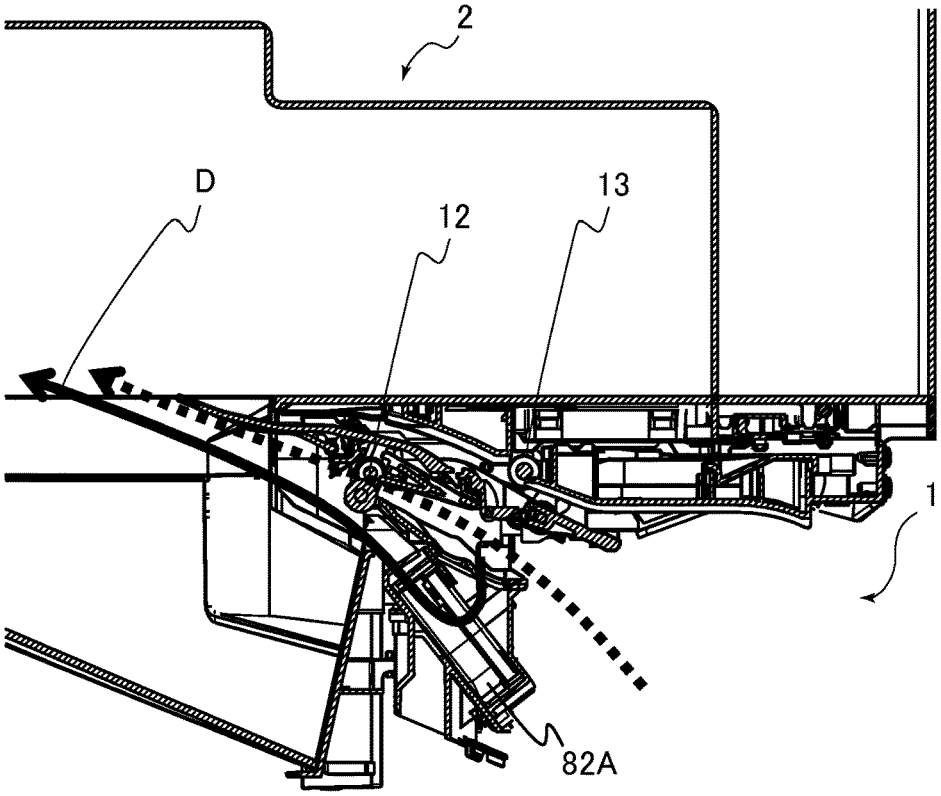
FIG. 21A is a cross-sectional view illustrating a part of an image forming apparatus according to a third embodiment.
Figure 21B:
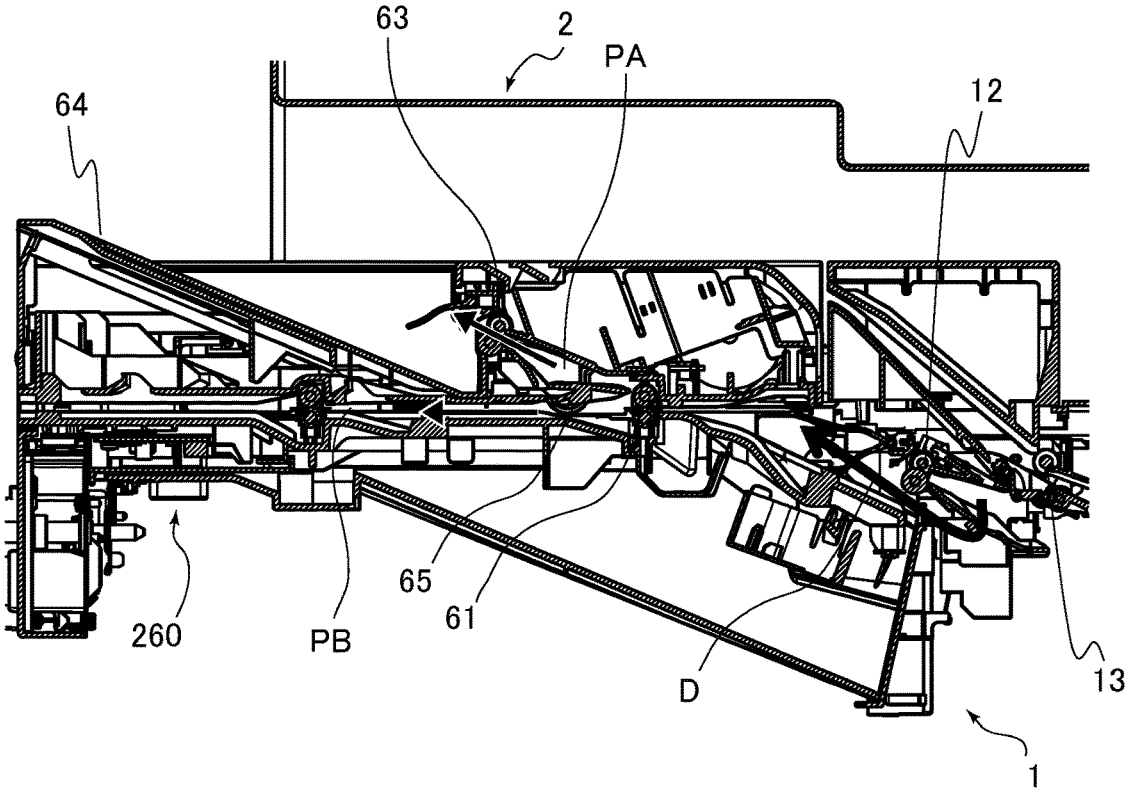
FIG. 21B is a cross-sectional view illustrating an intermediate conveyance apparatus according to the third embodiment.

As illustrated in FIGS. 21A and 21B, the wind generated by a fan 82A arranged in the image forming apparatus 1 can be taken into the intermediate conveyance apparatus 60 and distributed to the through path PB and the sheet discharge path PA by the switching guide 65.

FIG. 21A is a cross-sectional view illustrating a configuration of the image forming apparatus 1 of a case where the intermediate conveyance apparatus 60 is not attached. The fan 82A mounted on the image forming apparatus 1 takes in air from a conveyance path 66 of the sheet conveyed toward the sheet discharge roller pair 12, and discharges air through an air discharge port disposed in the vicinity of the sheet discharge roller pair 12 (arrow D).

FIG. 21B is a cross-sectional view illustrating a state in which the intermediate conveyance apparatus 60 is attached. In this case, the air discharged along the arrow D described above is taken into the through path PB via an opening formed on the image forming apparatus 1 side of the intermediate conveyance apparatus 60. Then, the air from the fan 82A is distributed to the through path PB and the sheet discharge path PA according to the position of the switching guide 65.

Even according to this configuration, air can be sent efficiently to the conveyance paths branched in the intermediate conveyance apparatus 60.

Fourth Embodiment

Next, a fourth embodiment will be described with reference to FIGS. 22 to 27. Hereafter, elements denoted with the same reference numbers as the first embodiment are assumed as having substantially the same configurations and effects as those described in the first embodiment.

In the first embodiment, flow of air being sent to the conveyance path 60P mainly by the first fan 71 has been described, whereas in the fourth embodiment, flow of air being sent to the upper unit 68 mainly by the second fan 82 will be described. Further, in the first embodiment, air was sent to the upper unit 68 by the second fan 82 through the air vent ports 103*a* and 103*b*, whereas in the fourth embodiment, air is taken into the upper unit 68 via a first air intake port 73*a* and a second air intake port 73*b*.

Hitherto, there were cases where conveyance failures or image defects of sheets occurred by the conveyed sheet coming into contact with dew condensation. The fourth embodiment aims at providing a sheet conveyance apparatus capable of reducing conveyance failures and image defects of sheets and an image forming system equipped with the same.

Intermediate Conveyance Apparatus

Figure 22:
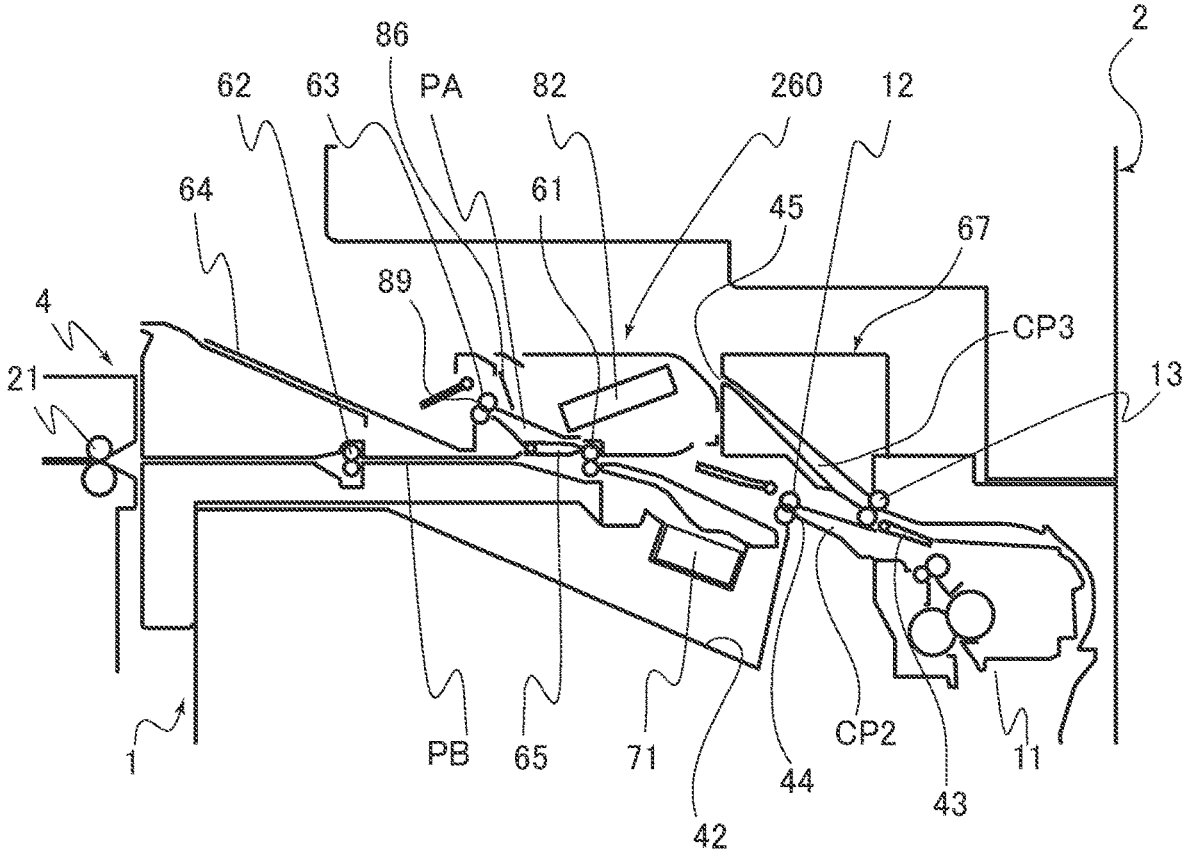
FIG. 22 is a schematic diagram illustrating an intermediate conveyance apparatus according to a fourth embodiment.

A configuration of an intermediate conveyance apparatus 260 according to the fourth embodiment will be described with reference to FIGS. 1 and 22 to 24B. As illustrated in FIGS. 1 and 22, the intermediate conveyance apparatus 260 is disposed on a sheet discharge tray 42 arranged on an upper portion of the image forming apparatus 1. The intermediate conveyance apparatus 260 is an apparatus for conveying sheets from the image forming apparatus 1 to the postprocessing apparatus 4, and it is an apparatus to be additionally attached to the image forming apparatus 1 when connecting the postprocessing apparatus 4 to the image forming apparatus 1. The image forming apparatus 1 can be used without being attached to the intermediate conveyance apparatus 260 and the postprocessing apparatus 4 as according to the present embodiment. In this case, the sheet discharge roller pair 12 of the image forming apparatus 1 discharges sheets to the sheet discharge tray 42.

When connecting the intermediate conveyance apparatus 260 to the image forming apparatus 1 and using the same, a dedicated reverse conveyance portion 67 is attached downstream of the reverse conveyance roller pair 13 serving as a reverse rotary member pair of the image forming apparatus 1. The image forming apparatus 1 includes a guide member 43 that guides the sheet having passed through the fixing unit 11 to a main body discharge conveyance path CP2 or a reverse conveyance path CP3. A first sheet discharge port 44 for discharging a sheet to an exterior of the apparatus is disposed at a downstream edge in a sheet conveyance direction of the main body discharge conveyance path CP2. The reverse conveyance path CP3 is disposed in the reverse conveyance portion 67, and a second sheet discharge port 45 for discharging a sheet to the exterior of the apparatus is disposed at the downstream edge in the conveyance direction of the reverse conveyance path CP3. The second sheet discharge port 45 is arranged at a position that differs from the first sheet discharge port 44. The guide member 43 pivots to guide the sheet to either the main body discharge conveyance path CP2 or the reverse conveyance path CP3.

The sheet guided to the main body discharge conveyance path CP2 by the guide member 43 is discharged to the exterior of the apparatus through the first sheet discharge port 44 by the sheet discharge roller pair 12 serving as a sheet discharge rotary member pair, and enters the intermediate conveyance apparatus 260. The intermediate conveyance apparatus 260 includes the first roller pair 61 for receiving sheets conveyed by the sheet discharge roller pair 12, the second roller pair 62 conveying the sheets in the through path PB serving as a conveyance path, the sheet discharge path PA branched from the through path PB, and the switching guide 65. The switching guide 65 pivots to guide the sheet conveyed by the first roller pair 61 to the sheet discharge path PA serving as the through path PB or a branched conveyance path.

The sheet guided to the sheet discharge path PA by the switching guide 65 is discharged onto the intermediate sheet discharge tray 64 disposed on an upper face of the intermediate conveyance apparatus 260 by the sheet discharge roller pair 63. The sheet guided to the through path PB by the switching guide 65 is conveyed by the second roller pair 62 and transferred to the inlet roller pair 21 of the postprocessing apparatus 4.

Figure 23A:
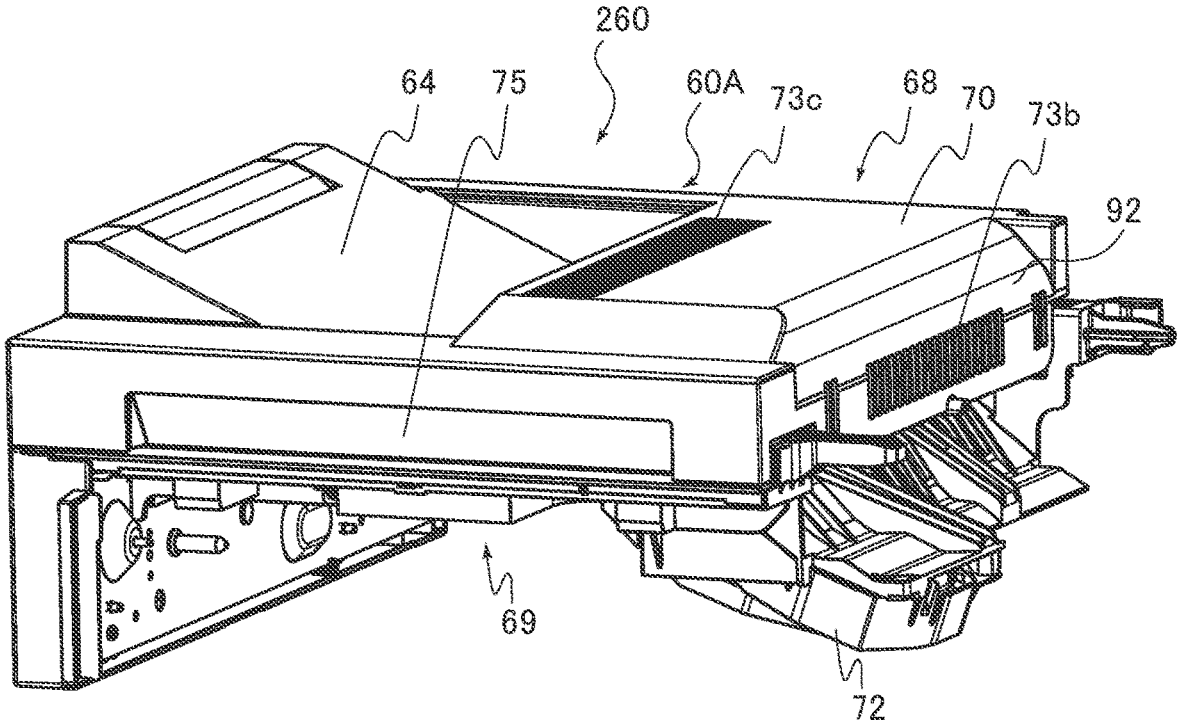
FIG. 23A is a perspective view illustrating the intermediate conveyance apparatus.
Figure 23B:
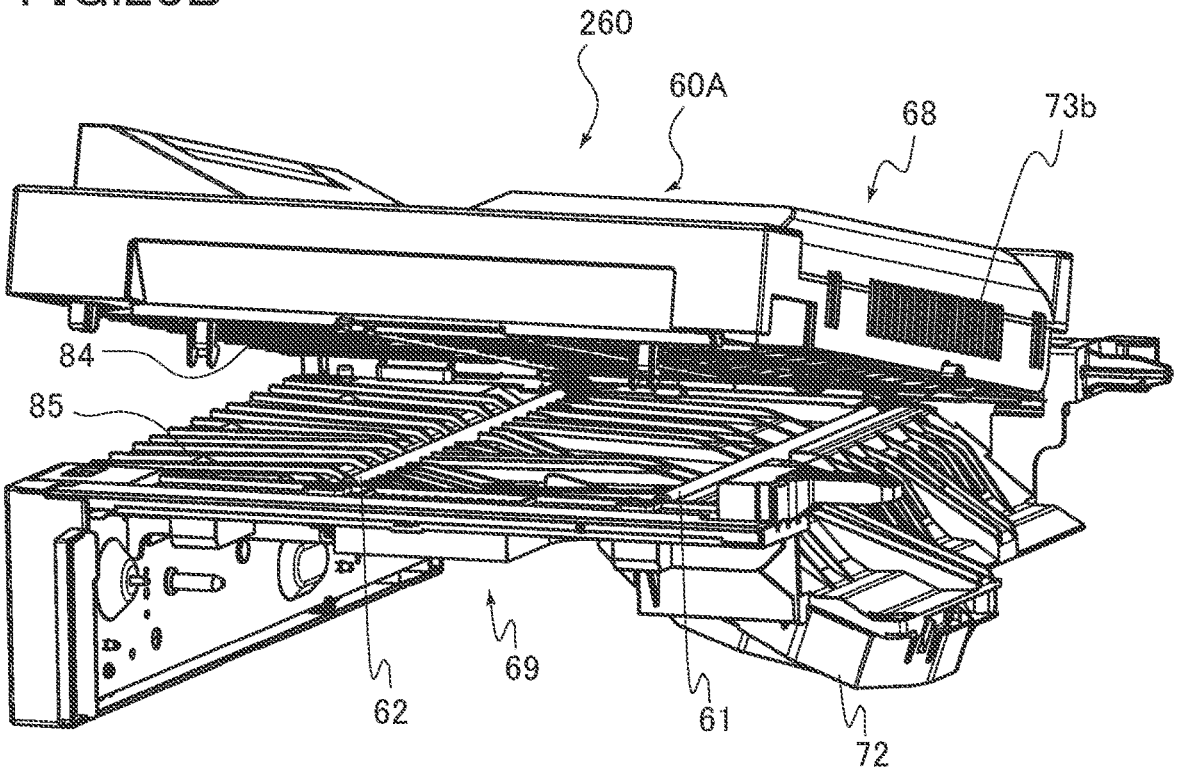
FIG. 23B is a perspective view illustrating the intermediate conveyance apparatus with a through path opened.

As illustrated in FIGS. 23A and 23B, the intermediate conveyance apparatus 260 includes the lower unit 69, and the upper unit 68 supported in an openable and closable manner via a hinge not shown to the lower unit 69. The lower unit 69 includes the first fan 71 serving as a second fan for sending air toward the through path PB, and the lower conveyance guide 85 serving as a first guide. The upper unit 68 includes the upper conveyance guide 84 serving as a second guide that faces the lower conveyance guide 85 and that forms the through path PB together with the lower conveyance guide 85. The upper unit 68 is opened upward with respect to the lower unit 69 by having the handle 75 provided on the upper unit 68 lifted up by the user. Thereby, the upper conveyance guide 84 is separated from the lower conveyance guide 85 and the through path PB is opened. By having the through path PB opened, the user can remove jammed sheets from the through path PB.

Figure 24A:
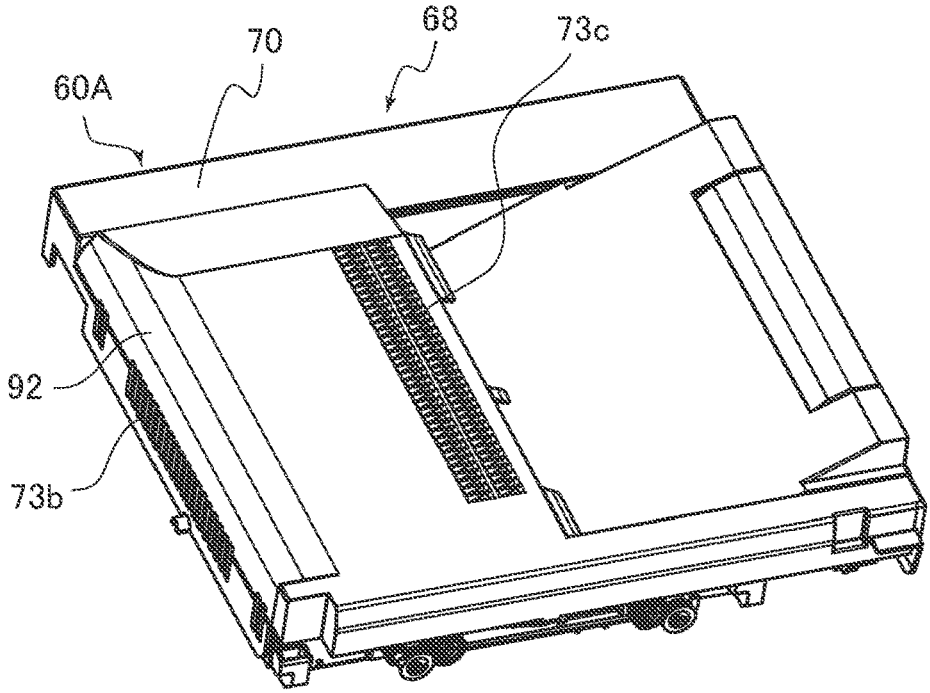
FIG. 24A is a perspective view illustrating an upper unit.
Figure 24B:
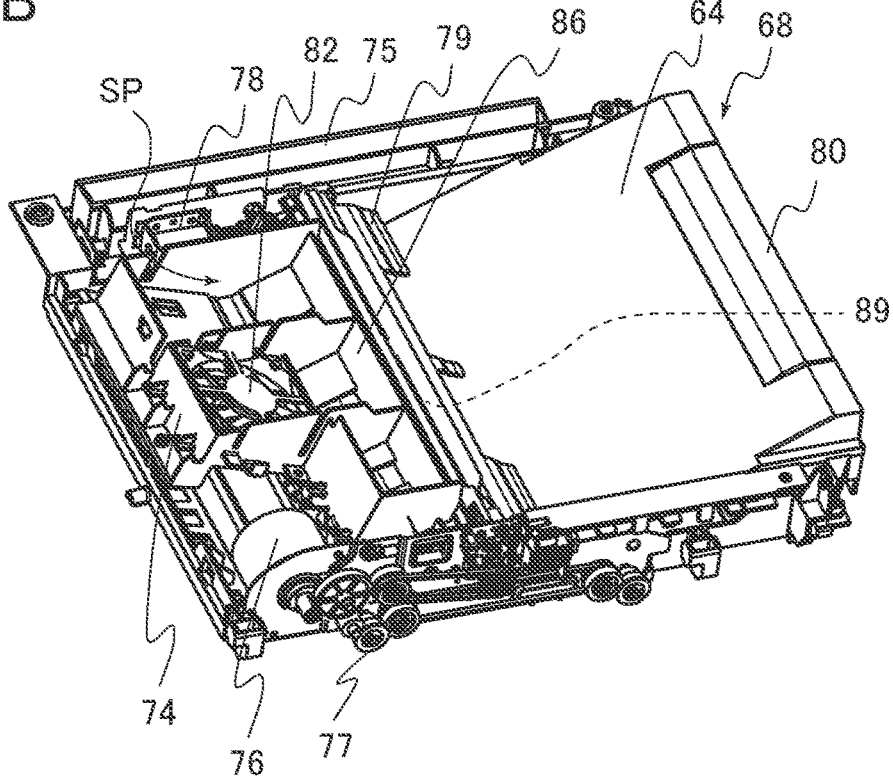
FIG. 24B is a perspective view illustrating an upper unit with an intermediate conveyance cover removed.

FIG. 24A is a perspective view illustrating the upper unit 68, and FIG. 24B is a perspective view illustrating the upper unit 68 with the upper cover 70 removed. FIGS. 24A and 24B illustrate the upper unit 68 from the rear side.

As illustrated in FIGS. 24A and 24B, the upper unit 68 includes the upper cover 70 forming the exterior of the upper unit 68, the second fan 82 that rotates and generates air current, and the fan holder 74 serving as a holding member for holding the second fan 82. The second fan 82 serving as a fan and a first fan is composed of an axial fan in which multiple blades are attached to a rotation shaft. The second fan 82 and the fan holder 74 are arranged in an area surrounded by the upper cover 70 and the through path PB (refer to FIG. 22). The fan holder 74 and the upper cover 70 form a communication space SP in which the second fan 82 is arranged.

As illustrated in FIGS. 22 and 24B, the sheet passing through the sheet discharge path PA is discharged to an exterior of the apparatus through the sheet discharge port 89 serving as a third sheet discharge port disposed at a downstream edge in the conveyance direction of the sheet discharge path PA. A partition wall 86 that separates the communication space SP and the sheet discharge port 89 is provided on the fan holder 74. Thereby, it becomes possible to reduce the amount of air sent by the second fan 82 serving as a fan leaking through the sheet discharge port 89.

Air Passage Configuration of Image Forming Apparatus

Figure 25A:
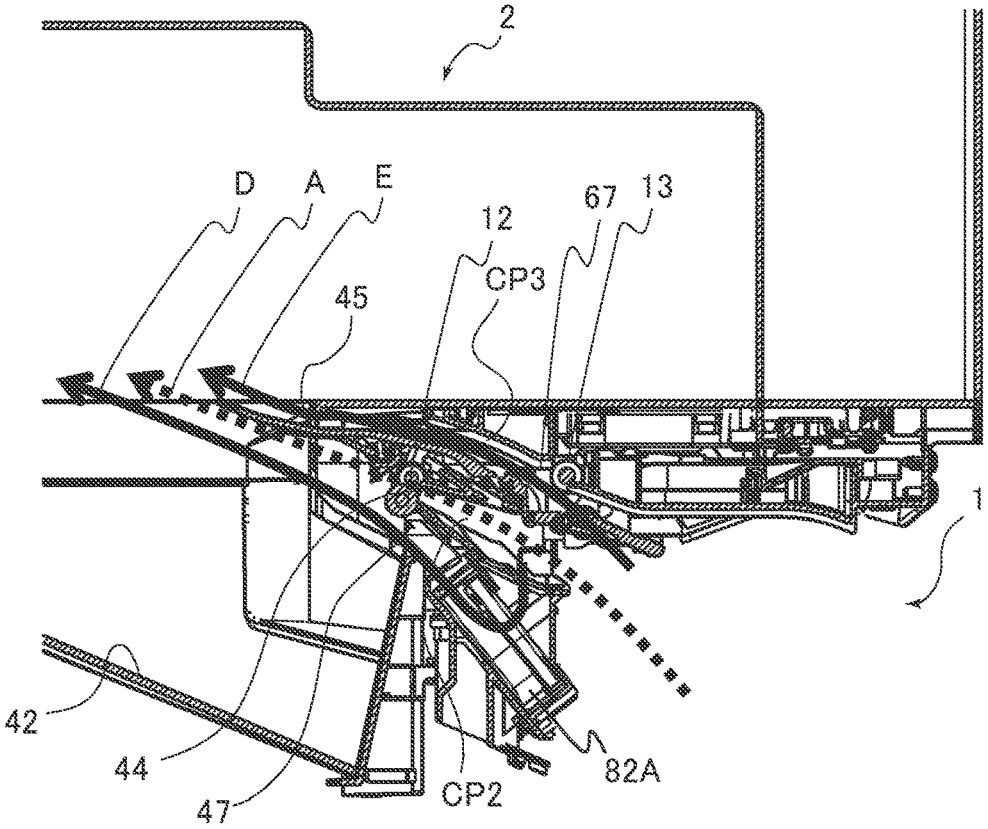
FIG. 25A is a cross-sectional view illustrating an air passage of the image forming apparatus.

Next, an air passage configuration of the image forming apparatus 1 will be described with reference to FIG. 25A. FIG. 25A is a cross-sectional view illustrating the image forming apparatus 1 in a state where the intermediate conveyance apparatus 260 is not attached. The image forming apparatus 1 includes the fan 82A serving as a third fan that rotates and generates air current. In FIG. 25A, arrow A shows a path of a sheet discharged through the main body discharge conveyance path CP2. Vapor that has been generated from the sheet is discharged by the fan 82A along arrow D. Air flowing through the reverse conveyance path CP3 is discharged through the second sheet discharge port 45 along arrow E. Air, or vapor, flowing along arrow D is discharged through a hole portion 47 disposed below the first sheet discharge port 44, but it can also be discharged through the first sheet discharge port 44.

Since arrows D and E are not blocked in the image forming apparatus 1 in a state where the intermediate conveyance apparatus 260 is not attached, air containing vapor is discharged to the exterior of the image forming apparatus 1 smoothly such that dew condensation does not easily occur.

Comparative Example

Figure 25B:
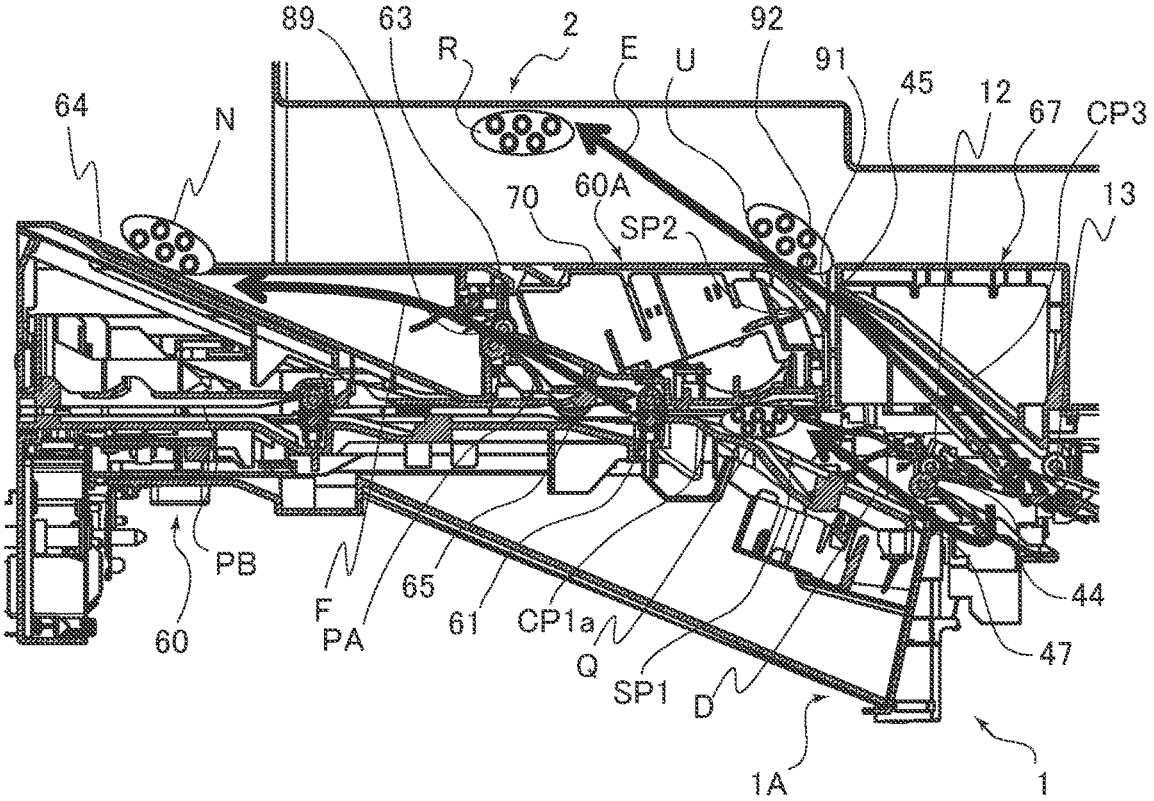
FIG. 25B is a cross-sectional view illustrating an air passage of an intermediate conveyance apparatus according to a comparative example.

FIG. 25B is a cross-sectional view illustrating the image forming apparatus 1 including an intermediate conveyance apparatus 160 serving as a comparative example with the second fan 82 not disposed. The configuration of the intermediate conveyance apparatus 160 is the same as the intermediate conveyance apparatus 260 described above except that the second fan 82 is not provided.

As illustrated in FIG. 25B, in a state where the intermediate conveyance apparatus 160 is attached to the image forming apparatus 1, discharge of air illustrated by arrows D and E is blocked by a casing 60A of the intermediate conveyance apparatus 160. The casing 60A includes the frame and the upper cover 70 of the intermediate conveyance apparatus 160.

Specifically, the air denoted by arrow D discharged through the hole portion 47 remains inside a first space SP1 surrounded by a casing 1A of the image forming apparatus 1 and the casing 60A of the intermediate conveyance apparatus 160, and dew condensation Q occurs at an inlet portion CP1*a* of the through path PB of the intermediate conveyance apparatus 260. Further, air denoted by arrow E passing through the reverse conveyance path CP3 is discharged to the exterior of the image forming apparatus 1 through the second sheet discharge port 45 and elevates, causing a dew condensation R on the surface of the image reading apparatus 2 disposed above the image forming apparatus 1.

Further, the air denoted by arrow E passing through the reverse conveyance path CP3 and discharged through the second sheet discharge port 45 contacts the upper cover 70 and causes dew condensation U on the upper cover 70. In other words, the air denoted by arrow E discharged through the second sheet discharge port 45 is sent to a second space SP2 between a first surface 91 of the casing 1A and a second surface 92 of the casing 60A, and causes the dew condensation U to occur on the second surface 92 which is a part of the upper cover 70. The second sheet discharge port 45 is formed on the first surface 91, and the first surface 91 and the second surface 92 face each other.

In a state where the intermediate conveyance apparatus 260 is attached to the image forming apparatus 1, the sheet discharged via the reverse conveyance path CP3 to the exterior of the apparatus through the second sheet discharge port 45 is guided while sliding, or abutting, against the second surface 92 of the upper cover 70. That is, the second surface 92 of the upper cover 70 functions as a guide member for guiding the sheets.

Further, the air denoted by arrow F passing through the sheet discharge path PA and discharged through the sheet discharge port 89 to the exterior of the apparatus contacts the intermediate sheet discharge tray 64 and causes dew condensation N to occur on the intermediate sheet discharge tray 64. When a sheet contacts the dew condensation that occurs as described above, conveyance failures and image defects of sheets may be caused.

Figure 26:
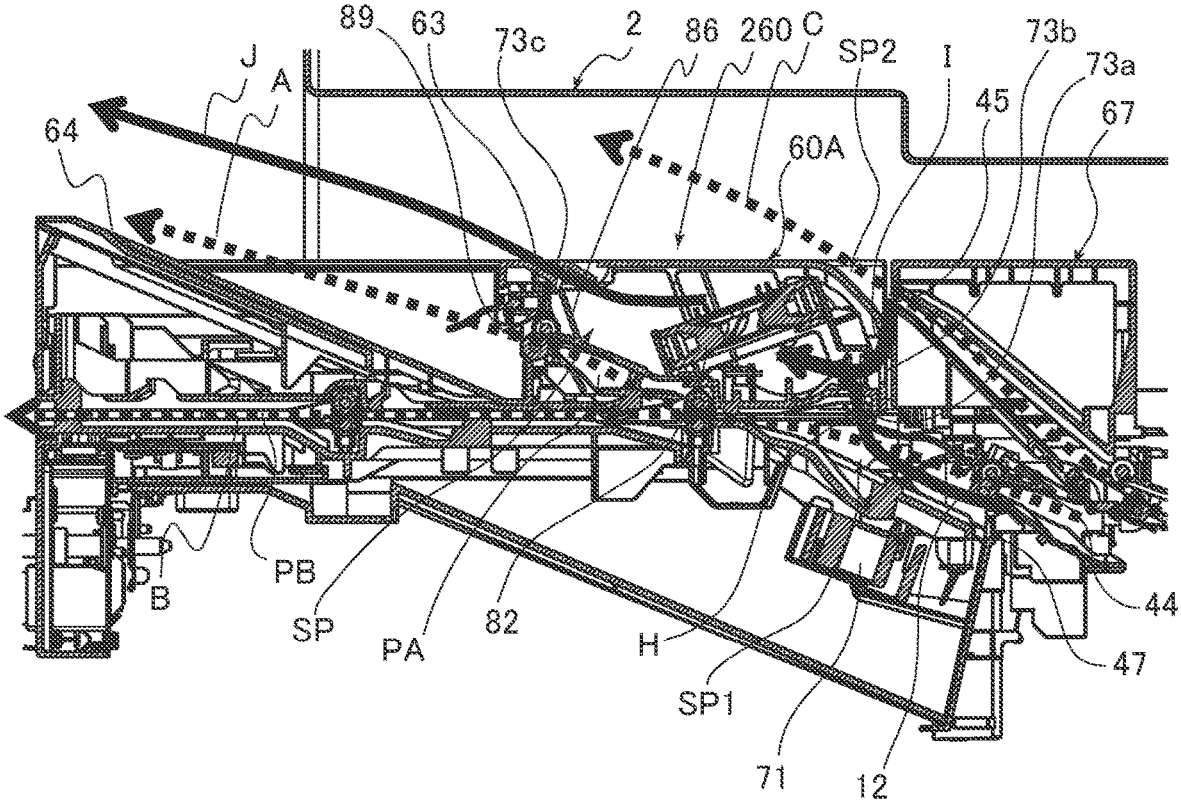
FIG. 26 is a cross-sectional view illustrating an air passage of the intermediate conveyance apparatus according to the present embodiment.
Figure 27:
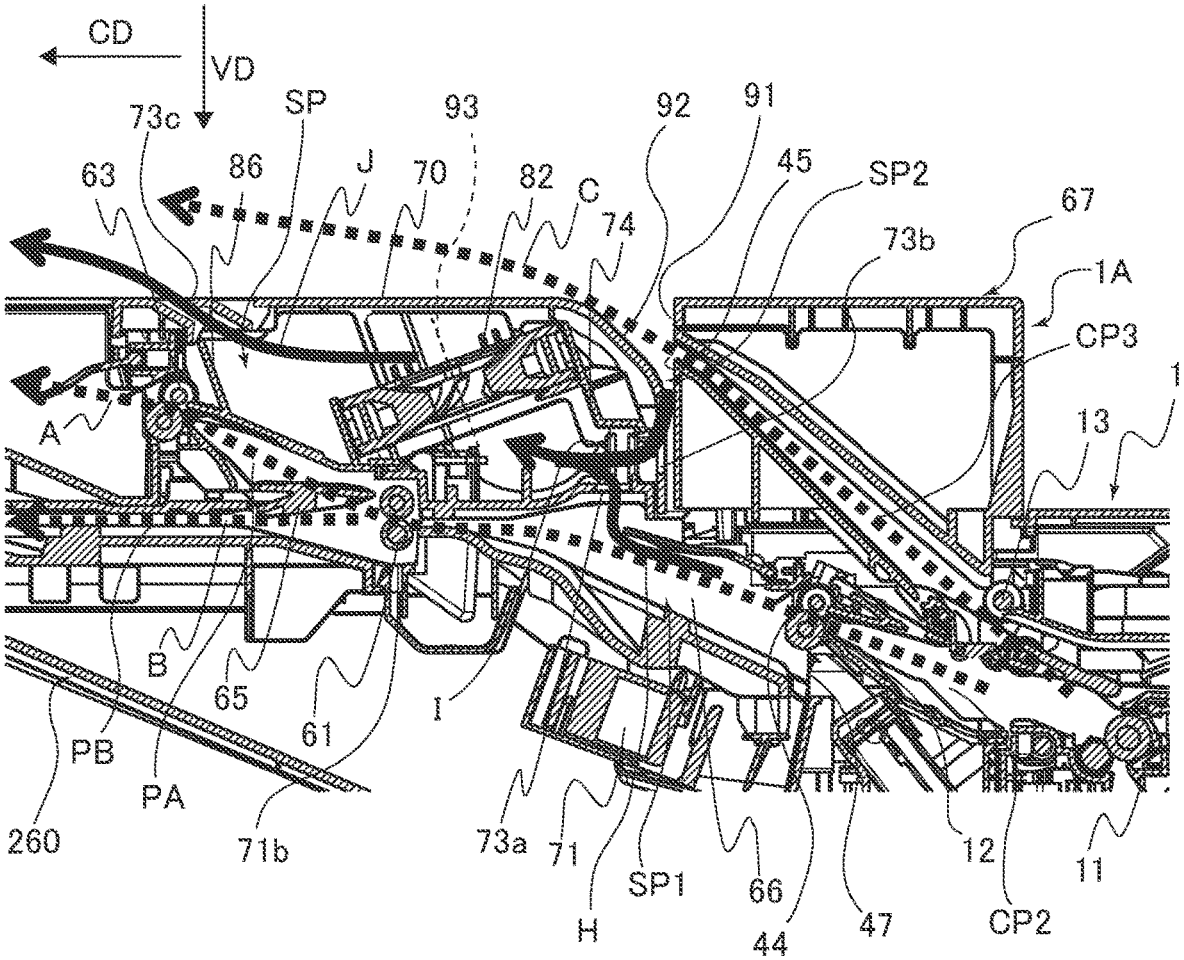
FIG. 27 is an enlarged cross-sectional view illustrating the intermediate conveyance apparatus.

Air Passage Configuration of Intermediate Conveyance Apparatus According to Present Embodiment Next, an air passage configuration of the intermediate conveyance apparatus 260 according to the preset embodiment will be described with reference to FIGS. 26 and 27. In FIGS. 26 and 27, arrow A denotes a path of the sheet passing through the main body discharge conveyance path CP2 and the sheet discharge path PA, arrow B denotes a path of the sheet passing through the main body discharge conveyance path CP2 and the through path PB, and arrow C denotes a path of the sheet passing through the reverse conveyance path CP3.

The first air intake port 73*a* composed of a plurality of holes is disposed, as illustrated in FIGS. 26 and 27, on a lower face of the upper unit 68 which constitutes a part of the casing 60A of the intermediate conveyance apparatus 260. The second air intake port 73*b* composed of a plurality of holes is disposed, as illustrated in FIGS. 23A, 23B, 24A, 26, and 27, on a side face of the upper unit 68 which constitutes a part of the casing 60A of the intermediate conveyance apparatus 260. An air discharge port 73*c* composed of a plurality of holes is disposed on an upper face of the upper unit 68 which constitutes a part of the casing 60A of the intermediate conveyance apparatus 260.

The first air intake port 73*a* is surrounded by the casing 1A of the image forming apparatus 1 and the casing 60A of the intermediate conveyance apparatus 160, and it is communicated with the first space SP1 through which the sheet discharged from the first sheet discharge port 44 passes. In the present embodiment, the second air intake port 73*b* is formed on the second surface 92 that defines the space SP2 described above. That is, the second air intake port 73*b* is formed between the first surface 91 and the second surface 92, and it is communicated with the second space SP2 through which the sheet discharged from the second sheet discharge port 45 passes. The hole portion 47 serving as an air discharge port of the image forming apparatus 1 is communicated with the space SP1.

In FIGS. 26 and 27, arrow H denotes air taken in by the second fan 82 through the hole portion 47 and the first air intake port 73*a*, and arrow I denotes air taken in by the second fan 82 through the second air intake port 73*b*. Arrow J denotes air discharged to the exterior of the intermediate conveyance apparatus 260 through the air discharge port 73*c* by the second fan 82.

The air discharge port 73*c* is arranged downstream of the first air intake port 73*a* and the second air intake port 73*b* in a conveyance direction CD, and arranged above the first air intake port 73*a* and the second air intake port 73*b* in a vertical direction VD. Further, the first air intake port 73*a* is arranged below the second air intake port 73*b*. Further, the second fan 82 is arranged downstream of the first air intake port 73*a* and the second air intake port 73*b* in the conveyance direction CD and arranged above the first air intake port 73*a* and the second air intake port 73*b*. The air discharge port 73*c* is arranged downstream of the second fan 82 in the conveyance direction CD and arranged above the second fan 82.

Further, the first air intake port 73*a* is arranged above the first sheet discharge port 44. According to this configuration, the air discharged into the first space SP1 (refer to arrow H) is elevated and naturally guided to the first air intake port 73*a*, such that air is efficiently taken in. Further, the second air intake port 73*b* is arranged below the second sheet discharge port 45. Thereby, the sheet discharged from the second sheet discharge port 45 and conveyed obliquely upward is prevented from being adhered to the second air intake port 73*b*, such that conveyance failure can be reduced.

As illustrated in FIG. 27, a rotational axis 93 of the second fan 82 is inclined with respect to the conveyance direction CD of the sheet conveyed through the through path PB and the vertical direction VD. More specifically, the rotational axis 93 is inclined upward with respect to the vertical direction VD as it moves downstream in the conveyance direction CD.

For example, the air containing vapor discharged from the sheet by being heated by the fixing unit 11 is discharged through the hole portion 47 of the image forming apparatus 1 into the first space SP1. Then, the second fan 82 rotates about the rotational axis 93 such that air within the first space SP1 is taken into the fan holder 74 through the first air intake port 73*a*, as indicated by arrow H. The fan holder 74 functions as a duct having the communication space SP formed in the interior thereof. The communication space SP is communicated with the first air intake port 73*a*, the second air intake port 73*b*, and the air discharge port 73*c*.

Further, the air passing through the main body discharge conveyance path CP2 and discharged through the second sheet discharge port 45 into the second space SP2 is taken into the fan holder 74 through the second air intake port 73*b*, as indicated by arrow I, by the second fan 82 rotating about the rotational axis 93.

Then, the second fan 82 sends the air taken into the fan holder 74 toward the air discharge port 73*c*. Even according to the relationship of arrangement of the first air intake port 73*a*, the second air intake port 73*b*, the second fan 82, and the air discharge port 73*c* described above, the rotational axis 93 is inclined with respect to the conveyance direction CD and the vertical direction VD, such that the second fan 82 can guide air appropriately to the air discharge port 73*c*.

Further, since the partition wall 86 is provided to the fan holder 74, the sheet discharge port 89 can be separated from the communication space SP, such that the air discharge efficiency can be improved. Moreover, the generation of dew condensation on the intermediate sheet discharge tray 64 by discharged air leaking from the sheet discharge port 89 can be suppressed, and conveyance failures and image defects of the sheets can be reduced.

The discharge direction of air being discharged through the air discharge port 73*c* is denoted by arrow J in FIGS. 26 and 27. The direction of arrow J is the direction that does not intersect with the casing 1A of the image forming apparatus 1 or the image reading apparatus 2. That is, the air discharged through the air discharge port 73*c* denoted by arrow J is designed to pass through between the intermediate sheet discharge tray 64 and the image reading apparatus 2. Thereby, it becomes possible to suppress the generation of dew condensation in the spaces SP1 and SP2 and on the exterior surface of the image forming apparatus 1 and the image reading apparatus 2, and to reduce conveyance failures and image defects of the sheets even in a state where the intermediate conveyance apparatus 260 is attached to the image forming apparatus 1. The direction of arrow J is determined, for example, by the direction of the second fan 82 or the direction in which the air discharge port 73*c* extends.

Other Embodiments

In the first to fourth embodiments described above, an example has been illustrated of a configuration in which a sirocco fan is used as the first fan 71 and an axial fan is used as the second fan 82. The present technique is not limited thereto, and other fans such as a mixed flow fan or a turbo fan can be used as the air blowing unit. The configurations of the second fan 82, the first fan 71, and the fan 82A can be selected arbitrarily from these various types of fans.

Further, the intermediate conveyance apparatus 60 or 260 described above can be connected to image forming apparatuses other than those adopting the electrophotographic system, such as an inkjet-type apparatus. In the case of an inkjet-type apparatus, generation of dew condensation, creasing of sheets, image defects and so on can be reduced by drying the sheets and the conveyance path using air supplied from the air blowing unit.

In the fourth embodiment, the rotational axis 93 of the second fan 82 has been disposed in an inclined manner with respect to the conveyance direction CD and the vertical direction VD, but the present invention is not limited thereto. For example, the rotational axis 93 of the second fan 82 can be arranged in parallel with the conveyance direction CD or the vertical direction VD as long as the second fan 82 can take in air from the first space SP1 and the second space SP2. In this case, for example, by changing the shape of the duct formed on the fan holder 74, the second fan 82 can be designed to take in air preferably from the first space SP1 and the second space SP2.

According to the fourth embodiment, the sheet discharge path PA and the intermediate sheet discharge tray 64 have been disposed on the intermediate conveyance apparatus 260, but they can also be omitted.

According further to the fourth embodiment, the air discharge port 73*c* has been arranged downstream in the conveyance direction CD of the first air intake port 73*a*, the second air intake port 73*b*, and the second fan 82, but the present technique is not limited thereto. For example, the air discharge port 73*c* can be arranged anywhere, as long as dew condensation does not occur on the casing 1A of the image forming apparatus 1 or the external surface of the image reading apparatus 2. In this case, the duct shape of the fan holder 74 can be changed.

According to the fourth embodiment, the first air intake port 73*a* has been arranged below the second air intake port 73*b*, but the present technique is not limited thereto, and the first air intake port 73*a* can be arranged above the second air intake port 73*b*.

According further to the fourth embodiment, the partition wall 86 has been provided in the fan holder 74, but the present technique is not limited thereto. The communication space SP within the fan holder 74 can be communicated slightly with the sheet discharge port 89, and the partition wall 86 can be disposed integrally with or separately from the fan holder 74. Further, the partition wall 86 can be disposed on the upper cover 70.

According to the first to fourth embodiments, the sheet discharge roller pair 12 and the reverse conveyance roller pair 13 are each composed of a pair of rollers, but the present technique is not limited thereto. For example, at least one of the rollers of the sheet discharge roller pair 12 and the reverse conveyance roller pair 13 can be replaced with a rotary member such as a belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-075403, filed Apr. 28, 2022, Japanese Patent Application No. 2022-092796, filed Jun. 8, 2022, Japanese Patent Application No. 2022-092797, filed Jun. 8, 2022, and Japanese Patent Application No. 2023-054938, filed Mar. 30, 2023, which are hereby incorporated by reference herein in their entirety.

What is claimed is:

1. A sheet conveyance apparatus configured to be connected to an image forming apparatus configured to form an image on a sheet, and a sheet processing apparatus configured to subject the sheet to a processing, the sheet conveyance apparatus being arranged on an upper face portion of the image forming apparatus and configured to receive the sheet from the image forming apparatus and convey the sheet to the sheet processing apparatus, the sheet conveyance apparatus comprising:

a conveyance path including a first path through which the sheet is conveyed toward the sheet processing apparatus and a second path branched from the first path;

a switching guide configured to switch a conveyance route of the sheet between the first path and the second path;

an air blowing unit arranged on a lower portion of the sheet conveyance apparatus and configured to send air toward the conveyance path;

an air intake port provided on an end portion on a front side of the sheet conveyance apparatus;

a duct configured to connect the air intake port and the air blowing unit; and an air blowing port configured to blow the air from the air blowing unit to the conveyance path, wherein the air blowing port is arranged upstream of the switching guide in a sheet conveyance direction of the first path and configured to blow the air toward a downstream side in the sheet conveyance direction.

2. The sheet conveyance apparatus according to claim 1, wherein the air blowing unit is a sirocco fan.

3. The sheet conveyance apparatus according to claim 1, wherein a part of the duct is composed of a sheet member having flexibility, the sheet member being held by a hook portion formed integrally with a guide member configured to form the conveyance path.

4. A sheet conveyance apparatus configured to be connected to an image forming apparatus including a first sheet discharge port configured to discharge a sheet, and a second sheet discharge port arranged at a position different from the first sheet discharge port and configured to discharge a sheet, the sheet conveyance apparatus including a conveyance path through which the sheet discharged through the first sheet discharge port is transferred to a sheet processing apparatus, the sheet conveyance apparatus comprising:

a first air intake port communicated with a first space through which the sheet discharged through the first sheet discharge port passes, the first space being surrounded by a casing of the image forming apparatus and a casing of the sheet conveyance apparatus;

a second air intake port communicated with a second space through which the sheet discharged through the second sheet discharge port passes, the second space being formed between a first surface provided on the casing of the image forming apparatus and a second surface provided on the casing of the sheet conveyance apparatus, the second sheet discharge port being formed on the first surface, the second surface facing the first surface;

a fan configured to rotate and generate an air current; and an air discharge port, wherein the fan takes in air through the first air intake port and the second air intake port and discharges air to an exterior of the sheet conveyance apparatus through the air discharge port.

5. The sheet conveyance apparatus according to claim 4, wherein the air discharge port is arranged downstream of the first air intake port and the second air intake port in a conveyance direction of a sheet passing through the conveyance path.

6. The sheet conveyance apparatus according to claim 4, wherein the first air intake port is arranged below the second air intake port.

7. The sheet conveyance apparatus according to claim 4, wherein the fan is arranged downstream of the first air intake port and the second air intake port in a conveyance direction of a sheet passing through the conveyance path, and arranged above the first air intake port and the second air intake port, wherein the air discharge port is arranged downstream of the fan in the conveyance direction and arranged above the fan, and wherein a rotational axis of the fan is inclined such that a more downstream portion thereof in the conveyance direction is higher in a vertical direction.

8. The sheet conveyance apparatus according to claim 4, wherein the first air intake port is arranged above the first sheet discharge port, and wherein the second air intake port is arranged below the second sheet discharge port.

9. The sheet conveyance apparatus according to claim 4, wherein a discharge direction of air discharged through the air discharge port is a direction not intersecting the casing of the image forming apparatus.

10. The sheet conveyance apparatus according to claim 4, further comprising:

a branched conveyance path configured to be branched from the conveyance path;

a third sheet discharge port configured to discharge a sheet passing through the branched conveyance path; and a holding member configured to hold the fan, wherein the holding member forms a communication space communicated with the first air intake port, the second air intake port, and the air discharge port, and includes a partition wall that separates the communication space from the third sheet discharge port.

11. The sheet conveyance apparatus according to claim 4, further comprising:

a lower unit including a first guide; and an upper unit including a second guide that faces the first guide and that forms the conveyance path together with the first guide, the upper unit being provided in an openable and closable manner with respect to the lower unit, wherein the fan is a first fan, wherein the first air intake port, the second air intake port, the first fan, and the air discharge port are provided in the upper unit, and wherein the lower unit includes a second fan configured to blow air toward the conveyance path.

12. An image forming system comprising:

an image forming apparatus including:

a first sheet discharge port configured to discharge a sheet; and a second sheet discharge port arranged at a position different from the first sheet discharge port and configured to discharge a sheet;

a sheet processing apparatus configured to process a sheet; and a sheet conveyance apparatus configured to be connected to the image forming apparatus and includes a conveyance path configured to convey a sheet discharged through the first sheet discharge port to the sheet processing apparatus, wherein the sheet conveyance apparatus includes:

a first air intake port communicated with a first space through which the sheet discharged through the first sheet discharge port passes, the first space being surrounded by a casing of the image forming apparatus and a casing of the sheet conveyance apparatus;

a second air intake port communicated with a second space through which the sheet discharged through the second sheet discharge port passes, the second space being formed between a first surface provided on the casing of the image forming apparatus and a second surface provided on the casing of the sheet conveyance apparatus, the second sheet discharge port being formed on the first surface, the second surface facing the first surface;

a fan configured to rotate and generate an air current; and an air discharge port, wherein the fan takes in air through the first air intake port and the second air intake port and discharges air to an exterior of the sheet conveyance apparatus through the air discharge port.

13. The image forming system according to claim 12, wherein the image forming apparatus includes:

a sheet discharge rotary member pair configured to convey a sheet through the first sheet discharge port to the conveyance path; and a reverse rotary member pair configured to convey a sheet to the second sheet discharge port in a first direction, and thereafter, convey the sheet to a second direction opposite to the first direction.

14. The image forming system according to claim 13, wherein the second surface is configured to come into contact with a sheet that is conveyed in the first direction by the reverse rotary member pair and that is discharged to an exterior of the image forming apparatus through the second sheet discharge port.

* * * * *